US006592339B1

(12) United States Patent
Fukushima et al.

(10) Patent No.: US 6,592,339 B1
(45) Date of Patent: Jul. 15, 2003

(54) SMALL PUMP DEVICE AND SPHYGMOMANOMETER USING THE PUMP DEVICE

(75) Inventors: Toshiaki Fukushima, Tokyo (JP); Yoshirou Nakamoto, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/508,122

(22) PCT Filed: Jul. 8, 1999

(86) PCT No.: PCT/JP99/03711

§ 371 (c)(1),
(2), (4) Date: Mar. 6, 2000

(87) PCT Pub. No.: WO00/03141

PCT Pub. Date: Jan. 20, 2000

(30) Foreign Application Priority Data

| | | |
|---|---|---|
| Jul. 8, 1998 | (JP) | 10-192577 |
| Nov. 4, 1998 | (JP) | 10-312835 |
| Jan. 7, 1999 | (JP) | 11-001565 |
| Feb. 23, 1999 | (JP) | 11-44428 |
| Mar. 8, 1999 | (JP) | 11/059809 |

(51) Int. Cl.[7] ..... F09B 27/08

(52) U.S. Cl. ..... 417/269; 91/499; 92/71; 92/98 R

(58) Field of Search ..... 417/269; 91/499; 92/71, 98 R

(56) References Cited

U.S. PATENT DOCUMENTS

| | | | | |
|---|---|---|---|---|
| 1,554,628 A | * | 9/1925 | Froelich | 417/269 |
| 2,839,008 A | * | 6/1958 | Stansfield | 417/269 |
| 4,801,249 A | * | 1/1989 | Kakizawa | 417/269 |
| 5,497,614 A | * | 3/1996 | Duva | 60/39.63 |

FOREIGN PATENT DOCUMENTS

| | | |
|---|---|---|
| CH | 503 202 | 2/1971 |
| FR | 2.207.539 | 6/1974 |
| JP | 62-291484 | 12/1987 |
| JP | 6-42457 | 2/1994 |
| JP | 9-293659 | 11/1997 |
| JP | 10-054363 | 2/1998 |
| JP | 11-201049 | 7/1999 |

* cited by examiner

*Primary Examiner*—Charles G. Freay
(74) *Attorney, Agent, or Firm*—Scully Scott Murphy & Presser

(57) ABSTRACT

Disclosed is a small-sized pump device that is constructed of a motor constituting the small-sized pump device, a case member mounted on an output-shaft surface of the motor, a rotary circular-cylindrical member making a rotational movement due to the rotation of the motor, an air chamber formed of a soft elastic member, a drive member for compressing and expanding the air chamber, an intermediate case equipped with a suction opening and an exhaust opening, a suction valve and an exhaust valve for preventing the back flow of the air, and a case lid equipped with a suction opening and an exhaust opening. On the outer surface of the rotary circular-cylindrical member is provided a spiral guide portion engaged with a part of the drive member so that the drive member may be displaced at prescribed pitches in response to the rotation of the rotary circular-cylindrical member. This makes it possible to highly efficiently convert the rotational movement of the motor to a linear movement for making compression/expansion of the air chamber.

34 Claims, 41 Drawing Sheets

Fig. 4
(a)
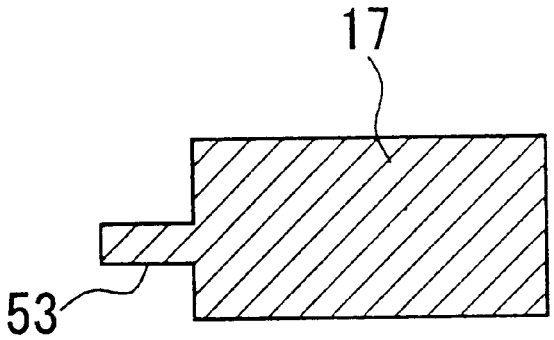
(b)
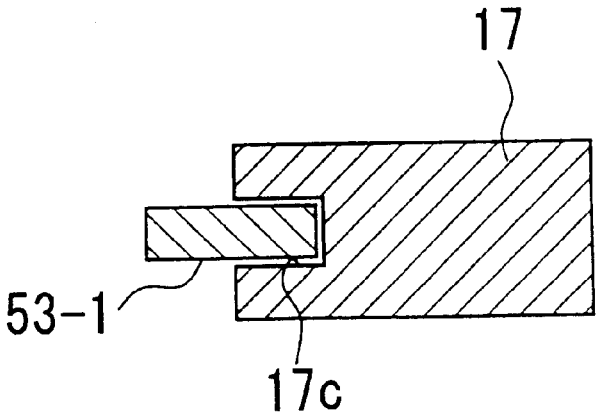

Fig. 8
(a)
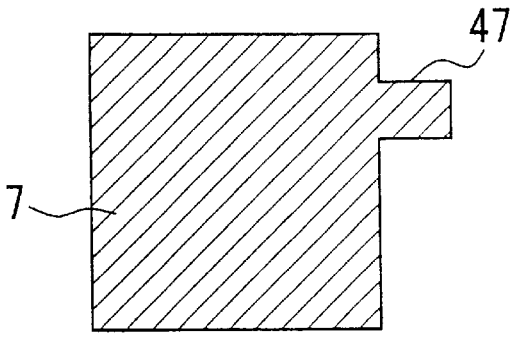
(b)
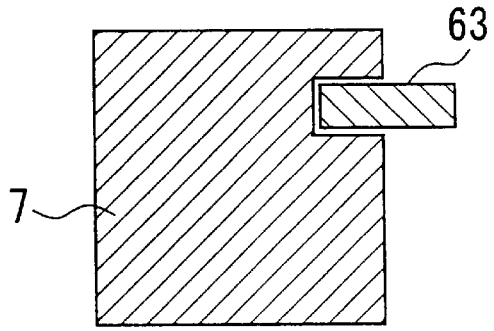
Fig. 9
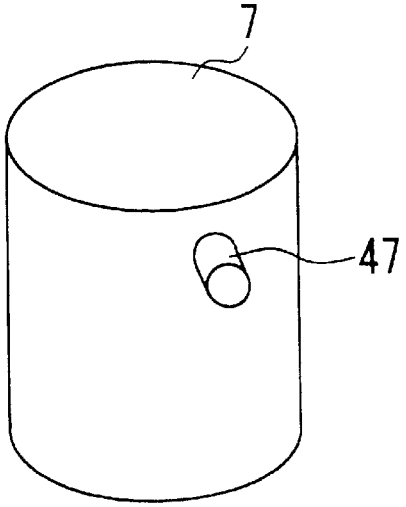

Fig. 22
(a)
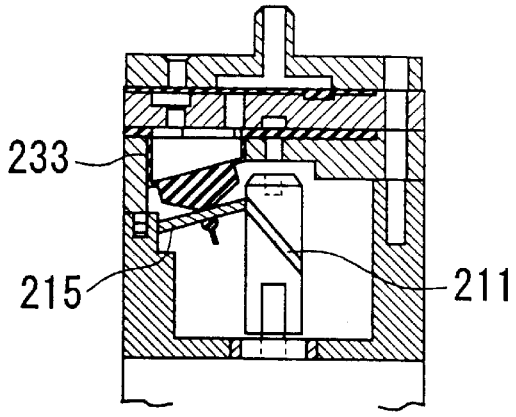
(b)
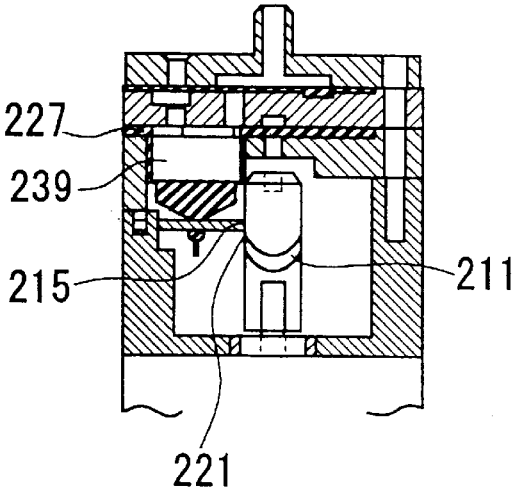
(c)
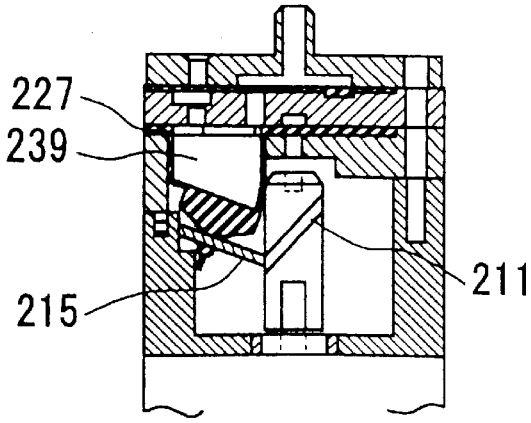

Fig. 25
(a)
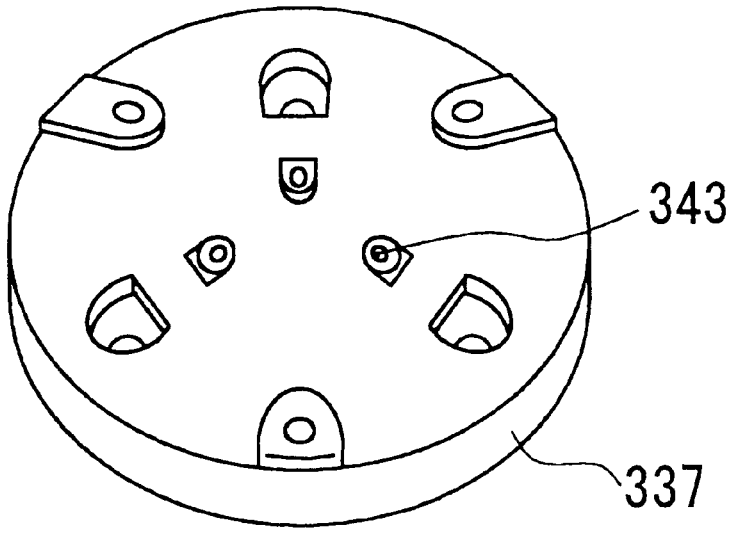
(b)
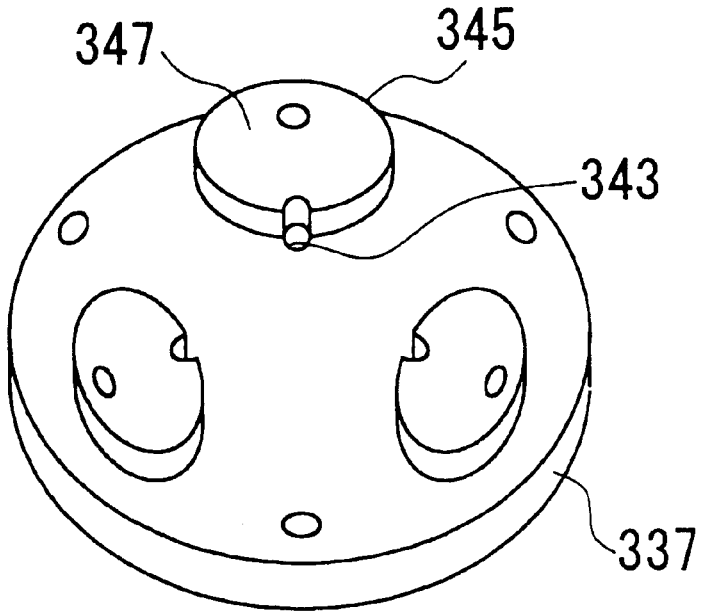

Fig. 33
(a)
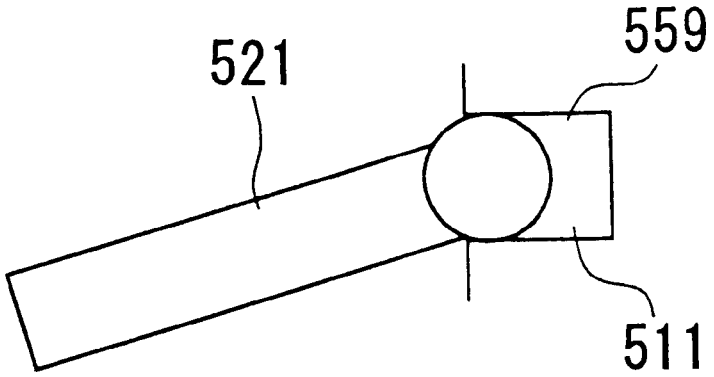
(b)
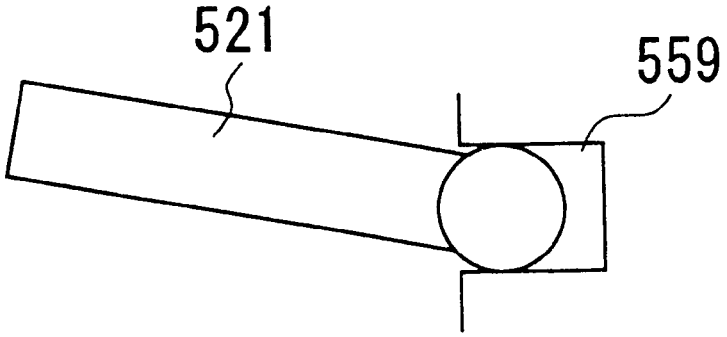

Fig. 34
(a)
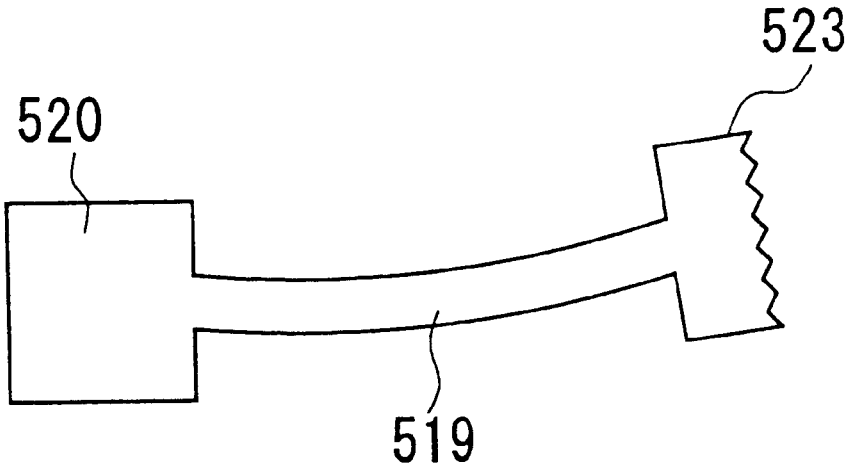
(b)
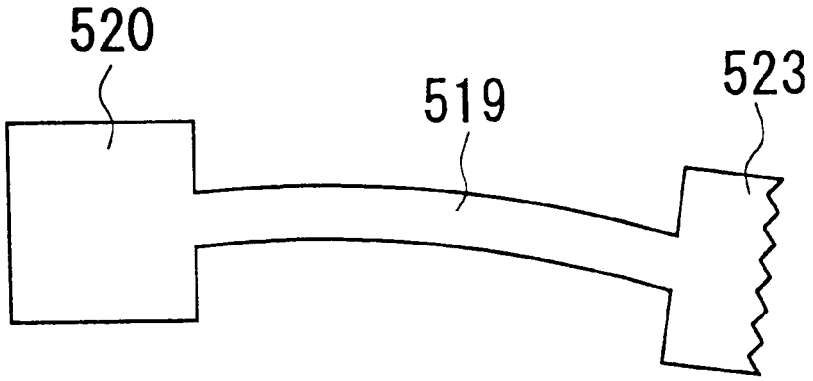

Fig. 37

| | | CP3-1 | CP3-2 | CP3-3 | MADE BY OK COMPANY | REMARKS |
|---|---|---|---|---|---|---|
| (1) MAXIMUM PRESSURE | | 549.4mmHg | 565.2mmHg | 574.8mmHg | 769.9mmHg | CAN BE PRESSURIZED UP TO 400mmHg OR MORE BY APPLICATION OF A RATED VOLTAGE |
| (2) PRESSURIZING TIME PERIOD | M CUFF (0~300mmHg) | 14.9 sec | 14.0 sec | 13.7 sec | 10.5 sec | 330cc (at280mmHg) CAPACITY OF M CUFF |
| | L CUFF (0~300mmHg) | 45.3 sec | 42.3 sec | 42.4 sec | 32.4 sec | 1000cc (at280mmHg) CAPACITY OF L CUFF |
| (3) VALUE OF CURRENT CONSUMPTION | AVERAGE VALUE | 236.0 mA | 233.0 mA | 257.4 mA | 363.8 mA | AVERAGE VALUE WHEN PRESSURIZING CUFF UP TO 0~300mmHg |
| (4) NOISE | | 50.6 dB | 53.0 dB | 52.2 dB | 53.3 dB | PUMP UNIT ONLY, 30cm LATERALLY AWAY, NOISE METER: A RANGE. MAXIMUM VALUE DURING PRESSURIZATION FROM 0 TO 200mmHg |
| (5) LEAK OF AIR | AT THE TIME OF HIGH PRESSURE 300mmHg | OK | OK | OK | OK | AFTER PRESSURIZATION, STOP THE PUMP AND LEAVE IT AS IS FOR 30 SEC. PRESSURE REDUCTION THAT THEREAFTER OCCURS IS 3mmHg/MIN OR LESS |
| | AT THE TIME OF LOW PRESSURE 50mmHg | 2.2mmHg/min | 4.2mmHg/min | 0.7mmHg/min | 5/6 1mmHg<br>1/6 6mmHg | EFFECT GREAT BY CLEANING WITH ALCOHOL |
| (6) RE-START | | OK | OK | OK | OK | CAN BE STARTED WHEN VOLTAGE 3V'S BEEN APPLIED UNDER A STATE OF PRESSURIZATION AT 200mmHg. THEREAFTER REACHES PRESSURE OF UP TO 300mmHg |

| | | Type-CP3 | MADE BY OK COMPANY | REMARKS |
|---|---|---|---|---|
| (7) BATTERY LIFT | | 1911 (ALKALI BATTERY) | 1610 (ALKALI BATTERY) | CP 3-1 REPRESENTS DATA WHEN N=1<br>OK REPRESENTS AVERAGE DATA WHEN N=10. |
| (8) DURABILITY | | | 30,000 TIMES OR MORE | REPEATEDLY PRESSURIZE UNTIL 0 TO 300mmHg AND DISCHARGE AIR 30,000 TIMES OR MORE. THEREAFTER MEASURE. |

BLOOD PRESSURE METER BLOCK DIAGRAM

FLOW CHART SHOWING PNEUMATIC SYSTEM

Fig. 42
Prior Art
(a)
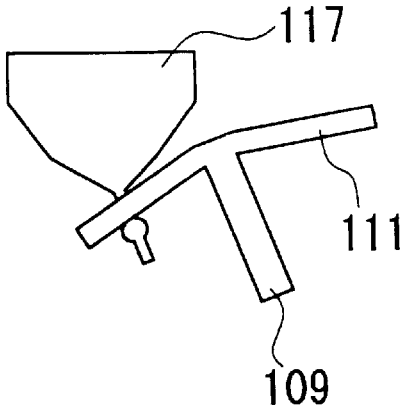
(b)
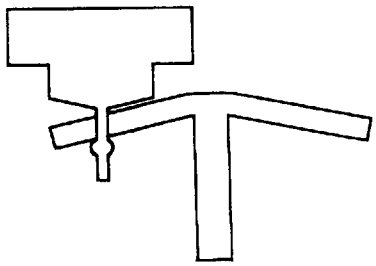
(c)
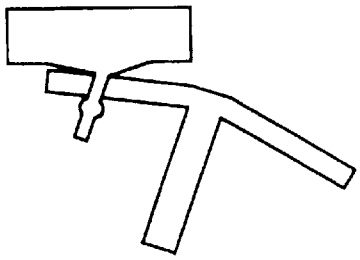

SMALL PUMP DEVICE AND SPHYGMOMANOMETER USING THE PUMP DEVICE

BACKGROUND OF THE INVENTION

1. Field of the Invention

The present invention relates to a small-sized pump device that is used as means for sending air into a cuff band member for use on a blood pressure meter or into various kinds of air supplies and applying pressure to its interior, and a blood pressure meter using this small-sized pump device.

2. Description of the Related Art

A general type of blood pressure meter has an appearance such as that illustrated in FIGS. 38(A) and 38(B) and has a construction illustrated in FIG. 39.

When having its main body cover 79 demounted, the blood pressure meter has equipped therein an electromagnetic valve 87, a display panel 81, a control circuit 93, a small-sized. pump device 91, a pressure sensor 89, and a slow leak valve 85. The cuff band member 83 and a group of the small-sized pump device 91, slow leak valve 85, electromagnetic valve 87, and pressure sensor 89 are connected to each other by means of a hollow tube 95.

And, when turning on a measuring switch after a power source is supplied to the blood pressure meter, the electromagnetic valve is closed, and the small-sized pump device performs its pumping operation to thereby speedily send air into the cuff band member and thereby pressurize the same. And, when the pressurization of the cuff band member up to a set value has been sensed by the pressure sensor, the small-sized pump device is stopped. And the pressure within the cuff band member is reduced by gradually discharging the air therewithin at a fixed speed through the slow leak valve. And while this pressure is being reduced, measurement is performed of a change in pressure and measurement is performed of the blood pressure value and the pulsation. After completion of such measurements, the electromagnetic valve is released in order to speedily discharge the air remaining within the cuff band member. And display is made of the measurement results on the display panel.

The above-described operation will now be explained with reference to a flow chart of FIG. 40 illustrating a pneumatic system as well as with reference to an electric block diagram of FIG. 39. First, the cuff band member 83 that is connected to the blood pressure meter is wound around the arm to thereby make preparations for measurement. Next, when having turned on the power source button of the blood pressure meter, the conditions to be set in the pressurization, etc., are displayed on the display panel 81. Here, in a case where set conditions to be set in the pressurization should be changed, this change can be made by operating pressurization set buttons. In a case where performing no changes in the set conditions, a push is made on a measurement-starting button.

When the measurement-starting button is pushed, an electric power is supplied to the electromagnetic valve 87, whereby the electromagnetic valve 87 is closed.

Almost simultaneously with this, the power is also supplied to the small-sized pump 91, whereby air is sent into the cuff band member 83 by the small-sized pump 91.

Regarding the pressured value within the cuff band member 83, into which air is sent, the analog signal obtained from the pressure sensor 89 is converted to a digital value by an A/D converter circuit, which is arbitrarily detected by a microcomputer (the control circuit 93). The power is supplied to the small-sized pump 91 until the pressure value within the cuff band member reaches from 0 mm Hg to the pressure value of the set conditions for the pressurization (e.g., a set value ranging from 160 to 280 mm Hg).

The control circuit compares the digital value with the set value and, when the digital signal is smaller than the set value, continues to drive the pump. When the pressure within the cuff band member 83 reaches the set value, the control circuit stops the small-sized pump device 91. On the other hand, the slow leak valve 85 gradually discharges the air within the cuff band member 83 with units of a fixed amount (several mm Hg/sec) and thereby goes on reducing the pressure therewithin.

During this time period, the fluctuation in the pressure in the cuff band member is measured as pulse waves by the pressure sensor 89 and is sampled at prescribed intervals by the microcomputer 93.

By the pulse waves being detected, the maximum blood pressure, the minimum blood pressure, and the pulsation are respectively determined. Generally saying, at the point in time when the pressure reduction has been made up to approximately 50 mm Hg, the measurement of the maximum blood pressure value and the minimum blood pressure value are ended. A time period required in doing so, will be about 30 seconds.

After that determination, a signal indicating the end of the measurement is generated, whereby the supply of the power to the electromagnetic valve 87 is stopped and the cuff band member 83 is released. As a result of this, the air having remained within the cuff band member 83 is speedily discharged, whereby the pressure value is made to be 0 mm Hg.

Along with this, the maximum blood pressure value, the minimum blood pressure value, and the pulsation times, which are the measurement results, are displayed on the panel of the display portion 81.

And, as the small-sized pump device used in the above-described blood pressure meter, there is the one that is shown in, for example, Japanese Patent No. 2551757. Illustration is made of this pump device in FIG. 41. A reference numeral 101 denotes a small-sized DC motor. A reference numeral 103 denotes an output shaft of a small-sized DC motor 101; a reference numeral 105 denotes a case that has been mounted on an output shaft surface of the small-sized DC motor 101. A reference numeral 107 denotes a collar that has been mounted on the output shaft 103. On the collar 107 is mounted a drive shaft 109 that is inclined at a prescribed angle with respect to the output shaft 103 and a forward end of that exists on a center axis of the output shaft 103. A reference numeral 111 denotes a drive member that is formed into the shape of a circular plate. Also, a reference numeral 113 denotes a diaphragm member and a reference numeral 115 denotes a diaphragm portion that is shaped like a hanging bell extended downward from the diaphragm member 113 and formed integrally therewith. And a reference numeral 117 denotes a drive portion located at the center of the diaphragm portion. A reference numeral 119 denotes a valve element portion that is shaped like a circular-cylindrical configuration extended upward from the central portion of the diaphragm member 113 and formed integrally therewith. The drive portion 117 is forcedly inserted into a hole of the drive member 111 and is retained thereby. A reference numeral 121 denotes a lid member. The lid member 121 is fixed to the case 105 with the diaphragm member 113 being clamped between the lid member 121 and the case 105. Pump chambers 123*a*, 123*b* are formed by the space formed between the lid member 121 and the diaphragm portion 115. A reference numeral 125 denotes a valve chamber portion formed in a central portion of the lid member 121 in such a way as to be directed upward, and 127 denotes an exhaust port. The valve element portion 119 is in contact with the inner-peripheral surface of the valve chamber portion 125 and is arranged to close the passage. A reference numeral 129 denotes a spherical valve element member, which has formed therearound a plurality of suction openings 131.

In the small-sized pump device that has been constructed as mentioned above, upon rotation of the output shaft 103 due to the supply of an electricity to the small-sized DC motor 101, the drive shaft 109 rotates together with the collar 107. As a result of this, the drive member 111 makes a countersunk turn motion, whereby the drive portion 117 of the diaphragm member 113 is vibrated in the vertical direction. The volume of the pump chamber 123 is thereby periodically changed. When the volume increases due to the downward movement of the drive portion 117, the pump chamber 123 is pressure-reduced, whereby the valve element portion 119 closes the valve chamber portion 125 by being brought into close contact with the valve chamber portion 125. Conversely, the valve element 129 is opened, whereby air is made to flow from the suction opening 131 into the pump chamber 123*a* or 123*b*. Next, when the volume decreases due to the upward movement of the drive portion 117, the pump chamber 123*a* or 123*b* is pressure-increased, whereby the valve element 129 is closed due to its close contact with the lid member 121. The valve element portion 119 is conversely brought to a state of being flexed inward, with the result that the valve element portion 119 is opened. The air within the pump chamber 123*a* or 123*b* is discharged from an exhaust port 127.

However, in the blood pressure meter using the small-sized pump device performing the above-described pumping operation, as a mechanism for converting the rotational movement of the motor to a linear movement, in the first conventional example, there are used the inclined shaft and the drive member for making a countersunk turn movement. For this reason, in the compression/expansion strokes of the air chamber, the air chamber is distorted, raising the problem that in the suction/expansion strokes of the air chamber the efficiency is poor.

This drawback will now be explained with reference to FIG. 42. It is to be noted that in FIG. 42 illustration is made of a case where the air chamber is one in number.

FIG. 42(*a*) illustrates the suction stroke, in which the inclined shaft is inclined. Therefore, the coupled portion between the air chamber and the drive member is pulled in the rightward/downward direction. And it is seen that the air chamber is also expanded in a state of being expanded.

Also, at an intermediate position of the suction/exhaust strokes of FIG. 42(*b*), the inclined shaft is vertical with respect to the air chamber. At this stage, the force can be made to act upon the air chamber from right below the same.

However, in the exhaust stroke of FIG. 42(*c*), the inclined shaft is again inclined. Therefore, the joined portion is pushed up in the rightward/upward direction. It is therefore seen that the air chamber is also compressed in a state of being distorted.

Also, in the blood pressure meter using the small-sized pump device that has been shown as the first conventional example, at the time of starting, the load that is applied to the output shaft of the motor is great. This raised the problem that the current value at the time of starting became great.

Also, as one of the characteristics the pump device of the blood pressure meter is demanded to have, there is a re-pressurization characteristic.

The re-pressurization characteristic is the one that is obtained by evaluating whether when having again applied a minimum voltage value in the range of use voltage from a state where pressurization has been made to 200 (20 mm Hg the pump device can be started and thereafter pressurization can be made up to 300 mm Hg.

Illustration about the load applied to the motor is shown in FIG. 45. It is to be noted that in FIG. 45 illustration of a force applied to one air chamber is made.

To the output shaft of the motor are mounted the collar, the drive shaft, and the drive member. To this drive member is coupled the diaphragm portion that is shaped like a hanging bell.

At this time, it is assumed that F represents the force that is generated when compressing and expanding the diaphragm. Under this assumption, it is assumed that the F acts upon the drive member; and R1 represents the distance from the output shaft to the point of action. Then, a moment of F×R1 acts on the output shaft of the motor as a force making the output shaft of the motor eccentric. As a result, the load upon the motor becomes high and in consequence the current value at the time of starting becomes great.

In a case where re-pressurization is made, since the pump device is in a state of pressure as high as 200 (20 mm Hg, it is clear that the value of the F becomes greater than that when no load is applied. Accordingly, the load upon the motor also becomes higher.

A second example of the conventional small-sized pump device is illustrated in FIG. 43. This small-sized pump device 65 is constructed generally of a drive source 66, a drive transmission portion 67, a pump portion 68, and a suction/exhaust portion 69. For the drive source 66 there is generally used a small-sized DC motor 70.

The drive transmission portion 67 performs its pumping operation that is done by compressing and expanding an air chamber 72 of the pump portion 68, by converting the rotational movement of an output shaft 71 of a DC motor 70 constituting the drive source 66 into, for example, vertical reciprocating movements.

Following this pumping operation, the air within an air chamber 72 is extruded into an exhaust opening 73 and an exhaust port 74 and is then supplied to the cuff band member of the blood pressure meter. In the conventional example illustrated in FIG. 43, in order to convert the rotational movement of the DC motor 70 into reciprocating movements, the following construction is adopted.

A circular-cylindrical surface cam 75 is mounted on the output shaft 71 of the DC motor 70. On an outer-peripheral surface of this circular-cylindrical surface cam 75 is formed a concaved groove that is smooth and that is inclined with respect to the direction of the output shaft 71 with one full round being made per one full circumference (one cycle of the vertical movement is complete with one full circumference being ended with one full round thereover). The drive member 76 that has been swingably retained at one end by the case is supported at the other end by the concaved groove of the circular-cylindrical surface cam 75. It is thereby arranged that the drive member 76 make its vertical reciprocating movements along the concaved groove due to the rotation of the circular-cylindrical surface cam 75.

Due to the vertical reciprocating movements of the drive member 76, the air chamber 72 is compressed and expanded.

In the figure, air is sucked in through a suction opening 77 through the expansion of the air chamber 72. Also, through the compression of the air chamber 72, the air inside is discharged from within the air chamber 72 through an exhaust opening 73. Further, the air inside is supplied to the cuff band member through the exhaust port 74.

And in this arrangement in the suction stroke from the suction opening 77 into the air chamber 72 as well as in the exhaust stroke from the air chamber 72 into the exhaust opening 73, a suction valve 78 and an exhaust valve 79 are used as check valves for preventing back flow of the air. Each of these valves is made of elastic material such as soft rubber and, as illustrated in FIG. 44, its valve portion is disposed in such a way as to cover the suction opening 77*a* and the exhaust opening 73 both provided in a housing. At an ordinary time, there prevails a state where landing portions of the outer-peripheral edges of the suction valve 78 and the exhaust valve 79 are in contact with a seal surface of the housing.

In the suction stroke, the air chamber 72 is pulled by the circular-cylindrical surface cam 75 and the drive member 76 in the downward direction and thereby sucks the air in. At this time, the air lifts up the landing portion of the outer-peripheral edge of the suction valve 78 via the suction opening 77*a* and is supplied to the interior of the air chamber 72 via the suction opening 77*b* as illustrated in FIG. 44. At this time, regarding the exhaust valve 79, the internal pressure of the cuff band member of the blood pressure meter act thereupon. Therefore, the landing portion of the outer-peripheral edge of the exhaust valve 79 is closely contacted with the seal surface of the housing with no clearance existing in between. The back flow of the air is thereby prevented.

Also, in the exhaust stroke, the air chamber 72 is pushed up by the circular-cylindrical surface cam 75 and the drive member 76 in the upward direction and thereby the air within the air chamber 72 is compressed. And, the thus-compressed air lifts up the landing portion of the outer-peripheral edge of the exhaust valve 79 via the exhaust opening 73 and is discharged to outside the air chamber. The air is thereby supplied to the interior of the cuff band member of the blood pressure meter. In this exhaust stroke, regarding the suction valve 78, the internal pressure of the air chamber 72 acts thereupon. Therefore, the landing portion of the outer-peripheral edge of the suction valve 78 is closely contacted with the seal surface of the housing with no clearance existing in between. The back flow of the air is thereby prevented.

Further, in the blood pressure meter using the small-sized pump device performing the above-described pumping operation, the compressing/expansion movement of the diaphragm is performed along the circular-arc orbit the center of whose circle is located at the retaining portion of the drive member. Therefore, at the time of compression, the air chamber cannot completely be compressed. This raised the problem that the maximum pressurizing force, which is one of the important characteristics of the for-use-in-blood-pressure-meter pump device, was small.

Also, in the small-sized pump device that has been above described as a conventional example, by the landing portions of the outer-peripheral edges of the suction valve 78 and the exhaust valve 79 being uplifted by pneumatic pressure, suction and exhaust of air are performed. However, the landability of the outer-peripheral edge of each valve with respect to the seal surface is bad. This raised the problem that when the pressure was low the leak (the back flow) of the air occurred.

Also, in the blood pressure meter using the small-sized pump device performed the above-described pumping operation, the drive member is positioned by being inserted into a drive member mounting groove and set therein. Therefore, following the vertical movement of the drive member, sounds generate between the fixed end thereof and the drive member mounting groove. This raised the problem that these sounds became noises.

Also, since the free end of the drive member is substantially circular-columnar, it is necessary to make the width of the concaved groove of the circular-cylindrical surface cam greater than the diameter of the free end. As a result of this, a clearance is necessarily produced between the two. The sounds that generate between the free end and the concaved groove of the circular-cylindrical surface cam during the rotation are therefore considered as being problematic.

And, in a case where having formed the circular-cylindrical surface cam by integral formation, the groove becomes substantially shaped like a trapezoidal wave. Therefore, in the vicinity of an apex of the groove, the free end is rapidly changed in terms of its direction. Therefore, the sounds that generate between the free end and the groove were also problematic.

Further, since the suction opening is provided in correspondence with the position of the suction valve, it was problematic that the sounds of opening or closing of the suction valve leaked directly into outside the pump device to become noises. For this reason, there was the problem that the noises, which are one of the important characteristics of the for-use-in-blood-pressure-meter pump device, were high in magnitude.

SUMMARY OF THE INVENTION

Under these circumstances, the present invention has an object to provide a small-sized pump device which, especially in the blood pressure meter, in order to enable compression and expansion carried out in the compression and expansion stroke in the air chamber by converting the rotational movement of the motor to a linear movement, to be made without causing rightward or leftward distortion of the air chamber, can perform a highly efficient pumping operation.

Also, it is another object of the present invention to provide a small-sized pump device which can reduce the load applied onto the motor to thereby decrease the current value at the time of starting and can also easily procure the repeated pressurization characteristic, and a blood pressure meter using the same.

Further, it is still another object of the present invention to provide a small-sized pump device that has decreased the noises generated, and a blood pressure meter using the same.

It is a further object of the present invention to provide a small-sized pump device wherein the compression ratio has been increased; and the maximum pressurizing characteristic has been enhanced, and a blood pressure meter using the same.

The present invention has an object to solve the above-described problems, and provides a small-sized pump device, the efficiency of that has been increased by preventing air from being leaked (making a back flow) at the time of low pressure when the pump operation is started.

To attain the above object, the small-sized pump of the present invention is the one that includes a drive source, a drive transmission portion that is engaged with the drive source, a pump portion that includes an air chamber engaged with the drive transmission portion, and a suction/exhaust portion that includes a suction valve and an exhaust valve, each of that is communicated with the air chamber of the pump portion, wherein the drive transmission portion has a cylindrical member, rotatably-supported on a drive output shaft of the drive source, a cam portion formed on a surface of the rotary cylindrical member so as to show a spiral configuration while having a prescribed angle with respect to a rotation axis of the rotary cylindrical member, and a drive member a part of that is engaged with the cam portion; and the air chamber is constructed so that an internal volume thereof may be compressed and expanded according to the displacement movement of said drive member, that is contacted to the air chamber and responding to the rotation movement of the cam portion.

To attain the above-described object, the present invention provides a small-sized pump device that includes a drive source, a drive transmission portion, a pump portion, and a suction/exhaust portion, and in that the drive transmission portion has a circular-cylindrical surface cam rotatably-supported by the motor and a drive member moved up and down by the circular-cylindrical surface cam, whereby the air chamber is pressed by the drive member. By constructing the drive transmission portion by the cam mechanism in the above-described way, it becomes possible to transmit the energy from the drive source with a high efficiency compared to the conventional arrangement.

To attain the above-described object, the present invention provides a small-sized pump device that includes a drive source, a circular-cylindrical surface cam rotatably supported by the output shaft, a drive transmission portion having a drive member moved up and down by the circular-cylindrical surface cam and constructed so as to press the air chamber by the drive member, a pump portion, and a suction/exhaust portion. The suction/exhaust portion is constructed by an exhaust valve holder, and, at the coupled portion formed between the suction/exhaust portion and the air chamber, a pressure-adjusting portion for making a pressure adjustment is provided. Especially, the configuration of the pressure-adjusting portion is made to be the one that depends on the enhancement of the pressurization characteristic. This enables the provision of a small-sized pump device having excellent pressurization characteristics.

Specifically, the pressure-adjusting portion is characterized by having a convexed portion formed at the coupling portion formed between itself and the air chamber, the bottom surface of the convexed portion having an inclined structure. Further, it is also a characterizing feature that the bottom surface of the convexed portion is substantially parallel with a line connecting the fixed end of the drive member and the apex portion of the concaved groove. Or, it is also a characterizing feature that the sectional configuration of the convexed portion of the exhaust valve holder is substantially the same as that of the air chamber. As a result of this, it becomes possible to provide a pump device having excellent pressurization characteristics.

To attain the above-described object, the present invention provides a small-sized pump device that includes a drive source, a drive transmission portion, a pump portion, and a suction/exhaust portion, in which it is a characterizing feature that the suction/exhaust portion includes a suction-valve/exhaust-valve integrated sheet wherein a sheet-like suction valve holder and a sheet-like exhaust valve holder are integrated together, and a suction valve holder and an exhaust valve holder each of that holds this sheet respectively; and in the periphery area of the suction opening and exhaust opening formed in these holders suction/exhaust pressure-adjusting portion is provided.

The suction/exhaust pressure-adjusting portion is characterized by being provided with an inclined and convexed step-like portion on the neighboring portion to the portion on which either one of the suction opening and exhaust opening of the suction valve holder and exhaust valve holder, or the both are formed.

By equipping such inclined and convexed step like portion, even at the time of low pressure, a higher tension is applied to the contacting portion of the outer-peripheral edge of each of the suction and exhaust valves. Therefore, the contacting characteristic of the outer-peripheral edge of the valve with respect to the seal surface is improved. This can prevent the leak (back flow) of the air during a low-pressure time when the pumping operation is started.

To attain the above-described object, the present invention provides a small-sized pump device that includes a drive source, a circular-cylindrical surface cam that is rotatably-supported by the output shaft, a drive transmission portion wherein the air chamber is pressed by a drive member moved up and down by the circular-cylindrical surface cam, a pump portion, and a suction/exhaust portion, and in that the drive member is formed integrally with a frame member portion through a fixed end portion thereof. As a result of this, it has become possible to provide a small-sized pump device having excellent anti noise characteristics.

Also, there is the characterizing feature as well that the free end of the drive member is substantially spherical.

Further, there is also the characterizing feature that the concaved groove of the circular-cylindrical surface cam is formed as a sine wave.

And it is possible to provide a small-sized pump device which has had its noise characteristic improved also by equipping the pump device with a case lid member constituting the suction/exhaust portion.

BRIEF DESCRIPTION OF THE DRAWINGS

FIGS. 4(*a*) and 4(*b*) are sectional views illustrating drive members used in the small-sized pump device of the present invention;

FIGS. 8(*a*) and 8(*b*) are explanatory views illustrating convexed portions of the second embodiment;

FIG. 9 is a perspective view illustrating a rotary member of the second embodiment;

FIGS. 22(*a*) to 22(*c*) are explanatory views illustrating the operation of the small-sized pump device of the tenth embodiment;

FIGS. 25(*a*) and 25(*b*) are perspective views illustrating the obverse and reverse surfaces of an exhaust valve holder of the tenth embodiment;

FIGS. 33(*a*) and 33(*b*) are explanatory views each illustrating the positional relationship between the concaved groove and the forward end portion of the small-sized pump device of the eleventh embodiment;

FIGS. 34(*a*) and 34(*b*) are explanatory views each illustrating the deformation of a fixed portion of the small-sized pump device of the eleventh embodiment;

FIG. 37 is an explanatory view illustrating the comparison in pressurizing time period, current consumption, noise, battery life, etc. between the small-sized pump device of the present invention and the conventional small-sized pump device;

FIGS. 42(*a*) to 42(*c*) are views illustrating the operation of the conventional small-sized pump device;

DETAILED DESCRIPTION OF THE PREFERRED EMBODIMENTS

Figure 1:
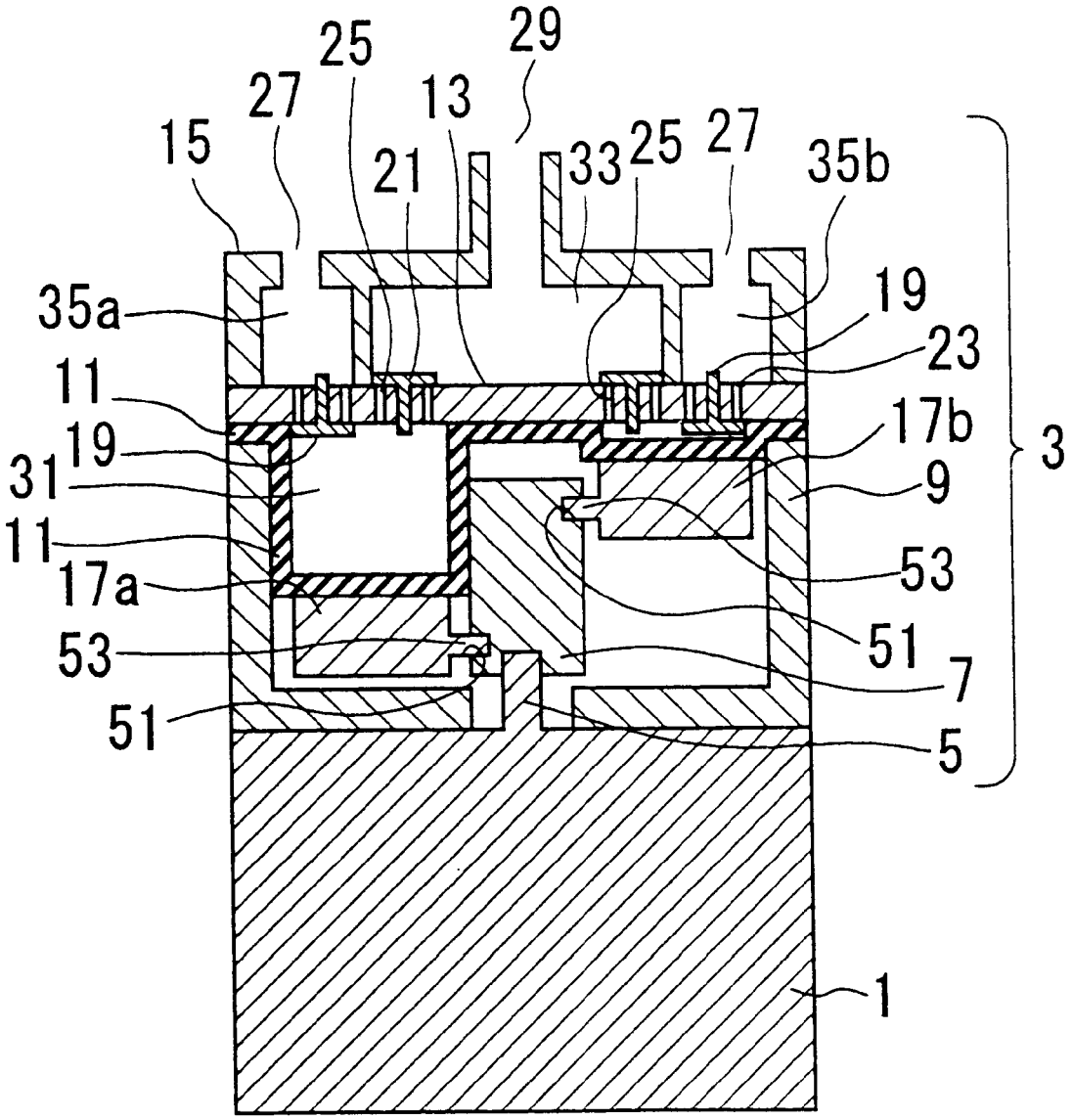
FIGS. 1 are sectional views illustrating a first embodiment of a small-sized pump device according to the present invention.
Figure 39:
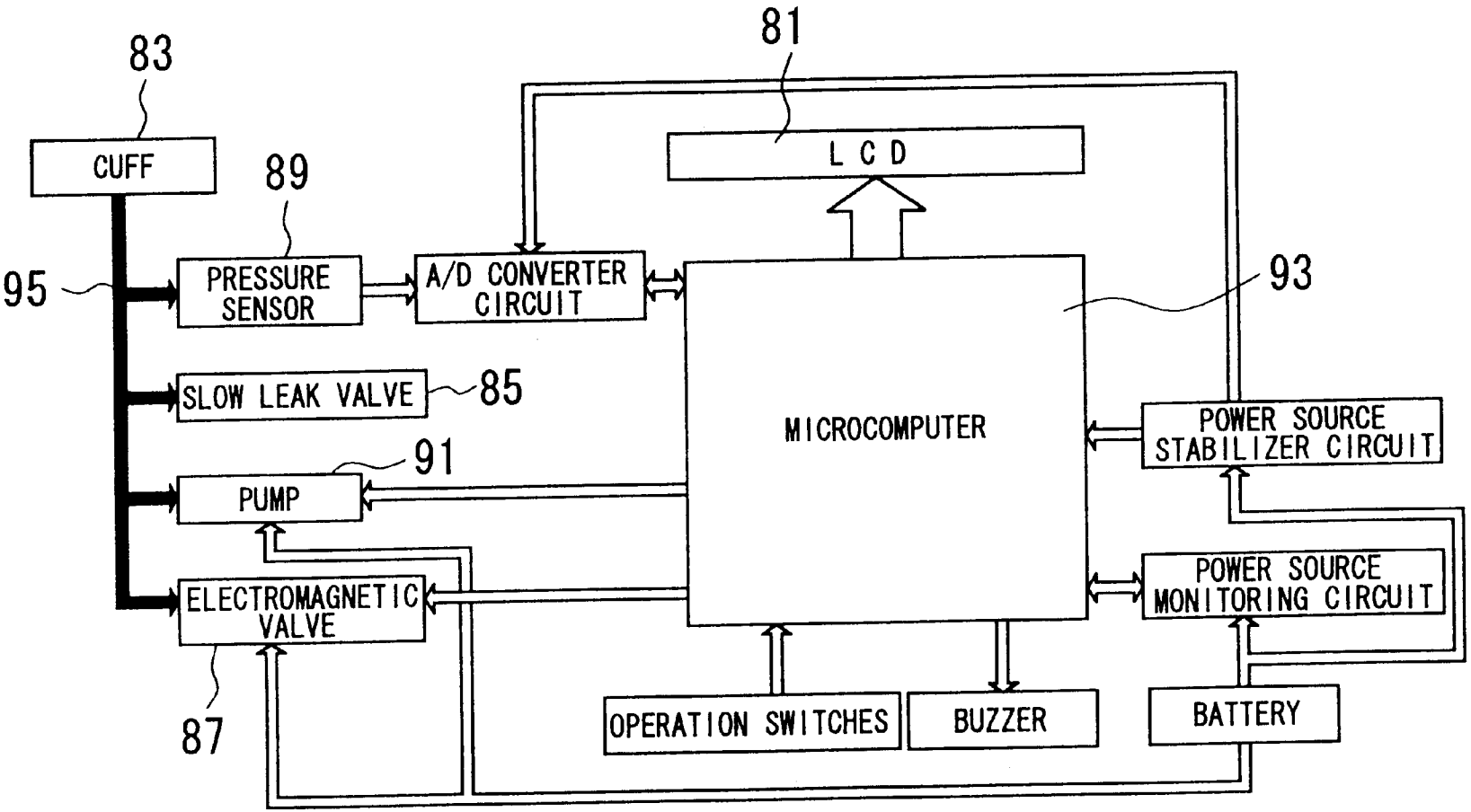
Fig. 39 Prior Art
FIG. 39 is an electric block diagram illustrating the construction of the blood pressure meter.
Figure 40:
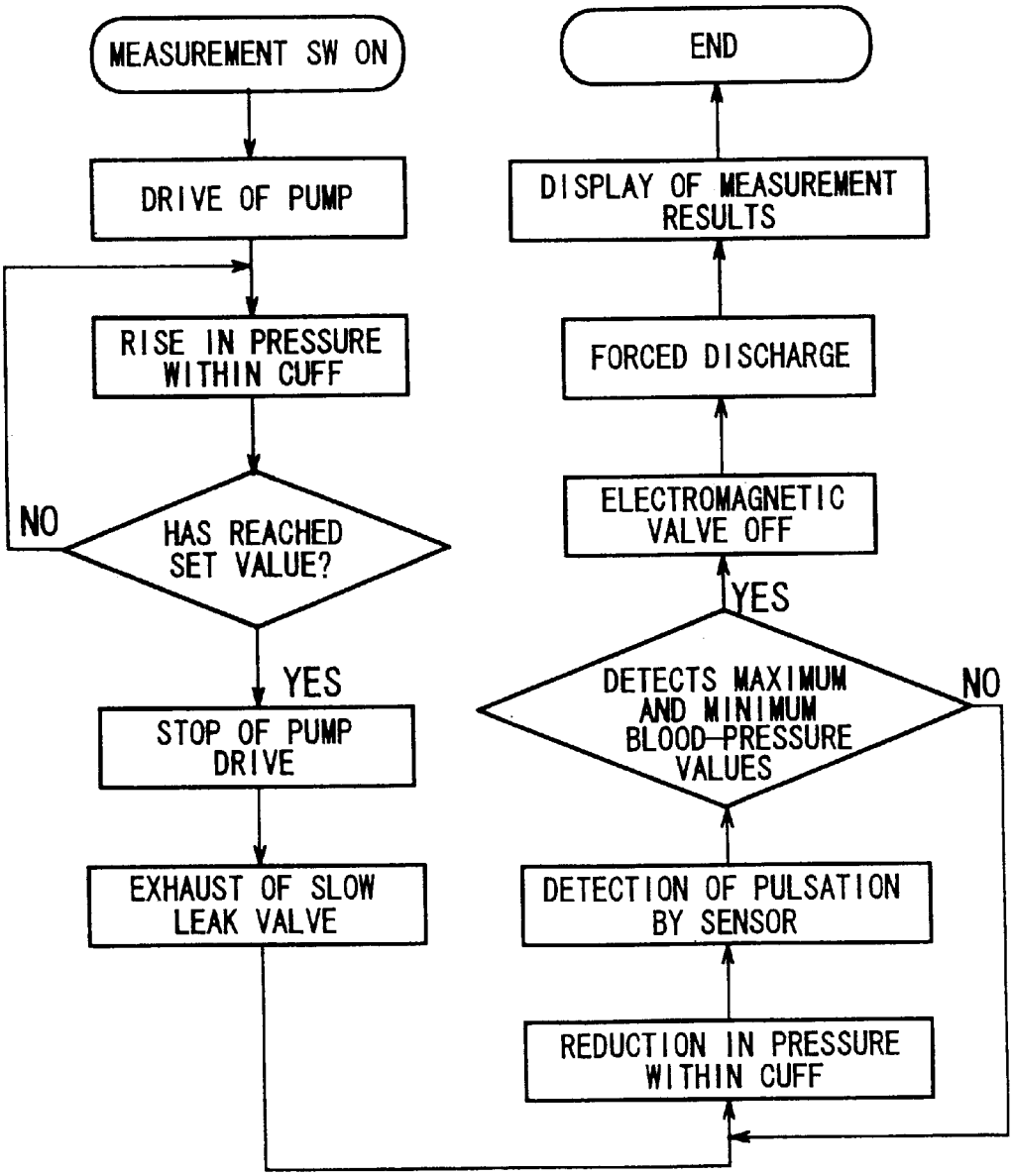
Fig. 40 Prior Art
FIG. 40 is a flow chart illustrating a pneumatic system of the blood pressure meter.
Figure 41:
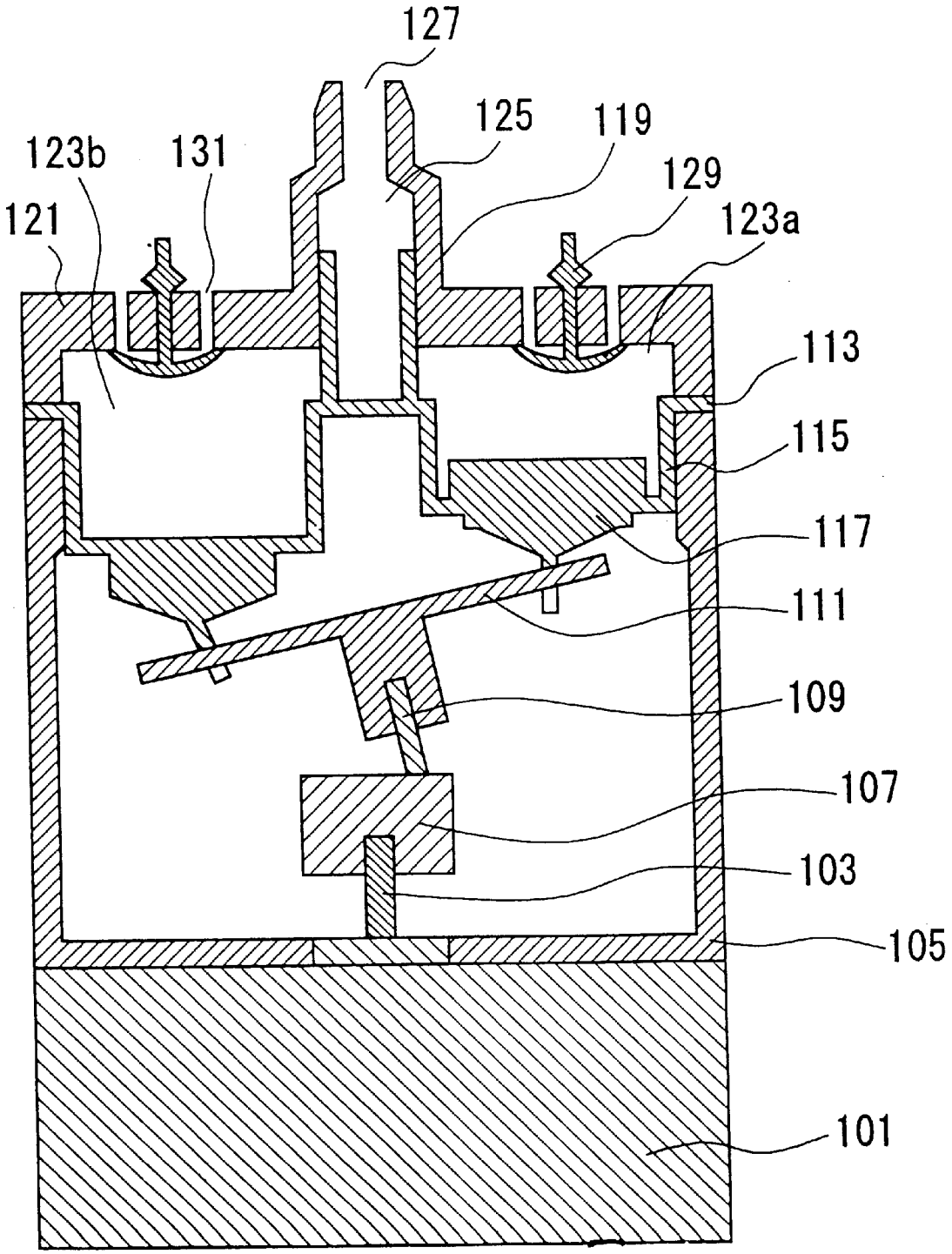
Fig. 41 Prior Art
FIG. 41 is a sectional view illustrating an example of the conventional small-sized pump device.
Figure 43:
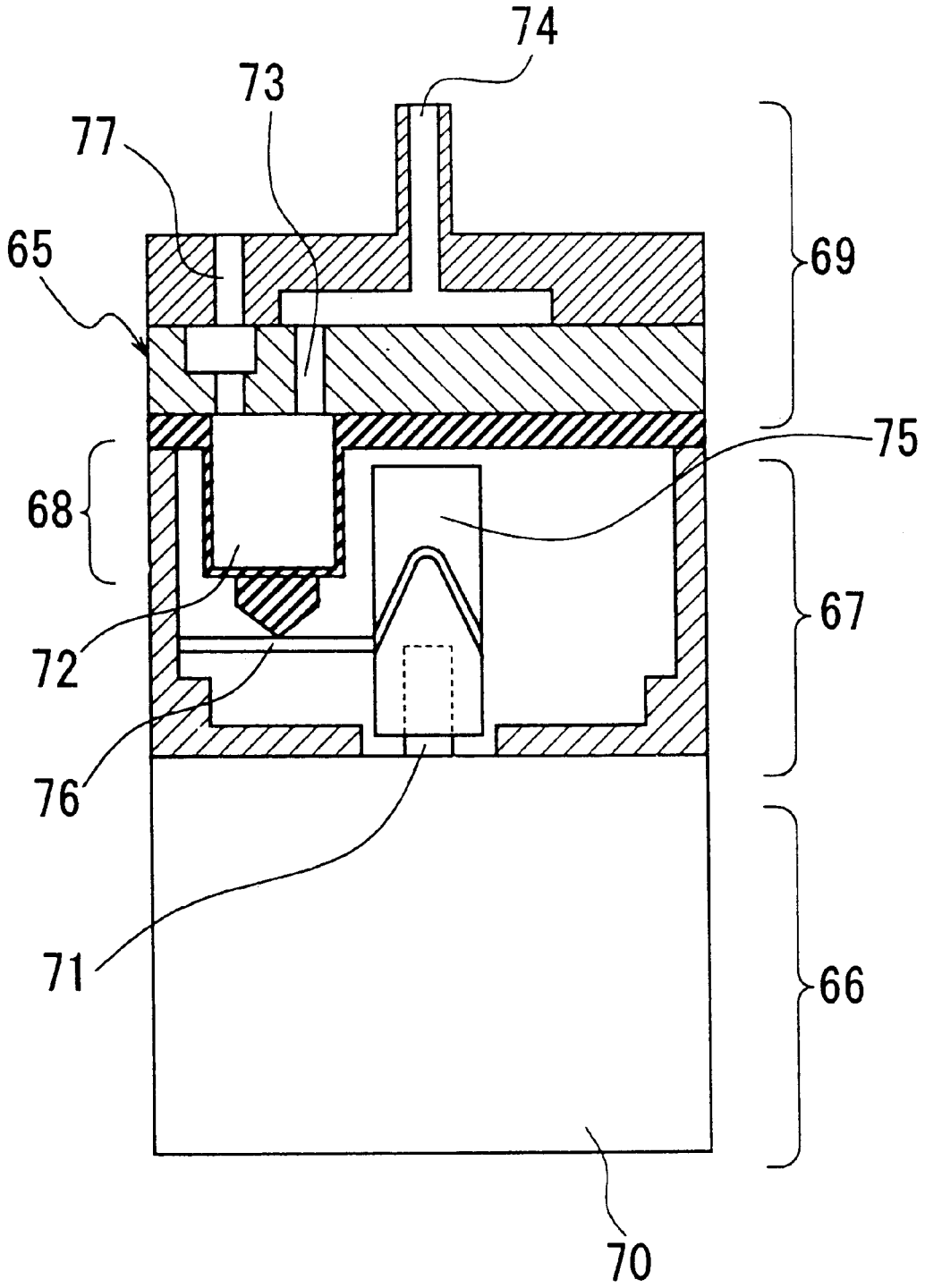
Fig. 43 Prior Art
FIG. 43 is a sectional view illustrating a second example of the conventional small-sized pump device.
Figure 44:
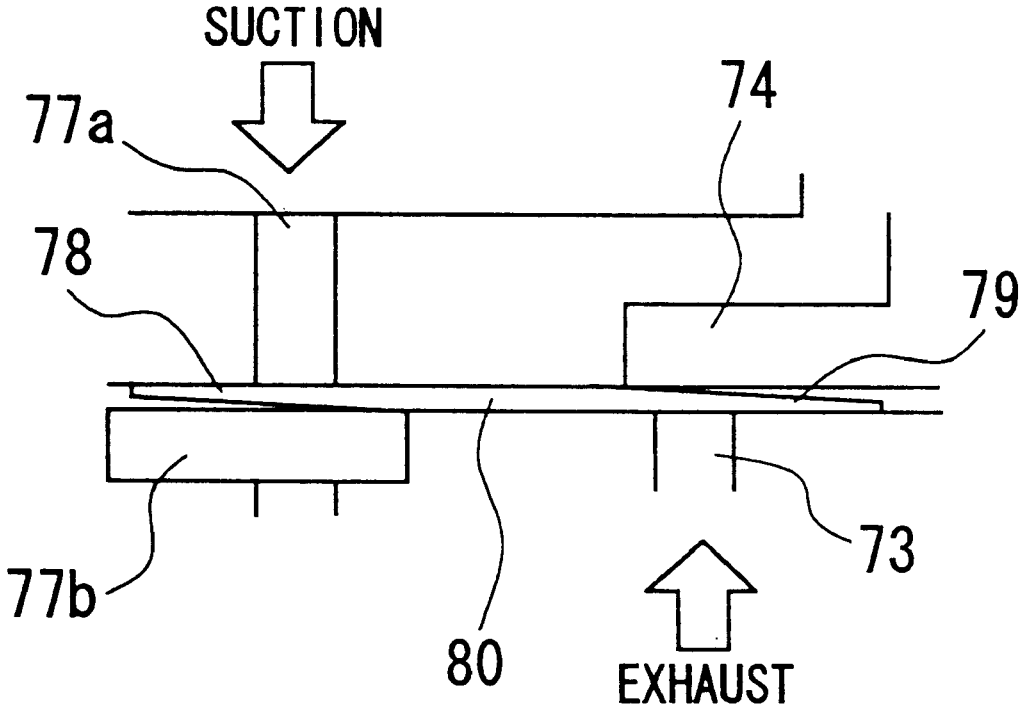
Fig. 44 Prior Art
FIG. 44 is an explanatory view illustrating suction/exhaust opening neighbor portions of the second example small-sized pump device.
Figure 45:
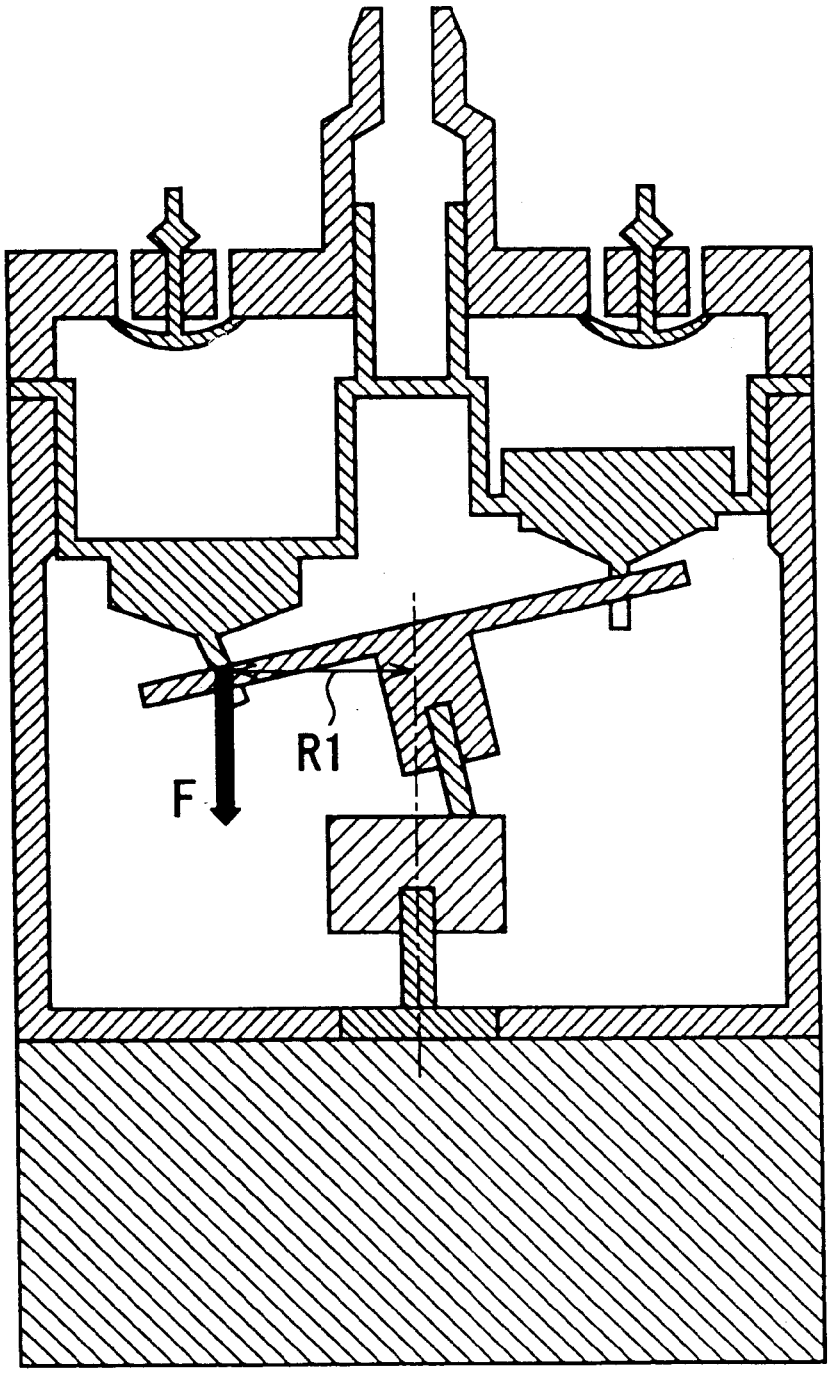
Fig. 45 Prior Art
FIG. 45 is a sectional view illustrating a force that is applied to a motor of the conventional pump device.

The entire construction of the blood pressure meter according to the present invention is almost the same as that of the conventional example illustrated in FIG. 39 with a unique small-sized pump device 91. On this account, a first embodiment of a small-sized pump device 91 used in the blood pressure meter according to the present invention will now be explained using a sectional view that is shown in FIG. 1.

The structure of the small-sized pump device used in the blood pressure meter is divided into a motor portion 1 and a pump portion 3.

From the motor portion 1 serving as a drive source is extended an output shaft 5. Onto the output shaft 5 is fixed by forced insertion, adhesion, etc. a rotary member 7 having a concaved groove 51 on its outer-peripheral surface as illustrated in FIG. 3.

A case main body 9 having a circular-cylindrical hollow portion is mounted on a portion of the motor portion 1 facing a direction along which the output shaft is extended and which is fixed thereto by screwing, etc. Screw holes (not illustrated) are formed on a surface of the case main body 9 opposite to the surface thereof on which the motor portion 1 is mounted. A diaphragm 11 formed of flexible elastic material such as rubber, an air passage lid 13, and a case lid 15 have respectively formed therein the same screw holes. And so these members can be fixed to the case main body 9 by screwing.

Figure 3:
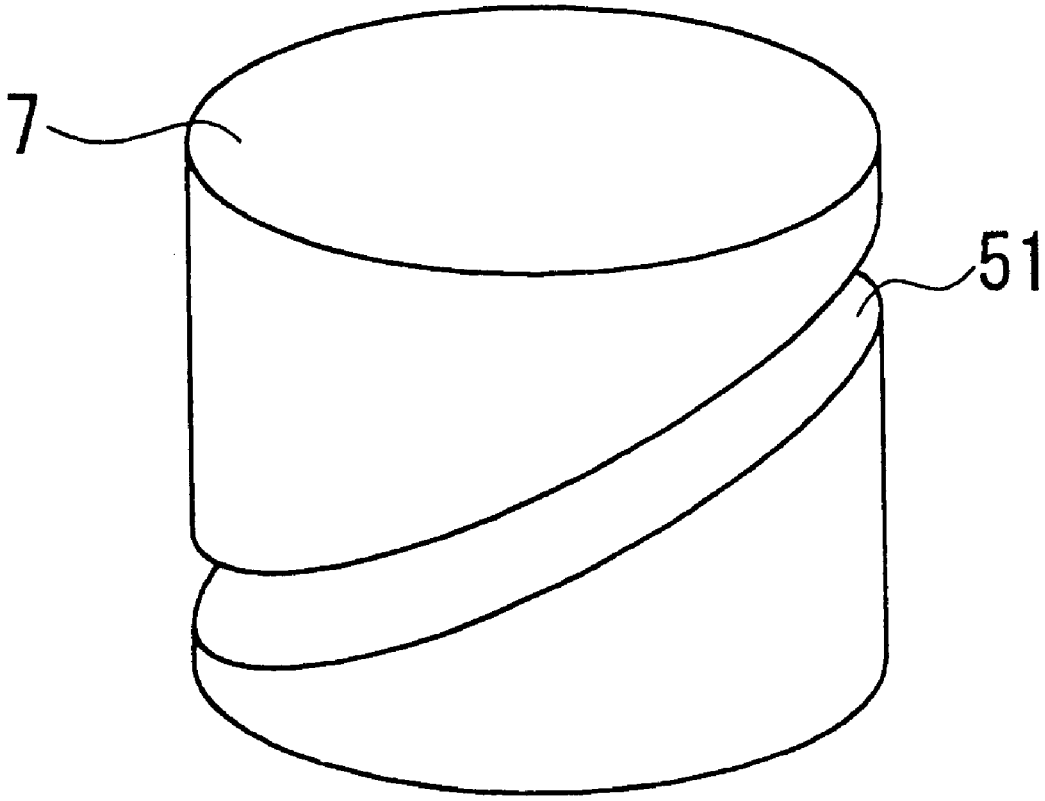
FIG. 3 is a perspective view illustrating a rotary member of the present invention.
Figure 5:
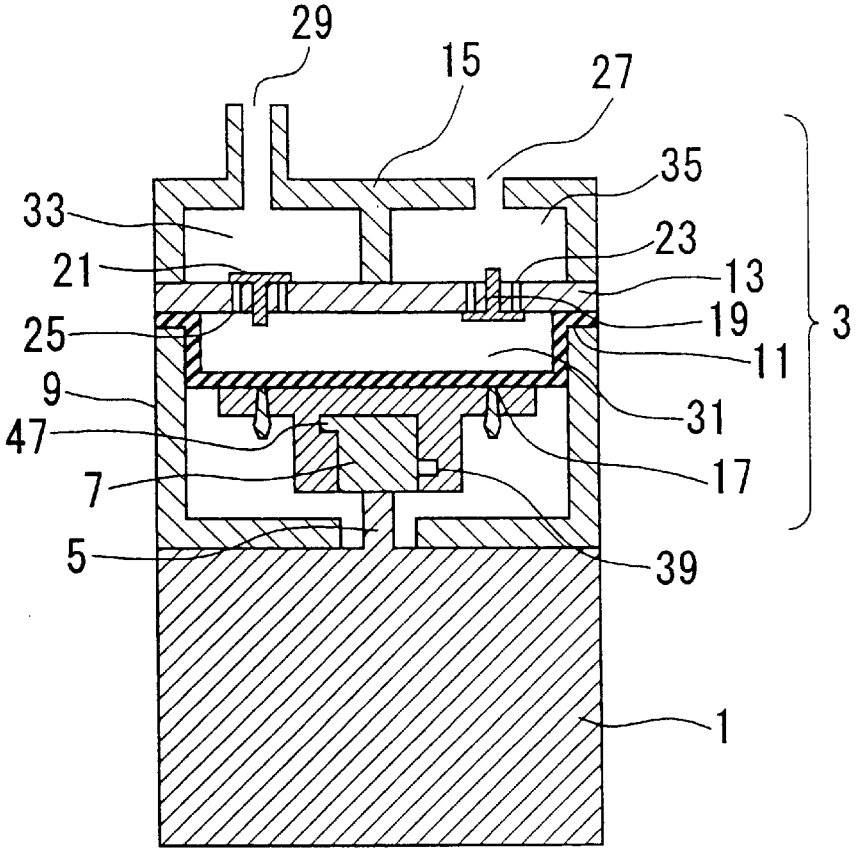
FIG. 5 is a vertical sectional view illustrating a second embodiment of the small-sized pump device according to the present invention.

In the outer-peripheral surface of the rotary member 7, as illustrated in the perspective view of FIG. 3, there is formed a smooth concaved groove 51 that is inclined with respect to a plane vertical to the extension direction of the output shaft of the motor. The concaved groove 51 serves as a cam portion. A convexed portion 53 of a drive member 17 is combined with a part of the concaved groove 51 inclined with respect to the axial line of the rotary member 7.

In this embodiment, regarding the drive member, drive members 17*a* and 17*b* are disposed at the left and right sides of the rotary member 7, respectively. Each of these drive members is loosely fitted into the concaved groove 51 through the convexed portion 53.

An upper surface of the drive member 17 and an underside surface of the diaphragm 11 are fixed to each other by adhesion, or by inserting a spherical portion having a diameter slightly larger than the diameter of a hole formed in a part of the drive member 17, etc. The radial movement with respect to the output shaft of the drive member 17 is regulated by the case main body 9 and the movement in the rotational direction about the output shaft 5 is also regulated. Therefore, the drive member 17 is only movable in the longitudinal direction of the output shaft 5.

The air passage lid 13 is provided with a suction opening 23 and an exhaust opening 25. For the purpose of preventing the back flow of the air, these openings 23 and 25 are respectively provided with a suction valve 19 and an exhaust valve 21.

And, the case lid 15 is provided with a suction passage 27 and an exhaust passage 29. A suction chamber 35*a*, 35*b* and an exhaust chamber 33 are formed in a space formed between the case lid 15 and the air passage lid 13.

Next, using FIG. 2, the operation of the small-sized pump device according to this embodiment will be explained.

When causing an electric current to flow into the motor and thereby energizing it, the rotary member 7 fixed to the output shaft 5 makes a rotation and, along therewith, the concaved-groove 51 also makes a rotational movement.

Figure 2:
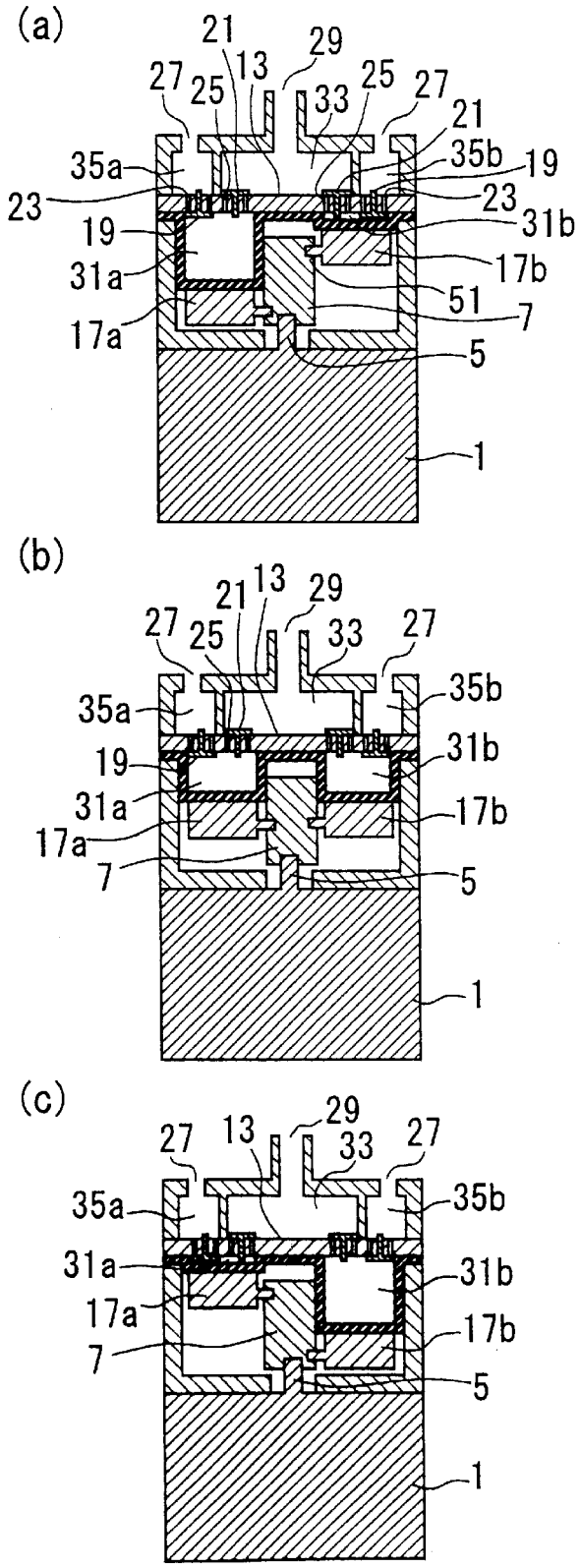
FIG. 2(*a–c*) is an explanatory view illustrating the operation of the small-sized pump device of the present invention.

The concaved groove 51 of the rotary member 7 and the convexed portion 53 of the drive member 17 are engaged with each other, and, in FIG. 2(*a*), the concaved groove 51 is located obliquely from the right/up to the left/down of the rotary member 7. Accordingly, among the air chambers formed by the diaphragm 11 fixed to the upper surface of the drive member, an air chamber 31*b* located on the right hand side in the figure is compressed, while an air chamber 31*a* on the left hand side in FIGURE is expanded. The air chamber 31*a* thereby has a maximum volume.

When the air chamber 31*b* is compressed, since the pressure within it 31*b* is high, the air within the air chamber 31*b* passes through the exhaust opening 25 and pushes and opens the exhaust valve 21. Then, this air passes through the exhaust passage 29 and is thereby sent into a cuff band member. On the other hand, the air chamber 31*a* is being expanded and is brought to a pressure-reduced state, whereby the air within the suction chamber 35*a* flows into the air chamber 31*a* via the air passage 27 and via the suction valve 19.

And when the concaved groove 51 is moved by being rotated due to the rotation of the motor portion 1 and thereby reaches the position indicated in FIG. 2(*b*), the left and right drive members 17*a*, 17*b* are located intermediately between the upper and lower end of the concaved groove 51. At this state of operation, the air chamber 31*a* is in the course of exhaust and the air chamber 31*b* is in the course of suction. At this time, the suction valve 19 provided between the suction chamber 35*a* and the air chamber 31*a* is kept closed while the exhaust valve 21 is kept open. Accordingly, the air within the air chamber 31*a* passes through the exhaust valve 21 is guided into the exhaust chamber 33 and into the exhaust passage 29. Also, the air chamber 31*b* is in the course of suction, whereby the suction valve 19 is kept open and the exhaust valve 21 is kept closed.

Further, when the rotary member 7 is moved to the position as shown in FIG. 2(*c*), the way of operation becomes reversed from that in the case of FIG. 2(*a*). Namely, the volume of the air chamber 31*a* becomes minimum and that of the air chamber 31*b* becomes maximum. Namely, regarding the air chamber 31*a*, the exhaust stroke is terminated and, regarding the air chamber 31*b*, the suction stroke is terminated.

In this way, the convexed portion 53 of the drive member 17 moves in such a way as to trace the concaved groove 51 of the rotary member 7 due to the rotation of the motor, the rotational movement of the motor is highly efficiently converted to a linear movement causing the air chamber to be compressed and expanded.

In this way, the respective air chambers 31*a* and 31*b* are repeatedly expanded and compressed due to the rotation of the motor. In addition, a plurality of the air chambers can be disposed with respect to one rotary member 7 in its peripheral direction. And in addition the timings with which the respective air chambers are compressed or expanded can have a time difference from each other, with the result that the pulsation at which exhaust or suction is made is less.

It is to be noted that, as illustrated as a sectional view in FIG. 4(*a*), the convexed portion 53 may be the one that is formed integrally with the drive member 17 by using the same material. Or, as illustrated in FIG. 4(*b*), it may be also arranged so that a blind hole 17*c* be formed in the drive member beforehand and the convexed portion 53 be thereby formed by inserting into this blind hole a pin 53-1 made of material different from that of the rotary member.

By using the pin 53-1 made of being different from the rotary member, a material, for example, it is possible to partially use a low-frictional material and thereby decrease the slide-frictional force between the concaved groove 51 of the rotary member 7 and the pin. Also, by loosely fitting the pin into the concaved groove of the rotary member, the pin can have a degree of freedom with respect to the rotation and therefore the sliding friction can be also changed into a rolling friction. This enables a further decrease in the frictional force as well. As a result of this, the most optimized designing for making the frictional force between the convexed portion 53 and the concaved groove 51 small, becomes possible.

In this embodiment, as the suction valve 19 and the exhaust valve 21 there is used a mushroom type valve. However, the suction valve and the exhaust valve may each be made to be a tongue valve and may each be integrated in the form of a sheet.

As a result of this, the effect of decreasing the number of parts is obtained and, because the device is easy to assemble, such arrangement contributes also to reduction in the cost.

Also, the cam portion that has been formed on the outer-peripheral surface of the rotary member 7 that is the rotary circular-cylindrical member is constructed so as to displace the drive member 17 in response to the rotation of the rotary circular-cylindrical member at prescribed pitches.

Further, the rotary circular-cylindrical member of the drive transmission portion has a circular-peripheral cam portion. This circular-peripheral surface cam comprised the concaved groove 51, which is associated with the drive member 17 having the convexed portion 53, a part of which is engaged with the concaved groove 51.

Also, the convexed portion of the drive member 17 may be constituted by the circular-columnar pin 53-1, which may be loosely inserted into the hole 17*c* formed in the drive member 17.

Also, the circular-peripheral surface cam portion comprises a plurality of continuous concaved grooves 51 or a plurality of continuous convexed-like portions 47.

Also, the circular-peripheral surface cam portion has a given angle of inclination as defined with respect to the output shaft 5 of the rotary circular-cylindrical member.

Also, the pitch, the period, and the phase of the circular-peripheral surface cam portion are each arbitrary. Further, the air chamber may be constructed in two, or three or more, numbers.

Figure 6:
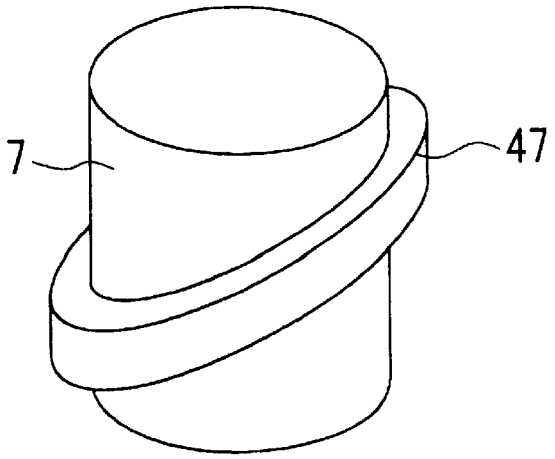
FIG. 6 is a perspective view illustrating a rotary member of the second embodiment.

Next, a second embodiment of the present invention is illustrated in FIGS. 5 to 11. In this embodiment, an example wherein the air chamber is provided one in number. As illustrated in FIG. 6, to the output shaft 5 of the motor there is fixed by forced insertion, adhesion, etc. the rotary member 7 that has on its outer-peripheral portion the cam portion consisting of the convexed portion 47 disposed obliquely with respect to the axial line thereof.

On the surface of the motor portion 1 on the side thereof where the output shaft is provided there is mounted the case member 9 by screws, etc. On another surface of the case member 9 opposite to that contacting to the motor portion 1, there are provided screw holes (not illustrated). Each one of the diaphragm 11 that is made of flexible elastic material such as rubber, the air passage lid 13, and the case lid 15 are provided therein with the screw holes. Therefore, these members can be fixed to the case member 9 by screwing.

Figure 10:
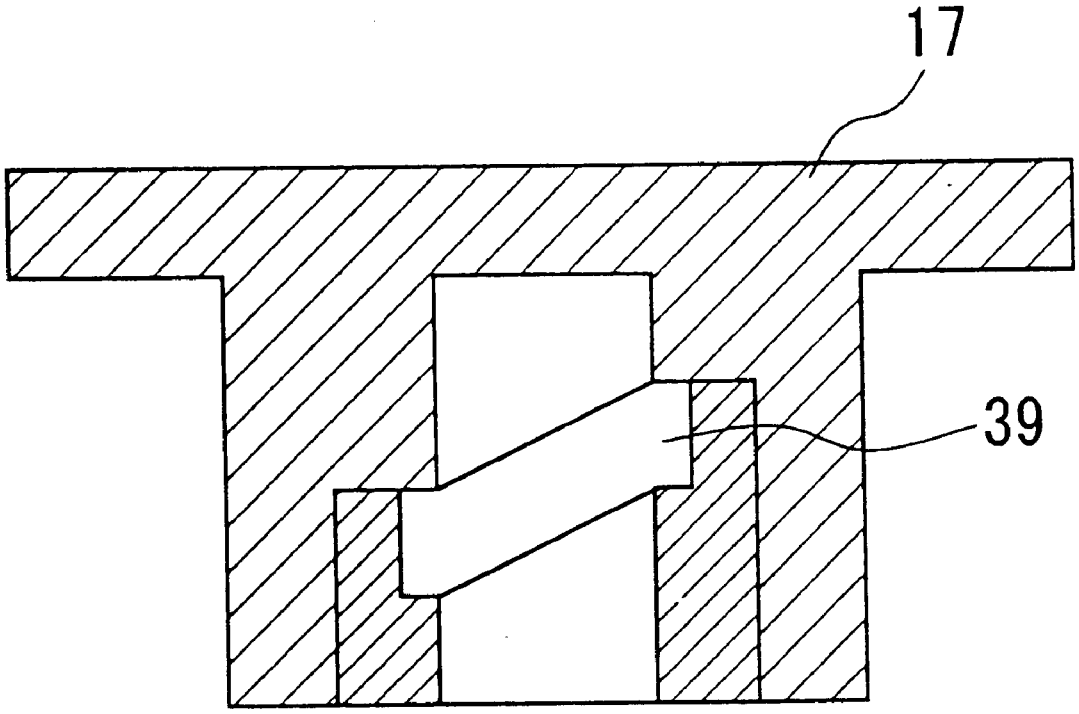
FIG. 10 is a sectional view illustrating a concaved groove of the rotary member of the second embodiment.

And, in the inner-peripheral surface of the drive member 17 there is formed a smooth concaved groove 39 that is inclined with respect to a plane vertical to the direction of the output shaft of the motor as illustrated in FIG. 10. And the convexed portion 47 of the rotary member 7 is coupled with a part of the concaved groove 39 that is inclined with respect to the axial line of the drive member 17.

Next, using FIG. 7, the operation of the small-sized pump device according to the second embodiment of the present invention will be explained. When causing an electric current to flow into the motor and thereby energizing it, the rotary member 7 fixed to the output shaft 5 makes a rotation and, along therewith, the convexed portion 47 also makes a rotational movement.

Figure 7:
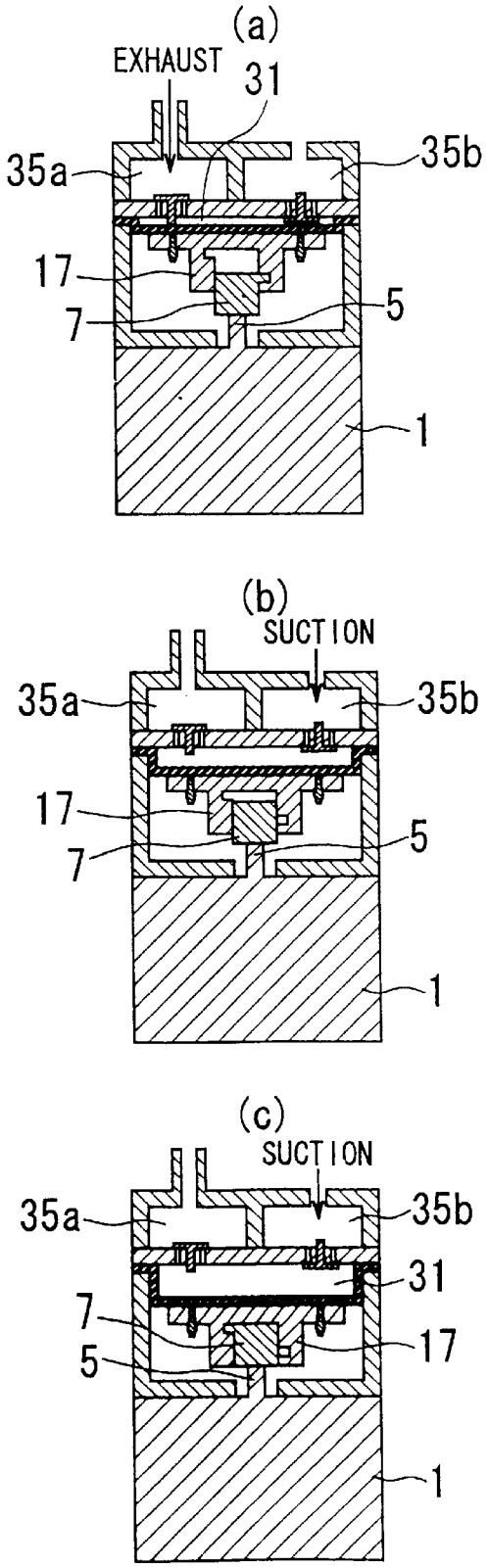
FIGS. 7(*a*) to 7(*c*) are explanatory views illustrating the operation of the small-sized pump device of the second embodiment.

The convexed portion 47 of the rotary member 7 and the concaved groove 39 of the drive member 17 are coupled with each other, and, in FIG. 7(*a*), the convexed portion 47 is located on the right side of the output shaft 5 and located on a lower side of the concaved groove 39 of the drive member 17. At this stage, the upper surface of the drive member 17 is located at a position remotest from the motor 1. Accordingly, the air chamber 31 formed by the diaphragm 11 fixed to the upper surface of the drive member is compressed.

When the air chamber 31 has been compressed, since the pressure within it is high, the air within the air chamber 31 passes through the exhaust opening 25 and pushes and opens the exhaust valve 21. Then, this air passes through the exhaust passage 29 and is thereby sent into the cuff band member.

And when the convexed portion 47 is moved by being rotated due to the rotation of the motor portion 1 and thereby reaches the position indicated in FIG. 7(*b*), the drive member 17 is located intermediate of the concaved groove 39. And the air chamber 31 is brought to a low pressure conditions. Therefore, the exhaust valve 21 is closed. And the suction valve 19 is opened due to the pressure of the air that has been stored within the suction chamber 35 through the suction passage 27. As a result of this, inflow of air starts from the suction opening 23. Namely, the suction stroke begins.

Further, when the convexed portion 47 is moved to the position of FIG. 7(*c*) and located at an upper position of the concaved groove 39, the upper surface of the drive member 17 comes to a position nearest to the motor portion 1. As a result of this, the air chamber 31 has a maximum volume. In this way, the convexed portion 47 of the rotary member 7 moving in such a way as to make a sliding contact with the concaved groove 39 of the drive member 17 due to the rotation of the motor, the rotational movement of the motor is highly efficiently converted to a linear movement causing the air chamber to be compressed and expanded.

It is to be noted that, as illustrated as a sectional view in FIG. 8(*a*), the convexed portion 47 may be the one that is formed integrally with the rotary member 7 by using the same material as that of the rotary member 7. Or, as illustrated in FIG. 8(*b*), it may be also arranged that a hole be formed in the rotary member beforehand and the convexed portion 47 be thereby formed by inserting into this hole a pin 63 made of material different from that of the rotary member. By using the pin 63 made of such different material, for example, it is possible to partially use a low-frictional material and thereby decrease the slide-frictional force between the concaved groove of the drive member and the pin. Also, by loosely fitting the pin into the hole of the rotary member, the pin can have a degree of freedom with respect to the rotation and therefore the sliding friction can be also changed into a rolling friction. This enables a further decrease in the frictional force as well. As a result of this, the most optimized designing for making small the frictional force between the convexed portion 47 and the concaved groove 39 becomes possible.

Figure 11:
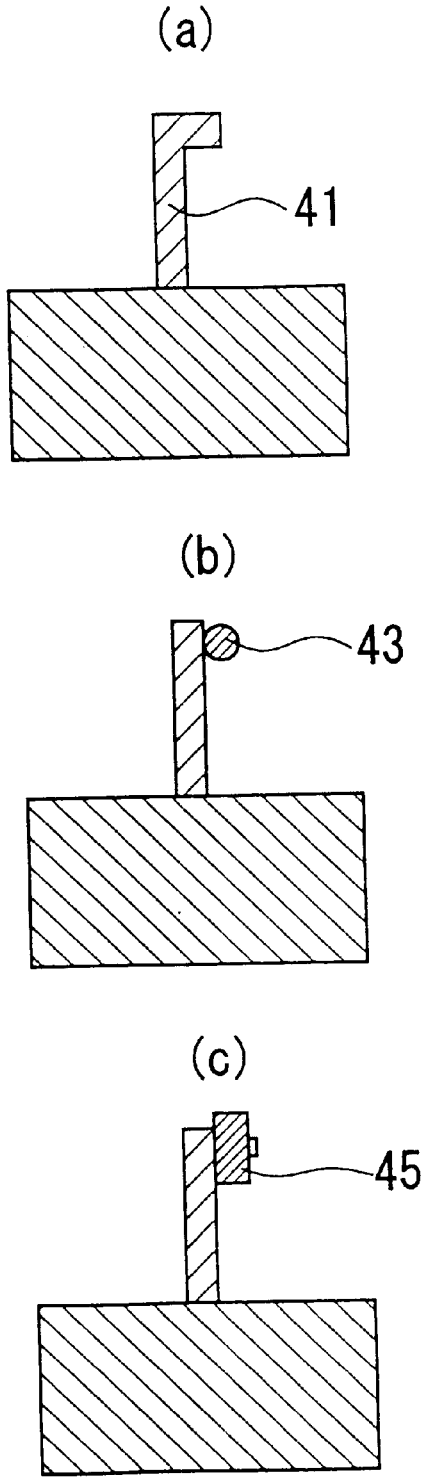
FIGS. 11(*a*) to 11(*c*) are explanatory views illustrating output shafts of the second embodiment.

Also, as illustrated in FIG. 11(*a*), the output shaft 5 itself may be an out put shaft 41 having L-shape like portion at an end portion thereof and serving as the convexed portion 47. Or, as illustrated in FIG. 11(*b*) it may be the one that has a circular-columnar, or spherical, convexed portion 43 joined thereto by welding, etc. Further, by using a convexed portion 45 comprising a ball bearings as illustrated in FIG. 11(*c*), it becomes possible to use a rolling friction.

As a result of this, since the rotary member 7 becomes unnecessary, it is possible to achieve a reduction in the moment of inertia causing a load upon the motor. Simultaneously, the distance between the contact portion, existing between the convexed portion 47 and the concaved groove 39, and the output shaft can be shortened, resulting in that the load torque applied onto the motor can be decreased.

Figure 12:
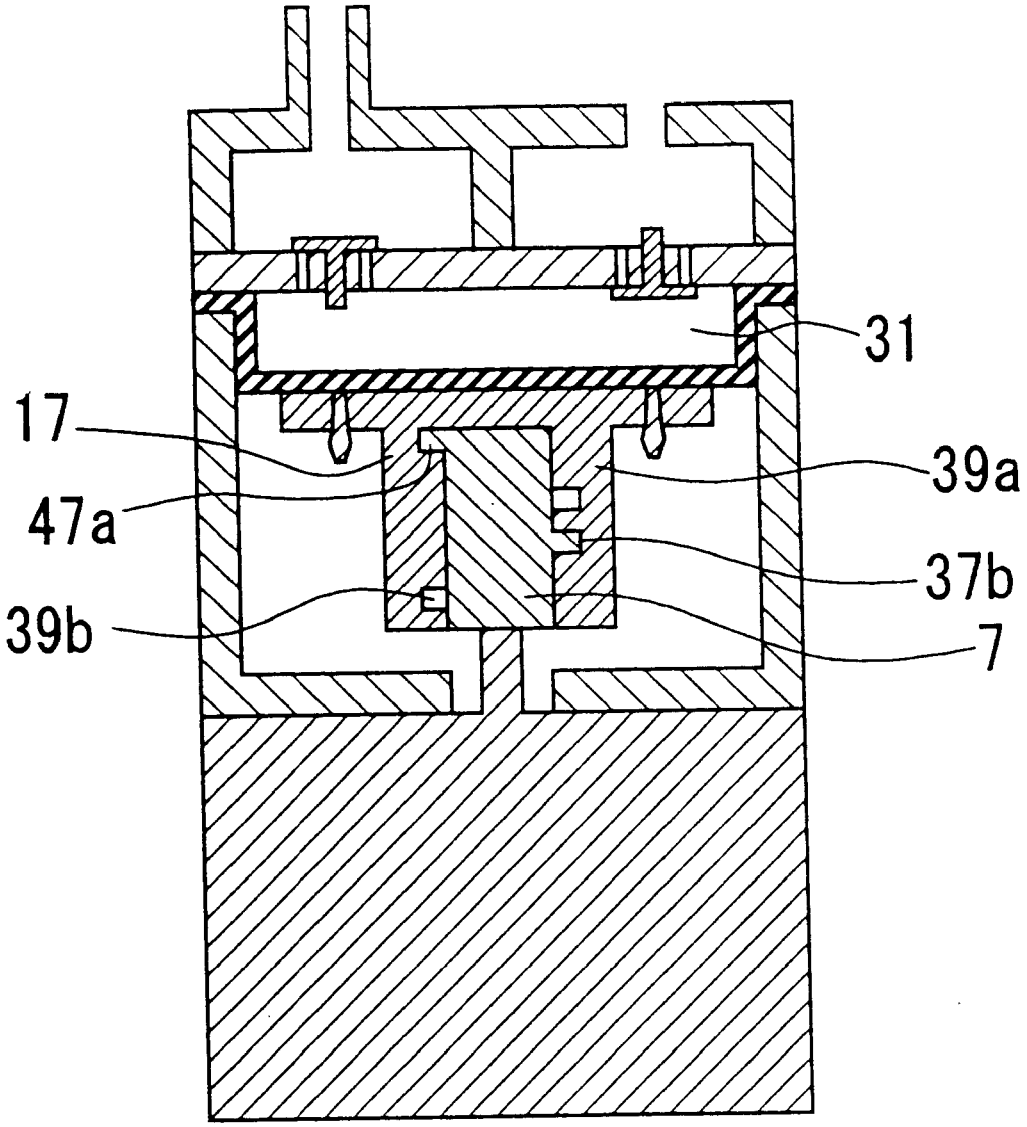
FIG. 12 is an explanatory view illustrating a third embodiment of the small-sized pump device according to the present invention.

Here, a plurality of the convexed portions may be provided on the outer surface of the rotary member 7, each of which being arranged thereon in a axis-symmetrical condition to each other. This will now be explained as a third embodiment with the use of FIG. 12. In an inner-peripheral surface of one drive member 17, are formed smooth concaved grooves 39*a*, 39*b* that are inclined with respect to a plane vertical with respect to the axial direction of the output shaft of the motor, the number of which corresponding to the number of the convexed portions 47*a*, 47*b*. The convexed portions 47*a*, 47*b* of the rotary member 7 are respectively combined with parts of the concaved grooves 39*a*, 39*b* inclined with respect to the axial line of the drive member 17. And the first convexed portion 47*a* and the second convexed portion 47*b* are located at the respective portions opposed to each other with a phase difference in an angle of approximately 180 degrees. Therefore, the load that is generated due to the contact between the first convexed portion 47*a* and the first concaved groove 39*a* and that is applied onto the output shaft in the axis direction thereof and the load that is generated due to the contact between the second convexed portion 47*b* and the second concaved groove 39*b* and that is applied onto the output shaft in the axis direction thereof act upon the output shaft with the same magnitude in opposite directions to each other. Therefore, the both loads can cancel with each other and so it is possible to decrease the load applied onto the motor. Therefore, the power consumption can be decreased.

Figure 13:
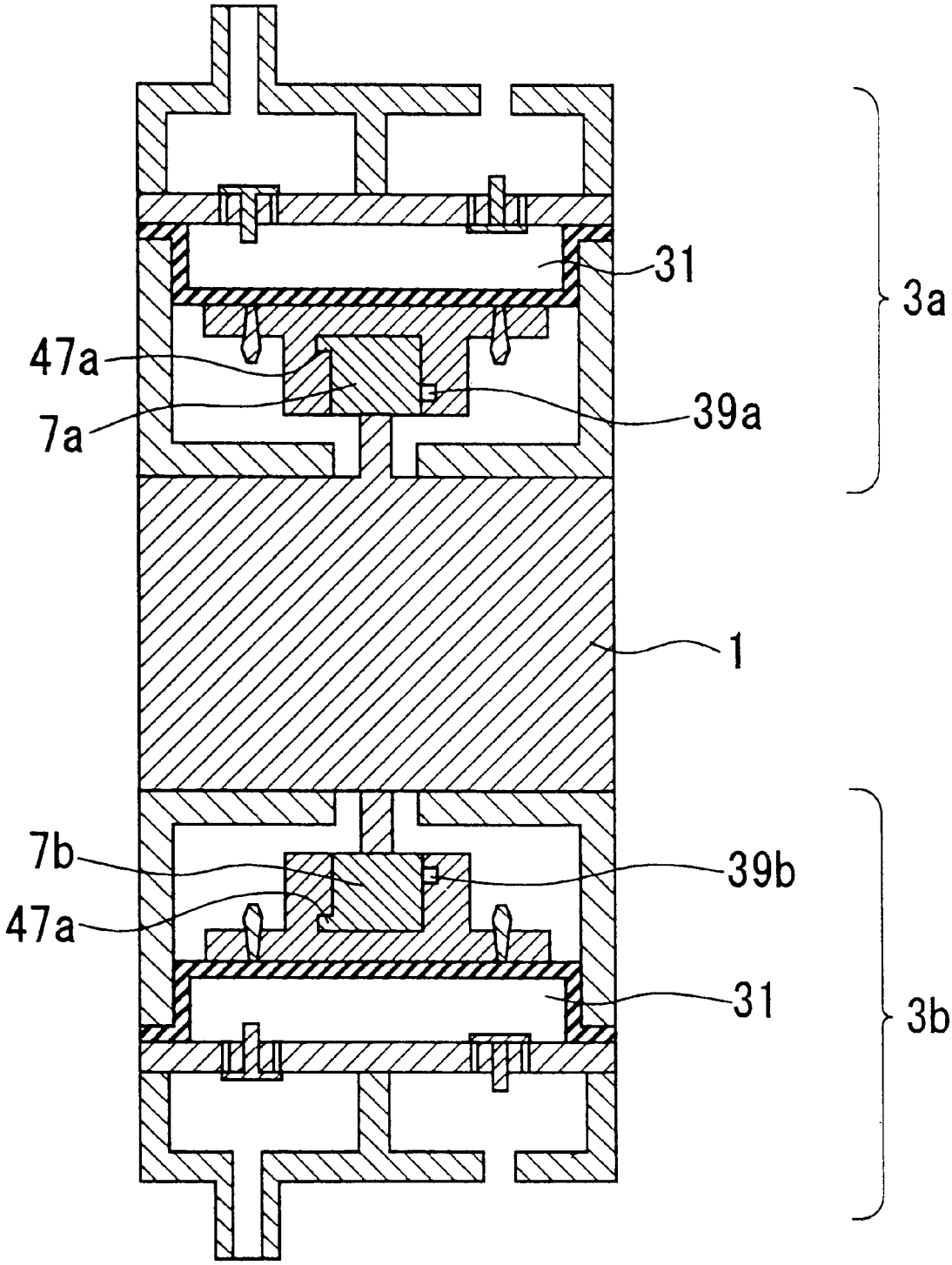
FIG. 13 is an explanatory view illustrating a fourth embodiment of the small-sized pump device according to the present invention.

Also, a plurality of the pump portions may be disposed symmetrically with respect to a plane vertical with respect to the output shaft. This will now be explained as a fourth embodiment with the use of FIG. 13. A pump chamber 3*a* and a pump chamber 3*b* are disposed symmetrically with the plane vertical with respect to the axial direction of the output shaft of the motor. In addition, the suction and exhaust strokes in the pump chamber 3*a* and in the pump chamber 3*b*, respectively are performed with the same timing. Therefore, the loads applied in the output shaft direction, which are generated due to the compressions or expansions of the air chambers act in opposite directions between the pump chamber 3*a* and the pump chamber 3*b*. Therefore, the both loads cancel with each other. Therefore, it is possible to decrease the load applied onto the motor in the output shaft direction. Therefore, the power consumption can be decreased.

Namely, one or a plurality of the air chambers 31 are disposed on mutually opposite sides of the motor 1 constituting the drive source so as to interpose the motor therebetween.

Figure 14:
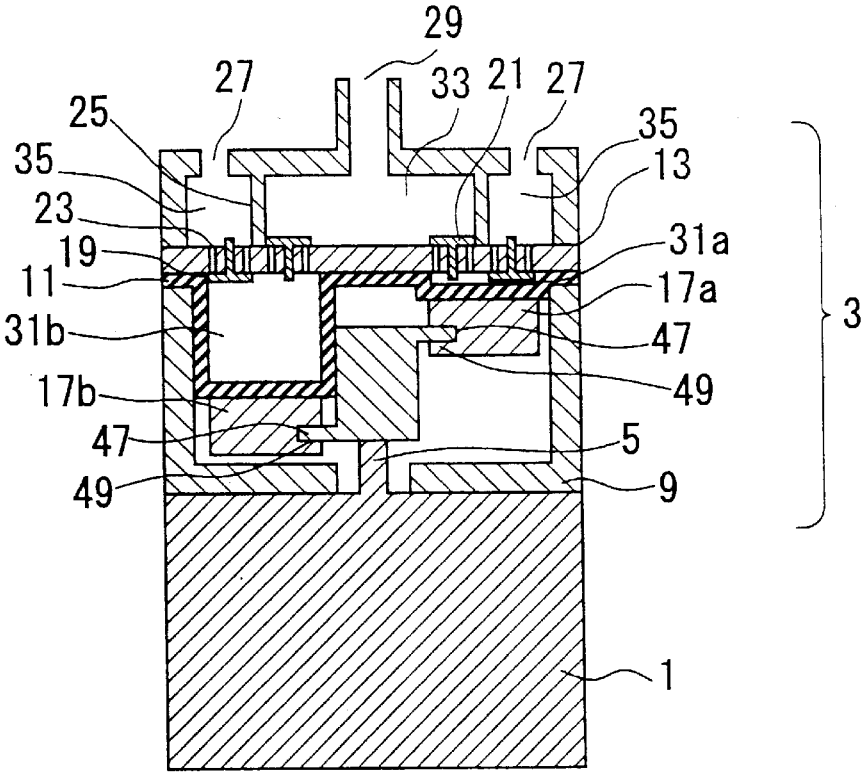
FIG. 14 is an explanatory view illustrating a fifth embodiment of the small-sized pump device according to the present invention.

Next, a fifth embodiment of the small-sized pump device used in the blood pressure meter of the present invention will be explained using a sectional view of FIG. 14. The output shaft 5 is extended from the motor portion 1. As illustrated in the perspective view of FIG. 6, to the output shaft 5 there is fixed by forced insertion, adhesion, etc. the rotary member 7 that has on its outer-peripheral surface the convexed portion 47 inclined with respect to the plane rectangular to the axial direction of the output shaft of the motor.

On the side of the motor portion 1 having the output shaft mounted thereon there is mounted the case member 9 by screws, etc. On the surface of the case member 9 opposite to the surface on which the motor portion has been mounted, there are provided screw holes (not illustrated). The diaphragm 11 which is made of flexible elastic material such as rubber, the air passage lid 13, and the case lid 15 are also provided therein with the same screw holes. Therefore, these members can be fixed to the case member 9 by screwing.

Figure 16:
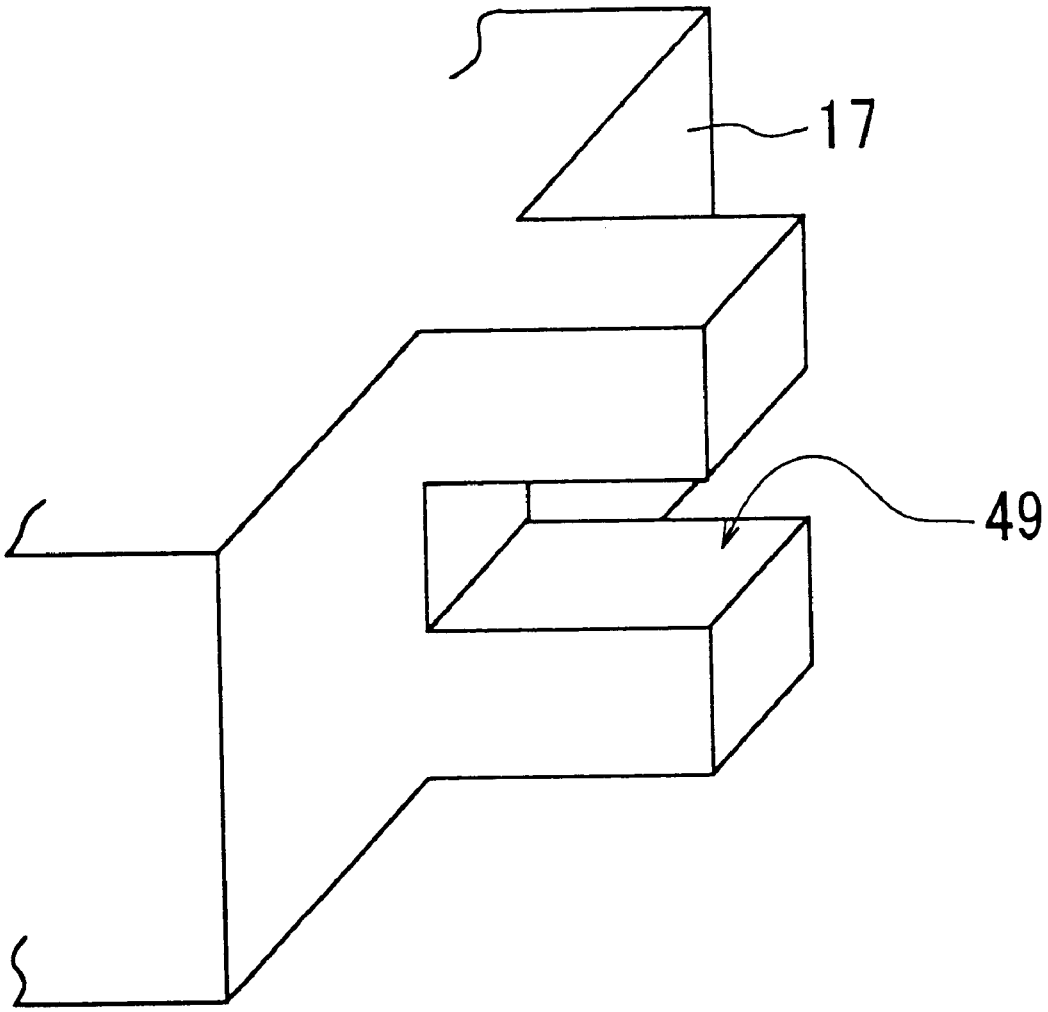
FIG. 16 is an explanatory view illustrating a horizontally thrown U-shaped groove of a drive member of the sixth embodiment.

On the side surface of the rotary member of the drive member 17, there is provided with a U-shaped groove 49 as illustrated in a partial perspective view of FIG. 16, which enable to clamp the convexed portion 47 inclined with respect to the axial line of the rotary member with a top surface and a bottom surface thereof. And the convexed portion 47 of the rotary member and the U-shaped groove 49 of the drive member 17 are loosely coupled with each other. Also, the upper surface of the drive member 17 and the bottom surface of the diaphragm 11 are fixed to each other by adhesion or, by inserting a spherical portion having a diameter slightly larger than the size of a hole formed in a part of the drive member 17, etc. The drive member 17 is regulated by the case main body 9 in the radial movement as viewed with respect to the output shaft, and is also regulated in the movement in the rotational direction about the output shaft. Therefore, the drive member is only movable in the direction of the output shaft. The air passage lid 13 is provided with the suction opening 23 and the exhaust opening 25. For the purpose of preventing the back flow of the air, these openings 23 and 25 are respectively provided with the suction valve 19 and the exhaust valve 21.

And, the case lid 15 is also provided with the suction passage 27 and the exhaust passage 29. The suction chamber 35 and the exhaust chamber 33 are provided in a space formed between the case lid 15 and the air passage lid 13. And, when causing an electric current to flow into the motor and thereby energizing it, the rotary member 7 fixed to the output shaft 5 makes a rotation and, along therewith, the convexed portion 47 also makes a rotational movement.

The convexed portion 47 of the rotary member 7 and the U-shaped groove 49 of the drive member 17 are coupled to each other. When the convexed portion 47 is located in a state of ascendant in the right/upper direction, the drive member 17*a* is located at the remotest position from the motor 1. Accordingly, the air chamber 31*a* formed by the diaphragm 11 fixed to the drive member 17*a* is compressed.

And, the drive member 17*b* is located in the nearest position to the motor portion 1. Accordingly, the air chamber 31*b* formed by the diaphragm 11 fixed to the drive member 17*b* is expanded. When the air chamber 31*a* has been compressed as mentioned above, since the level of the pressure within it, is high, the air within the air chamber 31*a* passes through the exhaust opening 25 and pushes and opens the exhaust valve 21. Then, this air passes through the exhaust passage 29 and is thereby sent into a cuff band member. On the other hand, when the air chamber 31*b* has been expanded, since the level of the pressure within it, is low, the air that has been stored within the suction chamber 35 through the suction passage 27, flows into the air chamber 31*b* via the suction opening 23 and via the suction valve 19 that has been pressed and opened by this air.

On the other hand, in a state where the rotary member is rotated and the oblique convexed portion 47 is located in a state of ascendant in the left/upper direction, the air chamber 31*a* is expanded and makes its suction. As a result of this, the air chamber 31*b* is compressed and makes its exhaust.

In this way, the respective air chambers are repeatedly expanded and compressed due to the rotation of the motor and thereby repeatedly make their suction and exhaust. In addition, if when a plurality of the air chambers could be disposed with respect to one rotary member in its peripheral direction, each one of the timings with which the respective air chambers carry out compressing and expanding operations can show a certain time difference from each other, resulting in that the pulsation caused by exhausting or sucking operations can be made small.

Figure 15:
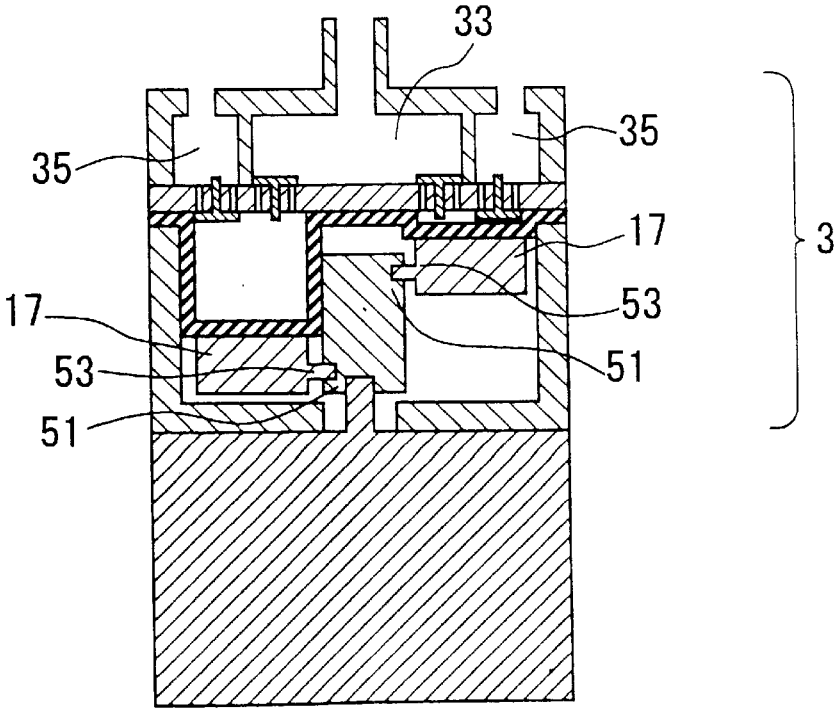
FIG. 15 is an explanatory view illustrating a sixth embodiment of the small-sized pump device according to the present invention.

Also, in a case where the rotary member has an inclined concaved portion 51 as illustrated in FIG. 3, this embodiment will now be explained as a sixth embodiment as illustrated in FIG. 15. A convexed portion 53 of the drive member is formed at a position thereof directing toward the rotary member 17. The concaved portion 51 of the rotary member and the convexed portion 53 of the drive member are loosely coupled to each other and are associated together. As a result of this, there is obtained the effect as same as that obtained in the fifth embodiment in that the pulsation caused by sucking and exhausting operation can be made small.

Figure 17:
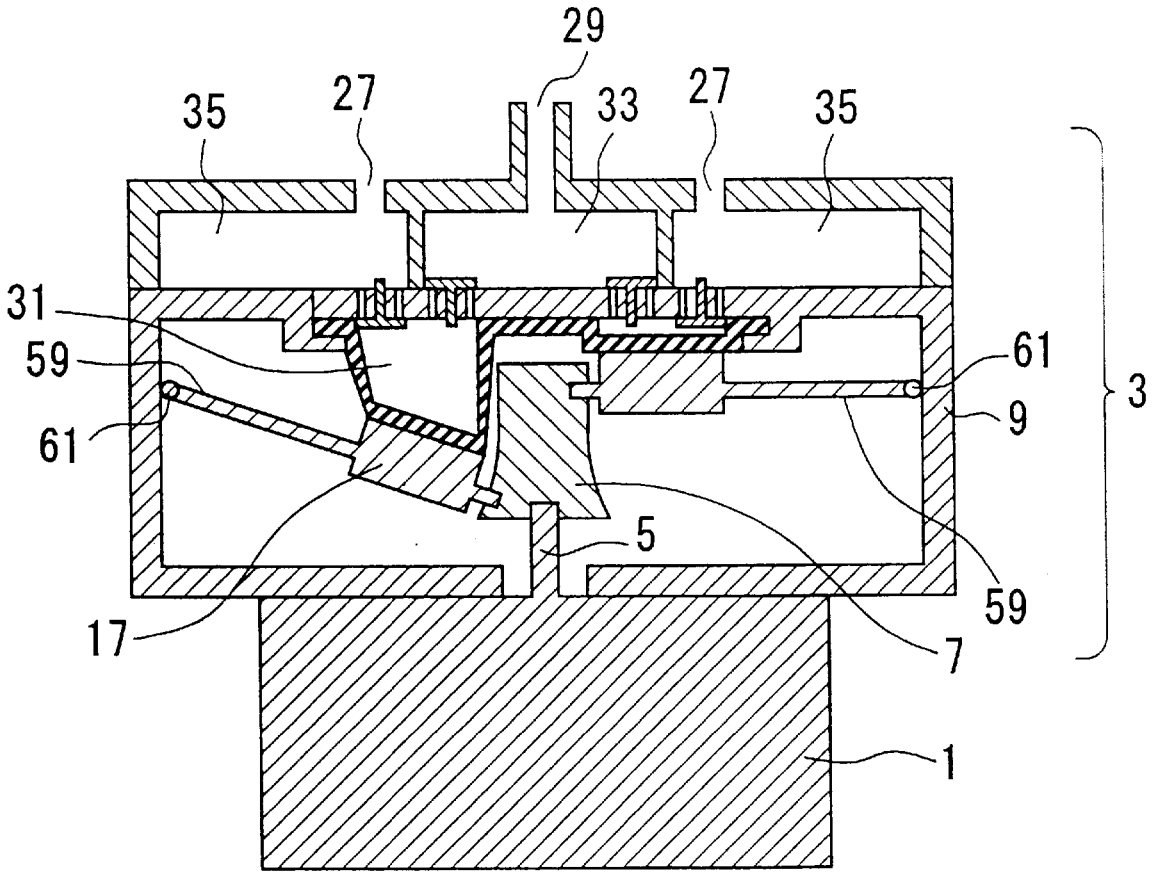
FIG. 17 is a sectional view illustrating a seventh embodiment of the small-sized pump device according to the present invention.

And, in a seventh embodiment, as illustrated in FIG. 17, on a side of the drive member 17 opposite to the side thereof facing to the rotary member 7, there is an arm portion 59 of the drive member. The arm portion 59 of the drive member is fixed to an inner wall of the case main member 9 by a swing portion 61 so that the arm portion may be swingably moved about this swing portion 61. The convexed portions 53 of the drive member are respectively loosely coupled to the concaved portions 51 of the rotary member 7 and are associated therewith. The drive member 17 is supported at one end by the swing portion 61 and is supported at the other end thereof by the concaved portion 51 of the drive member 7. The outer-peripheral surface of the rotary member is shaped along a locus line of the drive member. And the convexed portion 53 of the drive member is not apart from the concaved portion 51 and the drive member 17 is moved along the concaved portion 51. Namely, the drive member 17 is moved about the swing portion 61 along a circular-arc locus line on a plane parallel with the surface of the drawing.

As a result of this, it is possible to perform the pumping operation causing the compression and expansion of the air chamber 31. This makes it possible to cause the compression and expansion of the air chamber 31 about the swing portion 61. This can lessen the load applied onto the rotary member and therefore decrease the load upon the motor. This can achieve the low power consumption as well as the application of a high pressure.

Namely, a plurality number of the motor portion 1 constituting the drive source, as well as the drive transmission portion and the circular-peripheral surface cam portion, are also used in correspondence with the number of the air chambers 31.

Figure 18:
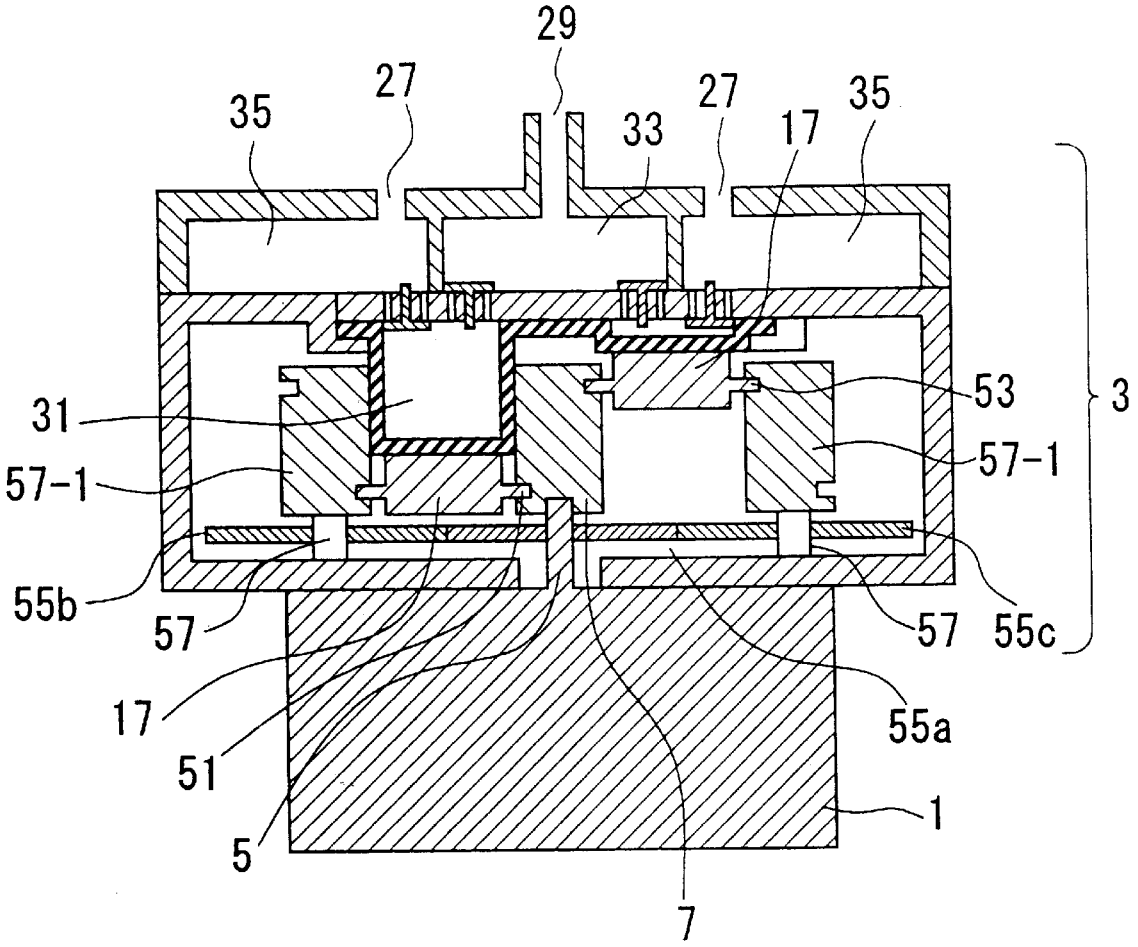
FIG. 18 is a sectional view illustrating an eighth embodiment of the small-sized pump device according to the present invention.

Also, the drive member 17 of the first embodiment may be modified in such a way that each side thereof is provided thereon with the convexed portion 53. Namely, separate rotary members, each having concaved groove 51 to be coupled with the convexed portion 53 of the driving means, are provided, wherein the rotary shafts 57 of the respective rotary members including the separate rotary members including the separate rotary members may be connected to each other by means of gears. This construction will now be explained as an eighth embodiment with referring to FIG. 18. A gear 55*a* is fixed to the output shaft 5 by forced insertion, adhesion, etc., whereby the center gear 55*a* is also rotated due to the rotation of the motor 1.

And, on the left and right side of the gear 55*a*, there are meshed therewith a gear 55*b* and a gear 55*c*. On the gears 55*b* and 55*c* there are provided with rotary shafts 57 and 57 that have been established in parallel with the output shaft 5. Also, on each of the rotary shafts 57 and 57 there is fixed a sub-rotary member 57-1. Further, in the peripheral surface of the sub-rotary member 57-1 there is also disposed a spiral concaved groove 57-2, whereby a cam portion is formed.

Accordingly, when causing an electric current to flow into the motor 1 and thereby energizing it, the rotary member 7 fixed to the output shaft 5 is rotated. Simultaneously, the gear 55*a* fixed to the output shaft 5 also makes its rotational movement. And the gears 55*b* and 55*c* meshed with this gear 55*a* is also rotated at the same time.

Each of the gears 55*a*, 55*b*, and 55*c* has a similar configuration. When the gear 55*a* makes one full rotation, each of the gears 55*b* and 55*c* also makes one full rotation.

By the rotary member 7 and the sub-rotary members 57-1 having been provided on both sides of the drive member via the gears as in this embodiment as described above, the drive member can be supported at its both side ends. Accordingly, it is possible to achieve the reduction in the load applied onto the output shaft. Also it is possible to achieve the low noise and the low power consumption. Further, it is possible to-highly efficiently perform the compression and expansion of the air chamber.

Figure 19:
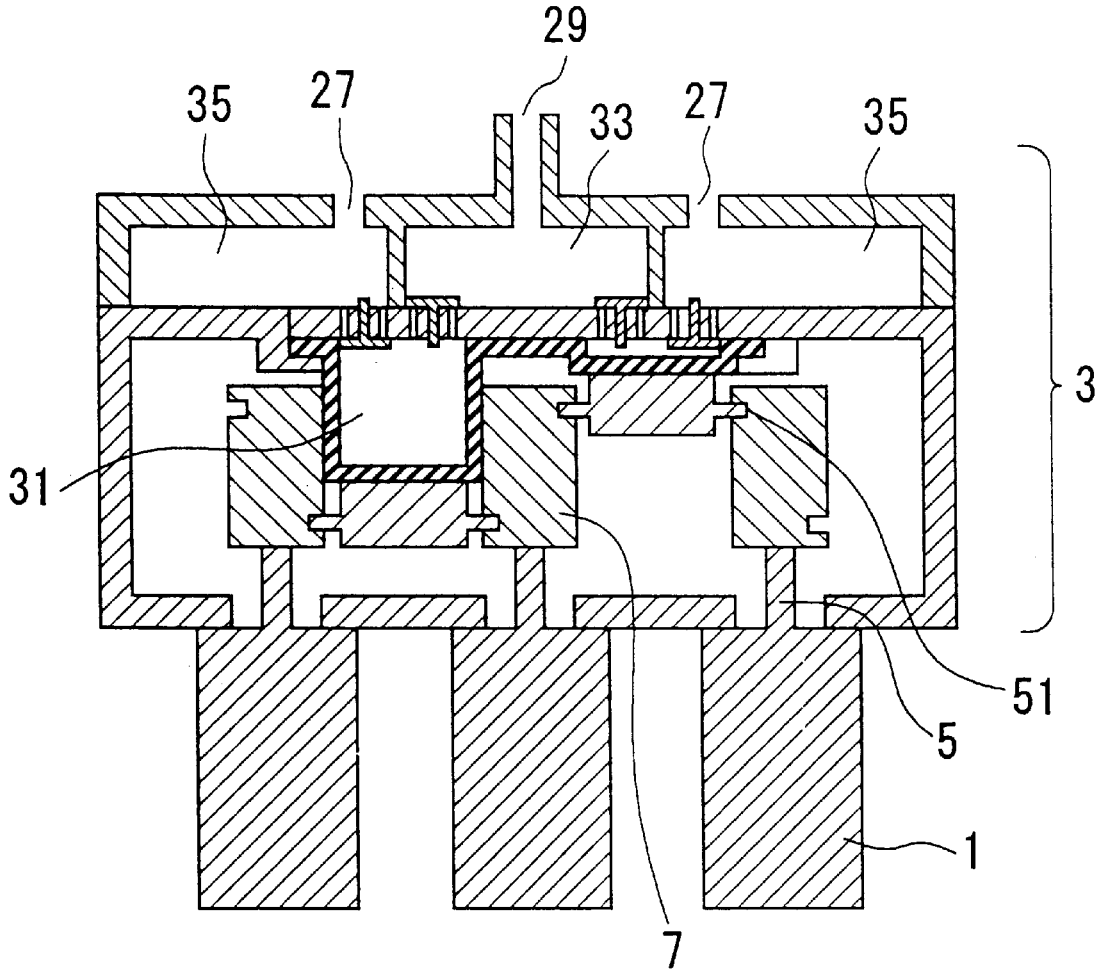
FIG. 19 is a sectional view illustrating a ninth embodiment of the small-sized pump device according to the present invention.

Also, instead of the transmission of the rotation made using the gears of the eighth embodiment, the motor may be provided with respect to each rotary shaft. This construction will now be explained as a ninth embodiment with the use of FIG. 19. A rotation sensing mechanism (not illustrated) is provided so that the respective rotations numbers of the respective motors may be the same. Therefore, by providing the motors in correspondence with the number of the respective output shafts, it is possible to make the diameter of each motor small. Therefore, it is possible to make the small-sized pump device thin and hence to achieve the miniaturization and thinning of the blood pressure meter.

Next, a tenth embodiment of the present invention will be explained as another embodiment of the small-sized pump device used in the blood pressure meter according to the present invention, using an exploded perspective view of FIG. 20 and a sectional view of FIG. 21.

A drive source 200 comprises by a motor 203 and an output shaft 205. By applying a DC voltage to the motor 203, the output shaft 205 makes a rotational movement.

To the output shaft 205 is fixed by forced insertion, adhesion, etc. a circular-cylindrical surface cam 209 constituting a drive transmission portion 207. In the outer-peripheral surface cam 209 is formed a smooth concaved groove 211 that is inclined with respect to a plane vertical with respect to the axial direction of the output shaft.

As the material of which the circular-cylindrical surface cam 209 there is used a plastic material, such as polyaceral, which is preferably the one that has less friction resistance and excellent wear resistance. On the output-shaft side of the motor 203 is mounted by screws, etc. an outer case 213 constituting the drive transmission portion 207.

Also, as another piece of parts constituting the drive transmission portion 207, there is a drive member 215, which has a desired configuration by bending, for example, a wire of SUS 304.

Figure 20:
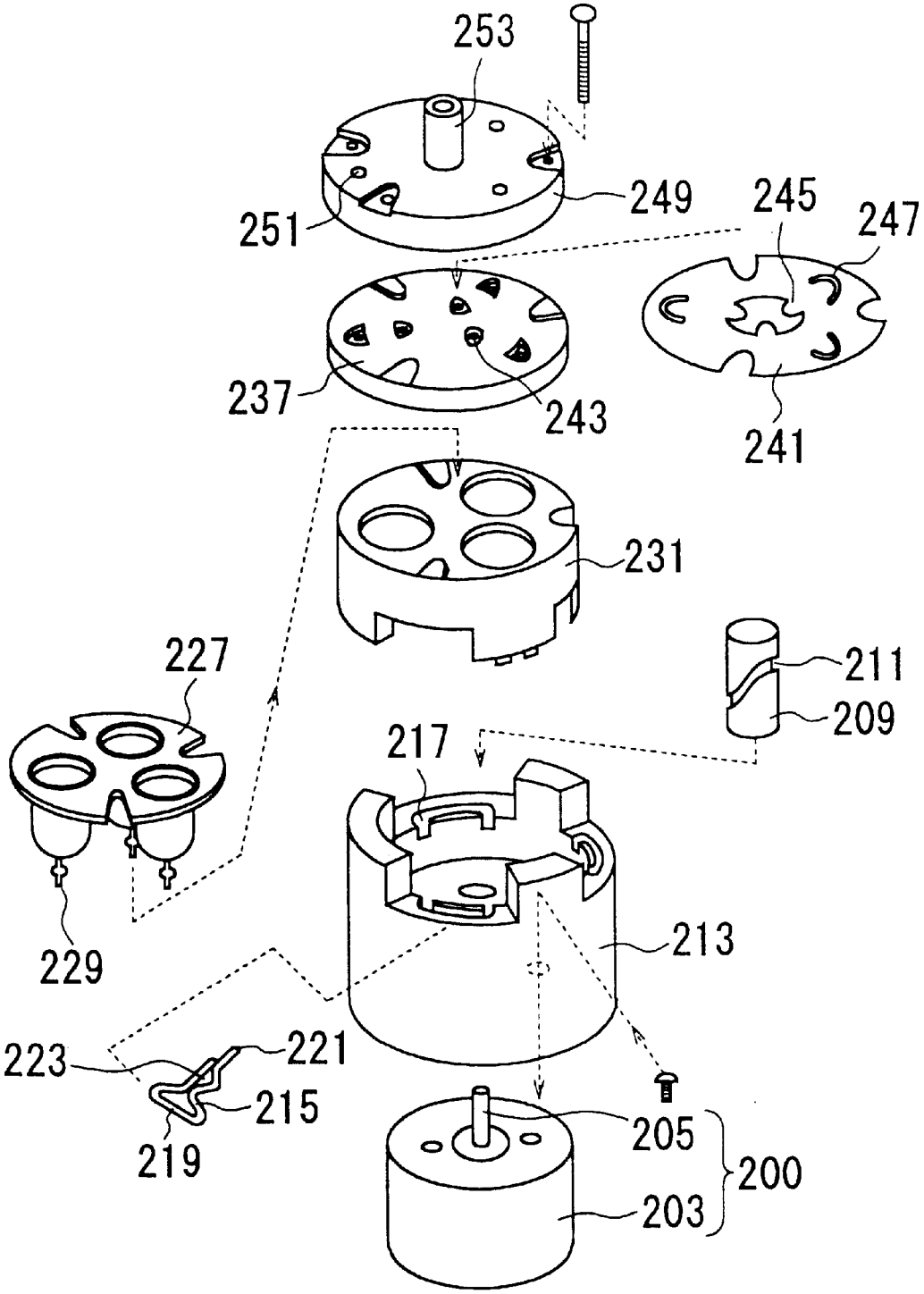
FIG. 20 is an exploded perspective view illustrating a tenth embodiment of the small-sized pump device according to the present invention.
Figure 21:
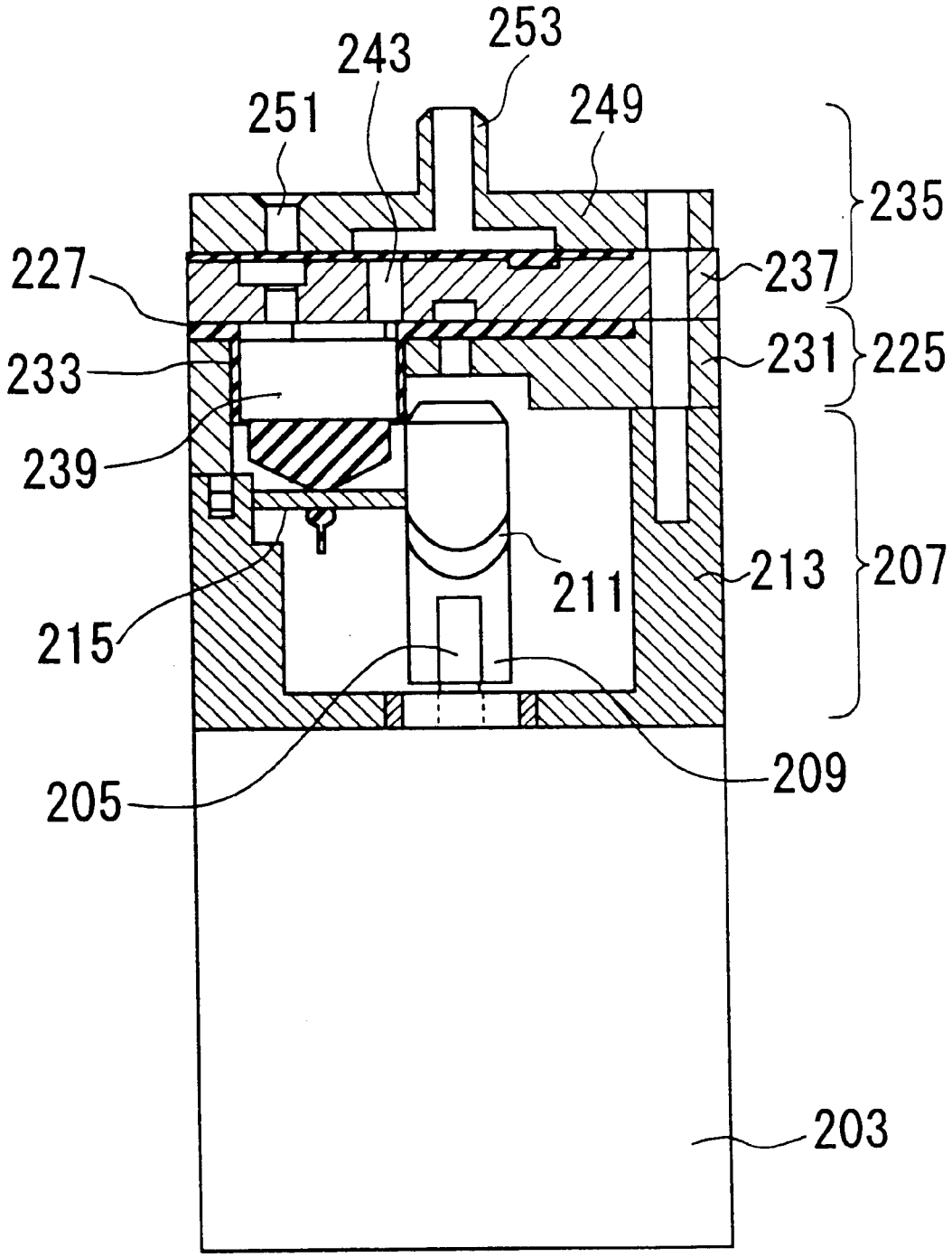
FIG. 21 is a sectional view illustrating the small-sized pump device of the tenth embodiment.

In FIGS. 20 and 21, the embodiment shows three drive members 215 are used, but any member of the drive members can be used depending upon its construction.

In the outer-peripheral portion of the outer case 213, a plurality of drive-member mounting grooves 217 are provided, the number of which corresponding to the number of the drive members 215. A fixing end 219 of the drive member 215 is fitted into the drive-member mounting groove 217, and a free end 221 of the drive members 215 has a substantially spherical shape and inserted into the concaved groove 211 of the circular-cylindrical surface cam 209.

The drive member 215 is regulated by the drive-member mounting groove 217 in the radial directional movement as viewed with respect to the axial direction of the output shaft. Further, the drive member 215 is regulated also in the rotational movement about the output shaft 205. Therefore, the drive member 215 is only movable in the rotational direction around a the fixing end 219 as a rotation axis.

And the drive member 215 is provided thereon with a retaining portion 223. Into the retaining portion 223 is inserted a coupling portion 229 extending downward from a diaphragm 227 that constitutes the pump portion 225 and that is made of flexible elastic material.

In this embodiment, the coupling portion 229 is substantially spherical, and the diameter of this coupling portion 229 is larger than the diameter of the hole of the retaining portion 223 of the drive member 215. In addition, the coupling portion 229 is made of flexible elastic material. And therefore by inserting this coupling portion 229 into the retaining portion 223 with a force greater than a prescribed value, the coupling portion 229 is deformed and thereby is passed through the retaining portion 223. As a result of this, the drive member 215 is fixed to the diaphragm 227.

Also, the diaphragm 227 is fitted into an intermediate case 231. The intermediate case 231, supports the outer-peripheral portion of a side wall 233 that is a deformable portion of the diaphragm 227 so that the side wall 233 does not make its unnecessary deformation.

And an air chamber 239 is formed between an exhaust valve holder 237 constituting the suction/exhaust portion 235 and the diaphragm 227.

At the positions, corresponding to a plurality of the air chambers 239, of the exhaust valve holder 237, there are provided exhaust openings 243.

On the exhaust valve holder 237 there is placed a sheet valve 241. In the sheet valve 241 are respectively formed one, or a plurality of the exhaust valves 245 and the suction valve 247 each of that carrying out an opening and closing operations due to a change in pressure of the air chamber 239. The exhaust valve 245 is provided at a position corresponding to the exhaust opening 243.

On the sheet valve 241 there is a suction valve holder 249. The suction valve holder 249 and the exhaust valve holder 237 clamp the sheet valve 241.

In the suction valve holder 249, there is provided a suction opening 251 at a position that corresponds to each suction valve 247. At a substantially central portion of the suction valve holder 249 is provided a circular-cylindrical exhaust port 253. All that is discharged from each exhaust opening 243 is discharged from the exhaust opening 253.

It is to be noted that the suction opening 251 and the exhaust opening 243 are kept sealed from each other by means of a seal portion (not illustrated) provided on the sheet valve 241. Therefore, no air passes between the two.

And the suction valve holder 249, the exhaust valve holder 237, the intermediate case 231, and the outer case 213 each is provided therein with screw holes at the same position and are fixed together by screws hermetically to each other.

Also, in this embodiment, the pump portion 3 is equipped with the exhaust valve holder 237, the sheet valve 241 disposed thereon, and the suction valve holder 249 disposed the sheet valve 24.

Next, using FIGS. 22(*a*) to 22(*c*), the operation of the small-sized pump device of this embodiment will be explained.

It is to be noted that since FIG. 22 is a sectional view only one of the air chamber 239 formed by the diaphragm 227 is illustrated. However, even in a case where a plurality of the air chambers 239 are disposed around the output shaft 205, the movement of each of the individual air chambers is the same to each other.

When causing an electric current to flow into the motor 203, the circular-cylindrical surface cam 209 forcedly inserted onto and fixed to the output shaft 205 makes its rotation and simultaneously the concaved groove 211 also changes its position.

The concaved groove 211 of the circular-cylindrical surface cam 209 and the free end 221 of the drive member 215 are mutually fitted with each other. In FIG. 22(*a*), the upper end of the concaved groove 211 is located on a position closed to the drive member 215, and the free end 221 is located at a position raised up to intermediate case 231. Accordingly, the diaphragm 227 fixed to the drive member 215 is pushed upward. Therefore, the air chamber 239 is compressed and so the volume thereof is in a state of being the smallest.

And when the air chamber 239 has been compressed, the pressure within the air chamber 239 becomes high. Therefore, the air within the air chamber 239 passes through the exhaust opening 243 and pushes and opens the exhaust valve 245. And the air is then sent into the cuff band member through the exhaust opening 253.

At this time, the suction valve 247 is pressed onto the suction opening 251 of the suction valve holder 249, whereby the sealability between these two elements is maintained. The leak of the air to the outside is thereby prevented.

And, further, when the concaved groove 211 is moved and reaches the position of FIG. 22(*b*), the free end 221 of the drive member 215 is located at a position the height of which is substantially intermediate of the concaved groove 211. The drive member lowers the diaphragm 227, whereby the volume of the air chamber 239 gradually increases from the state in that the volume thereof being the smallest.

At this time, the air that has thereby been increased flows from the suction opening 251, and this air pushes and opens the suction valve 247 to flow into the air chamber 239.

Also, at the time of inflow of the air, the exhaust valve 245 is pressed onto the exhaust opening 243 of the exhaust valve holder 237, whereby the sealability between these two elements is maintained. The back flow of the air from the cuff band member is thereby prevented.

Further, when the concaved groove 211 is moved to the position of FIG. 22(*c*) and the free end 221 of the drive member 215 has been located at the lower end of the concaved groove 211, the upper surface of the drive member 215 becomes nearest to the motor 203. As a result of this, the air chamber 239 has the largest volume.

In this way, the free end 221 of the drive member 215 moving in such a way as to trace the concaved groove 211 of the circular-cylindrical surface cam 209 due to the rotation of the motor 203, the drive member 215 is moved up and down with the drive-member mounting groove 217 serving as the center of rotation. As a result of this, the rotational movement of the motor 203 can be highly efficiently converted to a linear movement causing the air chamber 239 to be compressed and expanded.

Figure 23:
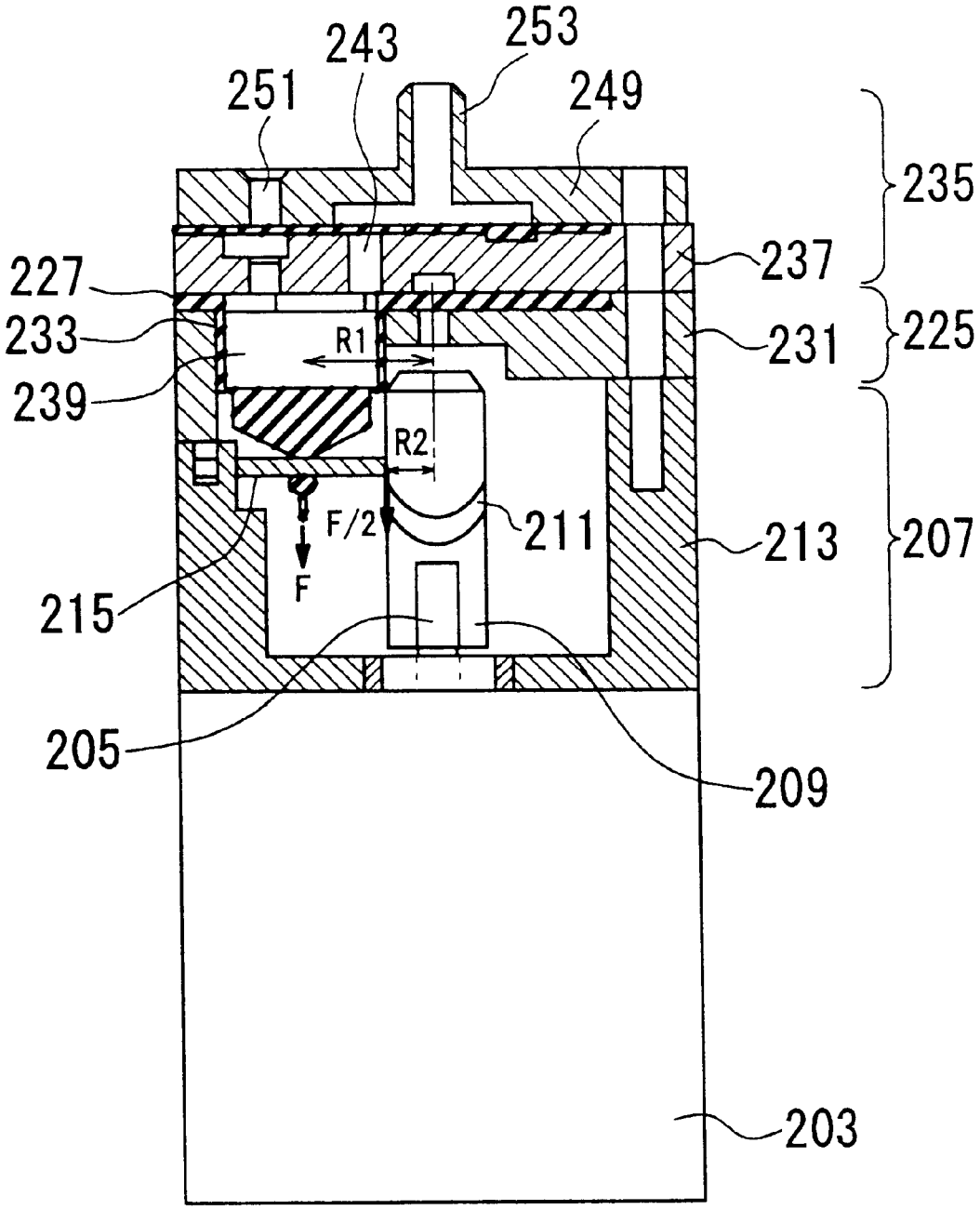
FIG. 23 is an explanatory view illustrating a force that is applied to a motor of the small-sized pump device of the tenth embodiment.

Also, FIG. 23 illustrates the principle "means for making an efficient transmission" of the present invention. This principle will now be explained. In a case where the force F applied to the drive member 215 from the air chamber 239 has been applied at a position away from the output shaft 205 of the motor 203 by a distance R1, the force F is divided by the drive-member mounting groove 217 and the concaved groove 211 of the circular-cylindrical surface cam 209. Therefore, the load applied onto the motor 203 is calculated by the product of the radius R2 of the circular-cylindrical surface cam 209 and the force F/2, i.e., F/2×R2. This value is smaller than that of the load F×R1 in the case of the conventional pump. Accordingly, it becomes possible to remarkably improve the torque characteristic that is among the characteristics affecting the load of the motor as compared with the conventional type of pump.

Figure 35:
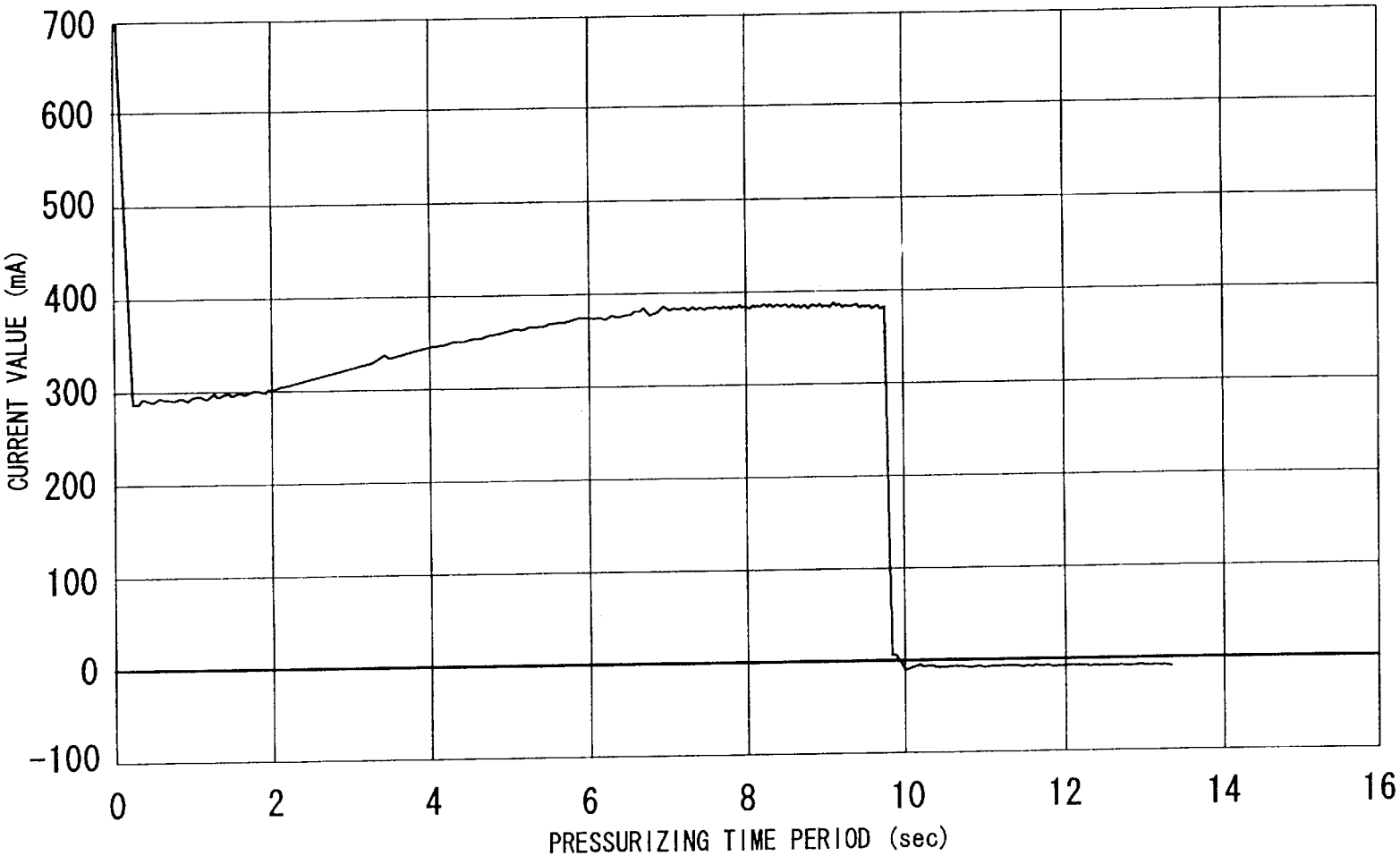
FIG. 35 is an explanatory view illustrating the relationship between the pressurizing time period and the current value of a conventional small-sized pump device.
Figure 36:
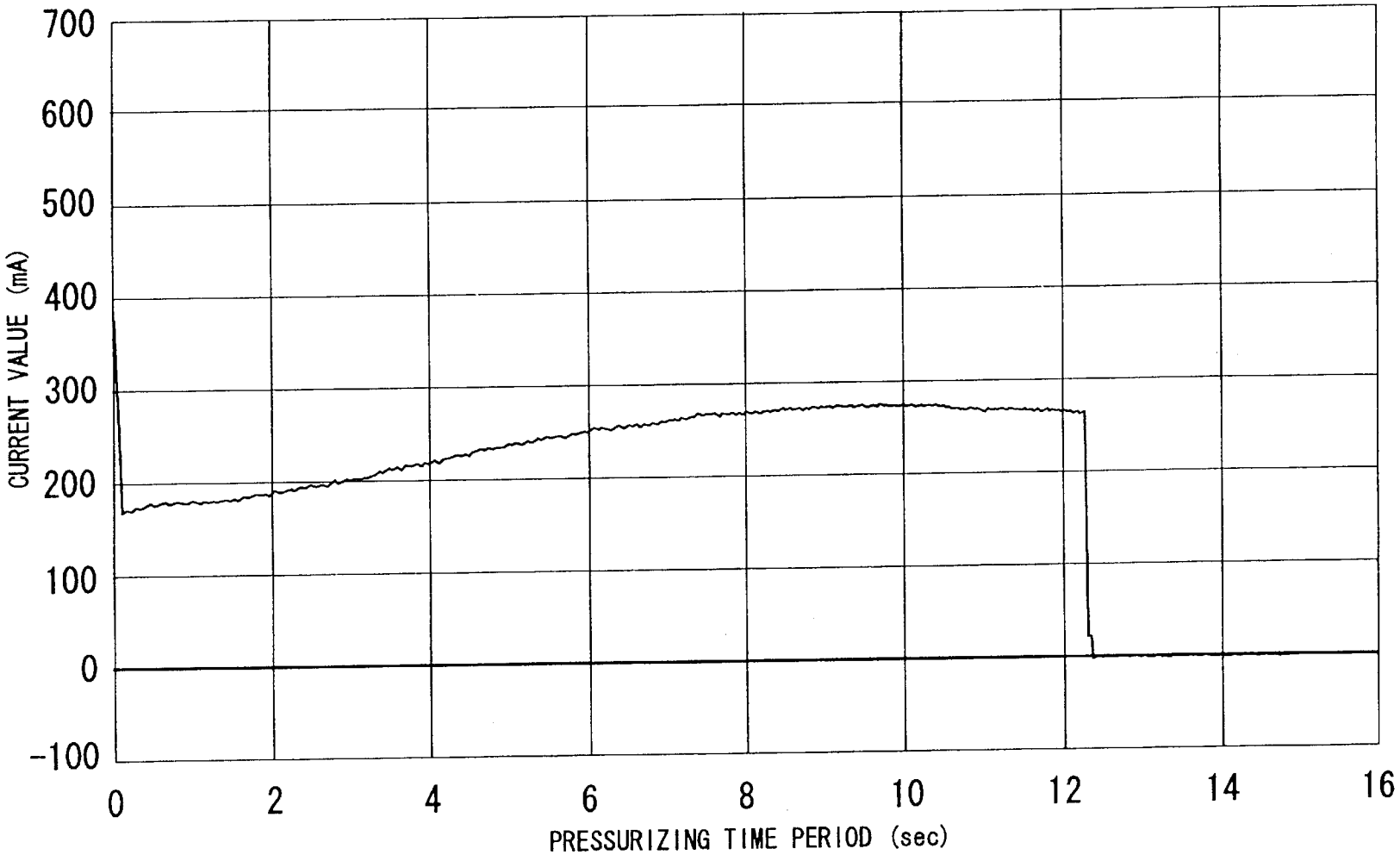
FIG. 36 is an explanatory view illustrating the relationship between the pressurizing time period and the current value of the small-sized pump device according to the present invention.

FIGS. 35 and 36 respectively illustrate the time periods of pressure application and the current values flowing into the motor, that are respectively needed until prescribed pressures are reached when pressurization is made in the small-sized pump of the present invention and when pressurization is made in the conventional small-sized pump. In the case of the conventional pump illustrated in FIG. 35, the time period needed until the prescribed pressure is obtained is 10 sec. or less. But the current consumption is as great as 300 to 380 mA. Therefore, the conventional pump is not suitable for a blood pressure meter that is in many cases used with a battery, etc.

On the other hand, as illustrated in FIG. 36, in the case of the small-sized pump of the present invention, it takes 12 seconds or more until the prescribed pressure is obtained. But the current consumption is as small as approximately 170 to 270 mA, with the result that the amount of consumption of the battery is small. This makes it possible to remarkably make longer the life of the battery for use in a portable blood pressure meter using a battery.

Next, an eleventh embodiment of the small-sized pump device used in the blood pressure of the present invention will be explained with reference to a sectional view of FIG. 24 and a perspective view of FIG. 25(*a*) illustrating the obverse surface of the exhaust valve holder as well as a perspective view of FIG. 25(*b*) illustrating the reverse surface of the exhaust valve holder.

A drive source 301 is constituted by a motor 303 and an output shaft 305. To this output shaft 305 is fixed by forced insertion, adhesion, etc. a circular-cylindrical surface cam 309 constituting a drive transmission portion 307. In the outer-peripheral surface of the circular-cylindrical surface cam 309 is formed a smooth concaved groove 311 inclined with respect to a plane vertical with respect to the axial direction of the output shaft. As the material of the circular-cylindrical surface cam 309 there is used plastic material, which preferably is the one such as polyacetal that has less friction resistance and excellent wear resistance.

On the surface of the motor 303 on the output-shaft side is mounted by screws, etc. an outer case 313 constituting the drive transmission portion 307. Also, as one more piece of parts constituting the drive transmission portion 307 there is a drive member 315. This drive member 315 is formed into a desired configuration, for example, by bending a wire of SUS 304, etc.

Figure 24:
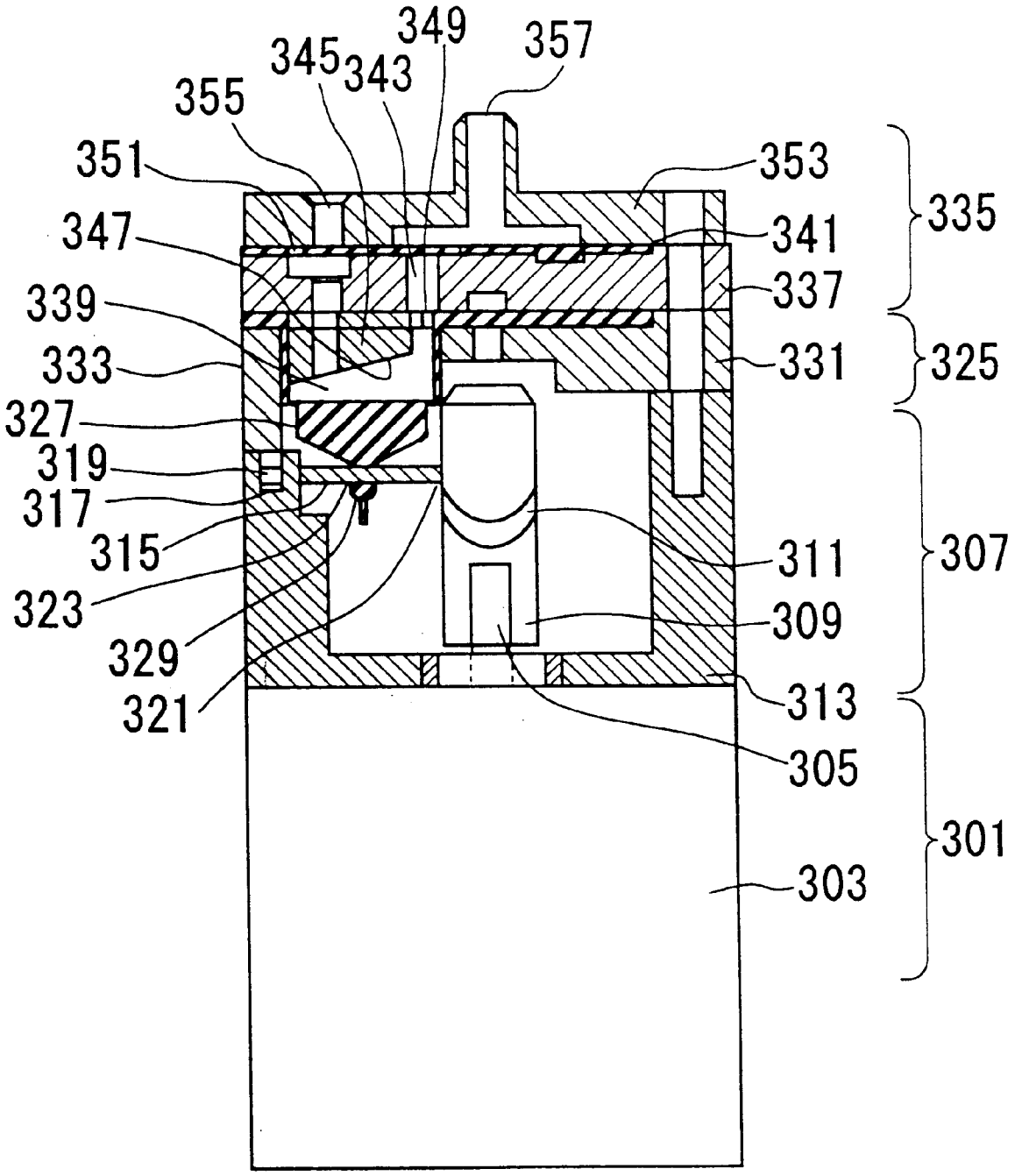
FIG. 24 is a sectional view illustrating the small-sized pump device of the tenth embodiment.

Only one of the drive members 315, in FIG. 24, is illustrated. However, in this embodiment, three drive members are used around the output shaft at intervals each of an angle of approximately 120 degrees. Namely, the drive member may be one in number, or two or more in number, correspondingly to the construction.

In the outer-peripheral portion of an outer case 313 are formed drive-member mounting grooves 317 the number of that corresponds to the number of the drive member 315 pieces. A fixed end 319 of the drive member 315 is fitted into the drive-member mounting groove 317 while a free end 321 thereof is inserted into a concaved groove 311 of the circular-cylindrical surface cam 309.

The drive member 315 is regulated by the drive-member mounting groove 317 in a radial direction movement as viewed with respect to the axial direction of the output shaft and further is also regulated by the same in terms of the rotational movement about the output shaft 305. Therefore, the drive member 315 is only movable in the rotation direction with the fixed end 319 being used as the axis of rotation.

And on the drive member 315 is provided with a retaining portion 323. Into the retaining portion 323 is inserted a coupling portion 329 extending downward from a diaphragm 327 that constitutes a pump portion 325 and that is made of flexible elastic material.

In this embodiment, the coupling portion 329 is substantially spherical. The diameter thereof is larger than the diameter of a hole formed in the retaining portion 323 of the drive member 315 and the coupling portion 329 is made of flexible elastic material. Therefore, by inserting the coupling portion 329 into the retaining portion 323 with a force greater than prescribed, the coupling portion 329 is deformed and passes through the retaining portion 323, whereby the drive member is fixed to the diaphragm 327.

Also, the diaphragm 327 is fitted into an intermediate case 331. By this intermediate case 331, the outer-peripheral portion of a side wall 333, which is a deformable portion of the diaphragm 327, is supported by the intermediate case 311 does not deform unnecessarily.

And an air chamber 339 is formed by an exhaust valve holder 337 constituting a suction/exhaust portion 335 and the diaphragm 327.

In the exhaust valve holder 337 there are provided exhaust openings 343 at the position corresponding to a plurality of air chambers 339 while on the air-chamber-339 side there is formed a convexed portion 345 constituting a pressure-adjusting portion 330.

And, a bottom surface 347 of the convexed portion 345 may be inclined. Further, this angle of inclination may be substantially parallel with an angle of inclination made by a line connecting the fixed end 319 of the drive member 315 and an apex portion 359 of the concaved groove 311.

Also, there may be also used a construction wherein the sectional configuration of the convexed portion 345 of the exhaust valve holder 337 is the same as that of the air chamber 339, whereby the side wall 333 of the diaphragm 327 is clamped by the convexed portion 345 and the intermediate case 331.

On the exhaust valve holder 337 is placed a sheet valve 341. In the sheet valve 341 may be formed one or plurality of the exhaust valves 345 and a suction valves 347. The exhaust valve 345 is provided at the position corresponding to an exhaust opening 343.

On the sheet valve 341 there is a suction valve holder 353. The suction valve holder 353 and the exhaust valve holder 337 clamps the sheet valve 341.

In the suction valve holder 353 is formed a suction opening 355 at a position corresponding to the suction valve 351. At a substantially center portion of the suction valve holder 353 is provided with a circular-cylindrical exhaust port 357. And all that has been discharged from the respective exhaust openings 343 is discharged from the exhaust port 357.

It is to be noted that the suction opening 355 and the exhaust opening 343 are kept sealed from each other by a seal portion (not illustrated) provided on the sheet valve 341, with the result that no air passes between these two openings.

And in the suction valve holder 353, the exhaust valve holder 337, the intermediate case 331, and the outer case 313 there are screw holes at the same relevant positions. These elements are bonded and fixed together by screws.

As still another concrete example of the present invention, the suction/exhaust portion 335 is constituted by the exhaust valve holder 337, and a pressure-adjusting portion 330 for increasing the pressure developed during operation of the pump device by decreasing the internal volume of dead/ unused space in the air chamber is disposed between this exhaust valve holder 337 and the air chamber 339. And the pressure-adjusting portion 330 has the convexed portion 345 protruding into the air chamber 339.

Also, the pressure-adjusting portion 330 has a structure wherein the bottom surface 347 is made to be inclined.

Next, the operation of the pump of this embodiment will be explained using a sectional view of FIG. 26.

When causing an electric current to flow into the motor 303, the output shaft 305 is rotated, and the circular-cylindrical surface cam 309 forcedly inserted onto the output shaft 305 and fixed thereto is also rotated. Simultaneously, the position of the concaved groove 311 also is changed.

The concaved groove 311 of the circular-cylindrical surface cam 309 and the free end 321 of the drive member 315 are mutually coupled with each other. In FIG. 24, the free end 321 of the drive member 315 is located at the apex 359 of the concaved groove 311. Accordingly, the drive member 315 is located at the position raised and closed up to the intermediate case 331 side. The drive member 315 is thereby kept in a state of being inclined by the drive-member mounting groove 317 and the apex 359 of the concaved groove 311. In this state, the diaphragm 327 that is fixed to the upper surface of the drive member 315 is pushed upward.

At this time, the air chamber 339 is kept compressed with the result that the pressure within it becomes high. Therefore, the air within air the chamber 339 passes through the exhaust opening 343, and pushes and opens the exhaust valve 349. Then, the air passes through the exhaust opening 357 and is sent into the cuff band member (not illustrated). In this respect, the operation is the same as in the case of the prior art. At this time, the suction valve 351 is pressed against the suction opening 355 of the suction valve holder 349, whereby the sealability between these two elements is maintained to prevent the leak of the air to the outside.

And, following the concaved groove 311 of the circular-cylindrical surface cam 309, the free end 321 of the drive member 315 goes therealong due to the rotation of the motor 303. Accordingly, the drive member 315 is moved up and down, or vertically, i.e., rotated about the drive-member mounting groove 317. It is thereby possible to highly efficiently convert the rotational movement of the motor 303 to the compression/expansion movement of the air chamber 339.

Figure 26:
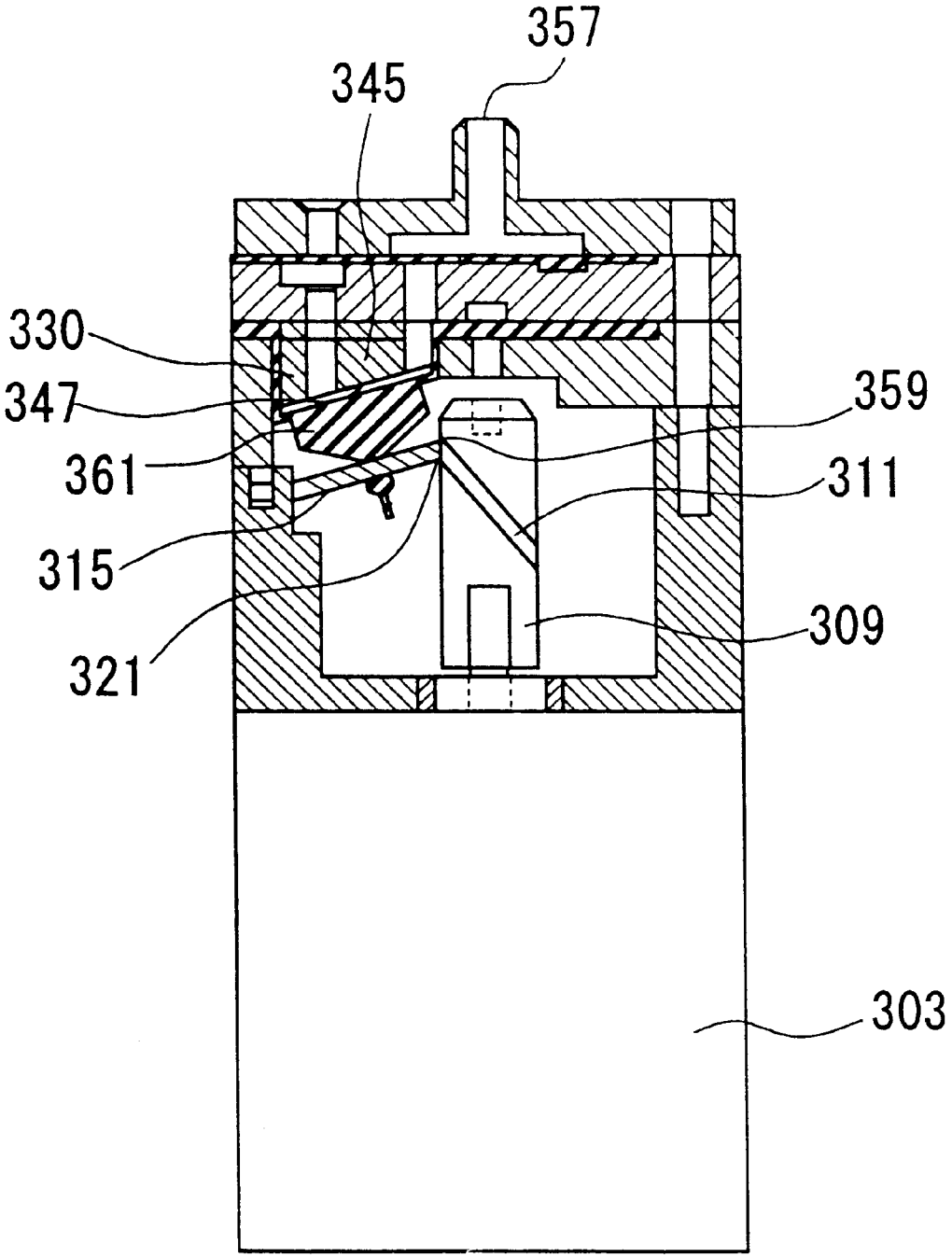
FIG. 26 is a sectional view illustrating the small-sized pump device of the tenth embodiment in a state where this pump device is compressed.

In the pump device that operates in the above-described way, when compression is made as in FIG. 26, the angle of inclination of the bottom surface 347 of the convexed portion 345 of the exhaust valve holder 337 and the movement surface 361 of the diaphragm can become substantially parallel with each other. As a result of this, it is possible to minimize the clearance between the bottom surface 347 and the movement surface 361.

Accordingly, because the volume of the air chamber when the air therein is compressed can be lessened, the compression ratio, which is represented by the ratio between the volume that prevails when the air chamber has been expanded and the volume that prevails when the air chamber has been compressed, can be set to be high. Therefore, it is possible to make high the maximum pressurizing force that is among the characteristics of the blood pressure meter.

FIG. 37 compares blood pressure meters cp3-1, cp3-2, and cp3-3 of the present invention and a conventional blood pressure meter produced by OK company in terms of the maximum pressure, pressurizing time period, current consumption, noise, battery life, etc. Here, regarding the cuff band member of the blood pressure meter, the M cuff is 330 cc in volume (at 280 mm Hg) and the L cuff is 1000 cc in volume (at 280 mm Hg). In the blood pressure cp3-1 to cp3-3 of the present invention, the pressurizing time period when having used the M cuff is 13.7 sec. to 14.9 sec. In contrast to this, the pressurizing time period is 10.5 sec. in the conventional blood pressure meter produced by OK company. On the other hand, the average current consumption when pressurizing the cuff up to 0 to 300 mm Hg was 233.0 mA to 257.4 mA in the blood pressure meter of the present invention and, in the conventional blood pressure meter, was 363.8 mA. Also, regarding the life of the battery as well, the blood pressure meter of the present invention was 1911 times while the conventional one was 1610 times.

Also, in the blood pressure meter of the present invention, the noise was between 50.6 to 53.0 dB whereas in the convention one the noise was 53.3 dB. Accordingly, as compared with the prior art, the noises could be decreased.

Also, in this embodiment, the suction/exhaust portion 405 is constituted by a suction valve holder 423 retaining a sheet-like suction valve 414 and an exhaust valve holder 418 retaining a sheet-like exhaust valve 415. Each of the neighboring areas upon the suction openings and exhaust openings provided in these holders has a suction/exhaust pressure-adjusting portion.

Also, the air chamber 408 is the one that has been made of flexible elastic material.

Figure 27:
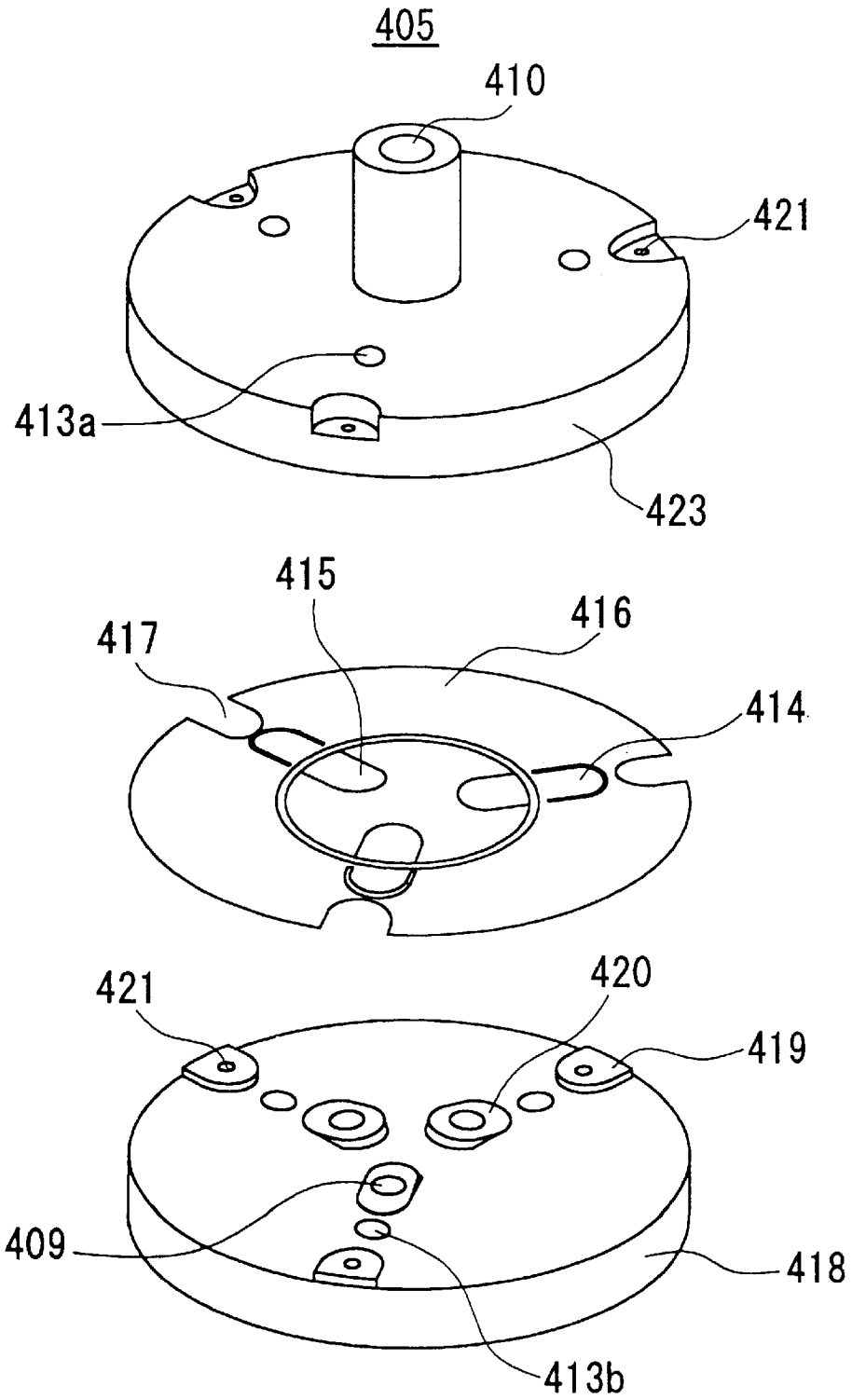
FIG. 27 is an exploded perspective view illustrating the small-sized pump device of the tenth embodiment.
Figure 28:
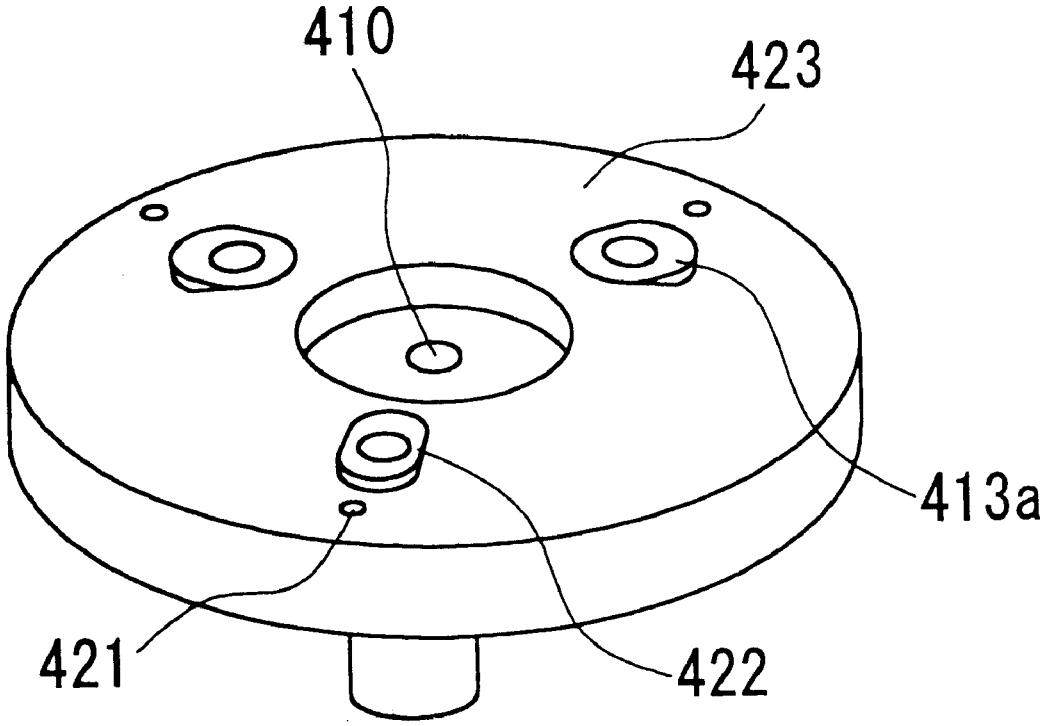
FIG. 28 is a view illustrating a suction valve holder of the small-sized pump device of the tenth embodiment.

Next, the construction of the suction/exhaust portion 405 in the tenth embodiment of the small-sized pump device of the present invention will be explained using an exploded perspective view of FIG. 27 and FIG. 28. Here, the small-sized pump device 401 that is used for explanation is the one that has three air chambers 408, but the number of these air chambers 408 is not limited thereto.

In the small-sized pump device of the present invention, the suction/exhaust portion 405 is constituted by the suction valve holder 423, the suction/exhaust valve integrated type sheet 416, and the exhaust valve holder 418. FIG. 28 is a view taken of the suction valve holder 423 seeing from the reverse side of it. The suction valve holder 423 is provided therein with three suction openings 413*a* and a three screw holes used for assembly 421. Also, in the reverse surface of the suction valve holder 423, at the neighboring area upon the suction opening 413*a* is provided as illustrated step-like portion 422 inclined and having a convexed configuration formed in a peripheral area of the suction opening. The level of the difference in the step like portion 422 is designed so that it may become low on the inner side and high on the outer side.

In the reverse surface of the suction valve holder 423 is provided a counterbore portion in the vicinity of the exhaust opening 410 provided at a central part thereof so that when the exhaust valve 415 has been opened, its forward end portion does not collide with the housing.

As in the case of the suction valve holder 423, the exhaust valve holder 418 also has provided therein with screw holes 421 for use in assembling. A step like portion 419 is provided at the neighboring portion upon this screw hole 421. These level differences 419 and notches 417 of the suction/exhaust valve integrated type sheet 416 are used when performing positioning when installing the suction/exhaust valve integrated type sheet 416 on the exhaust valve holder 418.

On the inner side of the exhaust valve holder 418 are provided with three exhaust openings 409 and on the outer side thereof are provided with three suction openings 413*b*.

Figure 29:
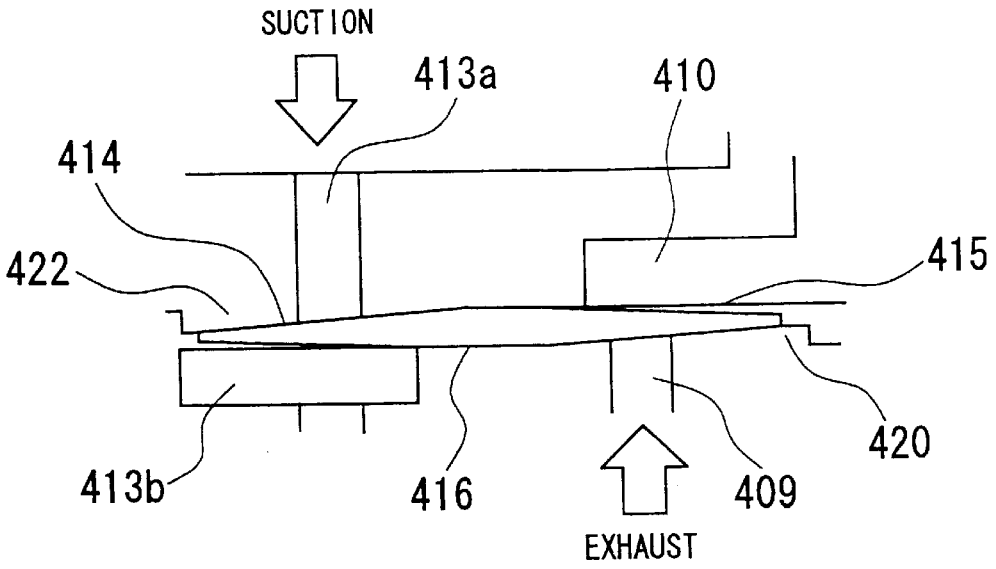
FIG. 29 is an explanatory view illustrating the neighboring portions upon suction and exhaust openings of the small-sized pump device of the tenth embodiment.

As in the case of the suction valve holder 423, on the neighboring areas upon the exhaust openings 409 there are provided as illustrated an inclined step like portion 420. The level difference in the step like portion 420 is designed so that it may become high on the inner side and low on the outer side. FIG. 29 is a typical sectional view illustrating the neighboring portions upon the suction opening 413 and exhaust opening 409.

As illustrated in FIG. 29, at the forward end portions of the suction valve 414 and the exhaust valve 415, the step like portions are formed so that the level in difference of the step like portions 420 as formed in a peripheral area of the exhaust opening and that of the step like portions 422, as formed in a peripheral area of the suction opening become maximum. By this structure being made up, even at the time of low pressure, a larger tension is applied onto each of the portions at which the outer-peripheral edges of the suction valve 414 and the exhaust valve 415 are contacted with, the seal surface. Therefore, the contacting characteristic of the outer-peripheral edges of the valves with respect to the seal surface is improved to thereby enable the prevention of the leak (back flow) of the air. For this reason, the efficiency of the small-sized pump device 401 can be expected to become high.

Here, an explanation has above been given of a case wherein the level differences have been provided on the both neighboring portions upon the exhaust opening 409 and suction opening 413*a*. However, the level difference may be provided on only either one of them.

Namely, in this embodiment, the above-described suction/exhaust pressure-adjusting portion is constructed so that the spacing between the mutually opposing surfaces of the suction valve holder 423 and the exhaust valve holder 418 may be non-uniform.

Figure 30:
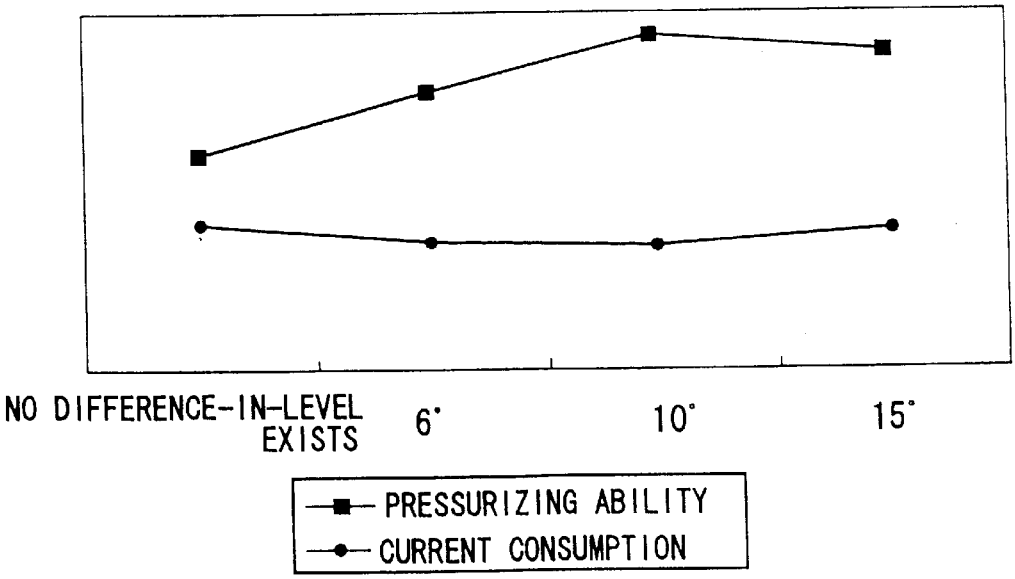
FIG. 30 is a view illustrating the comparison of the pressurizing ability according to the difference in terms of difference-in-level configuration of the neighboring portion of each of the suction/exhaust openings of the tenth embodiment.

FIG. 30 illustrates the pressurizing characteristics (the pressurizing ability and the current consumption) of the small-sized pump device 401 having a suction valve holder 423 which having three different suction valve holders 423, each having above mentioned step like portions, the inclination angle being 6, 10, and 15 degrees respectively, and the exhaust valve holder 418 with no step like portions, as well as the pressurizing characteristic (the pressurizing ability and the current consumption) of the small-sized pump device 401 having the exhaust valve holder 418 and the suction valve holder 423 both of which being provided therein with no step like portion. From the figure, it is seen that both the pressurizing ability and the current consumption are improved due to the provision of the step like portions.

Figure 31:
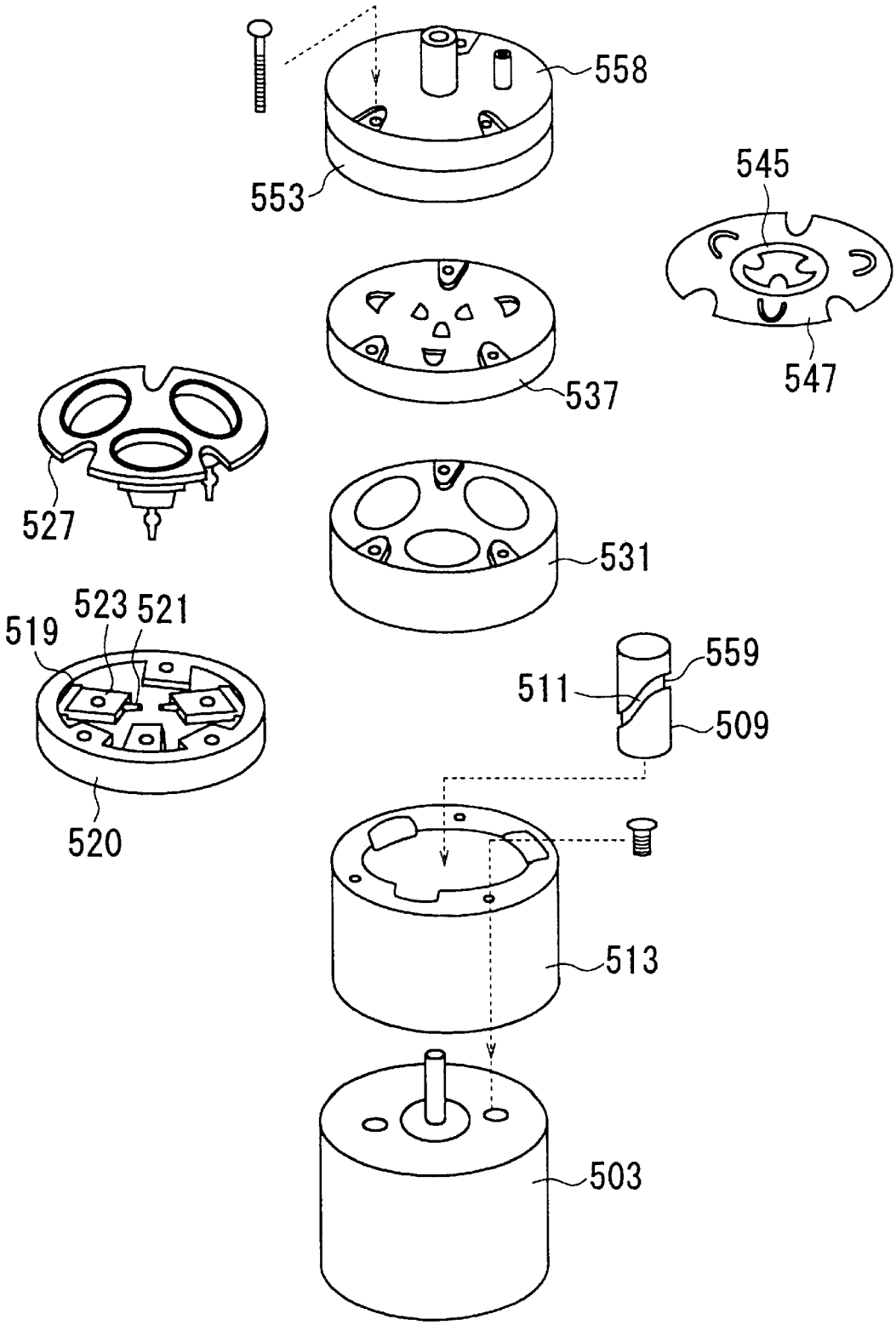
FIG. 31 is an exploded perspective view illustrating the small-sized pump device according to an eleventh embodiment of the present invention.
Figure 38:
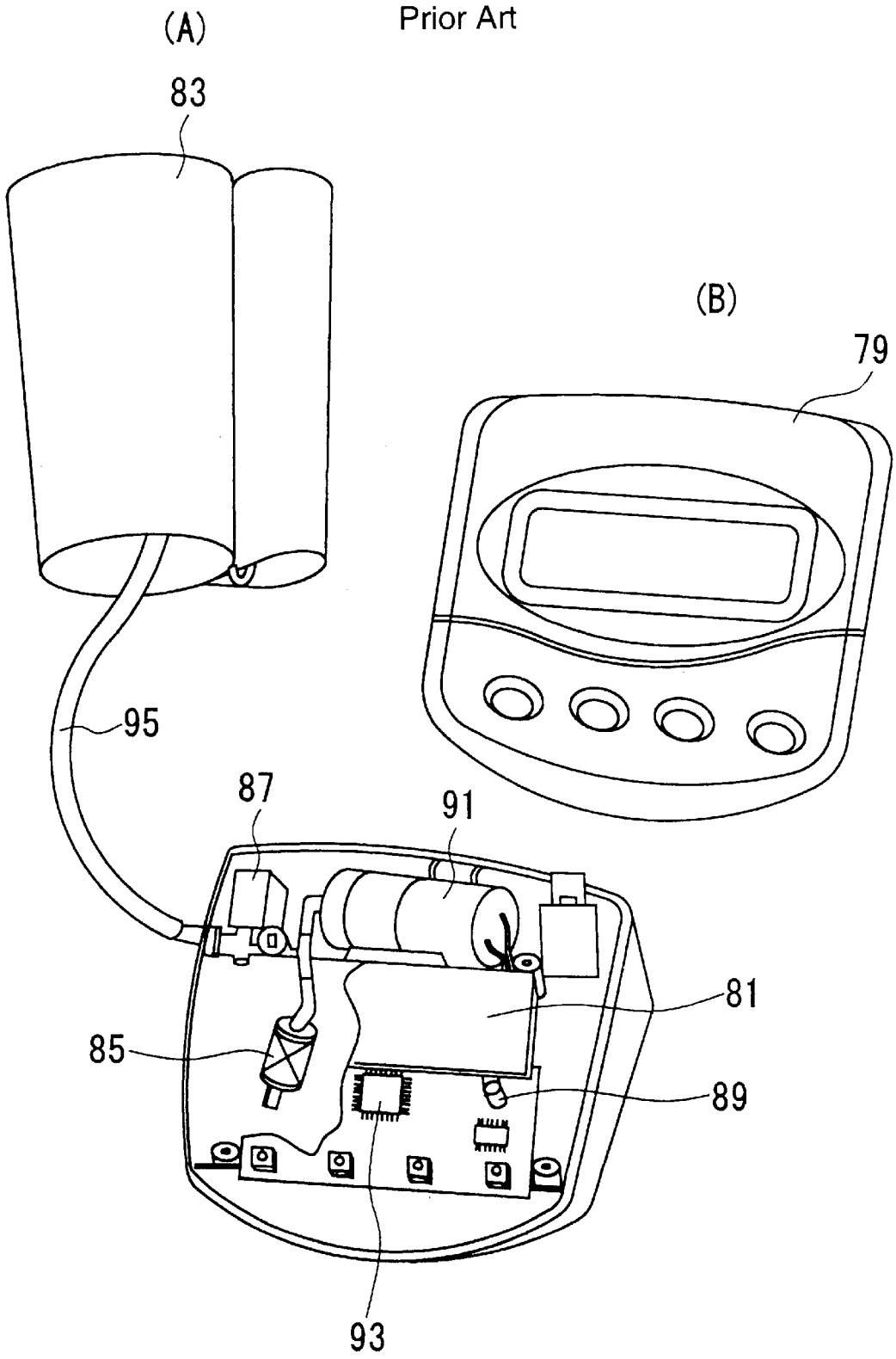
Fig. 38 Prior Art
FIG. 38(A) is an explanatory view illustrating an entire construction as viewed from the bottom surface of a blood pressure meter.
FIG. 38(B) is an explanatory view illustrating a display panel portion of the blood pressure meter.

The construction of the blood pressure meter that has used the small-sized pump device of the present invention is substantially the same as that of the conventional blood pressure meter of FIG. 38. On this account, a twelfth embodiment of the small-sized pump device 91 used in the blood pressure meter of the present invention will now be explained using an exploded perspective view of FIG. 31 and a sectional view of FIG. 32.

A drive source 501 is constituted by a motor 503 and an output shaft 505. Onto the output shaft 505 is fixed by forced insertion, adhesion, etc. a circular-cylindrical surface cam 509 constituting a drive transmission portion 507. In the outer-peripheral surface of the circular-cylindrical surface cam 509 is formed a smooth concaved groove 511 inclined with respect to a plane vertical with respect to the axial direction of the output shaft. As the material of the circular-cylindrical surface cam 509, there is used plastic material. This plastic material preferably is, for example, the one that has less friction resistance and excellent wear resistance, such as polyacetal.

On the surface of the motor 503 existing on the side of the output shaft is mounted by screws, etc. an outer case 513 constituting the drive transmission portion 507. Also, as one more piece of parts constituting the drive transmission portion 507 there is a drive member 515.

The drive member 515 is made-of plastic material such as polyacetal that is low in friction and low in wear. This member is constituted by a free end 521, a retaining portion 523, and a fixed end 519.

The free end 521 has a spherical configuration the diameter of that is substantially the same in dimension as the width of the concaved-groove 511 of the circular-cylindrical surface cam 509.

Also, in this embodiment, the fixed end 519 is formed as thin as 0.3 mm, and the fixed end 519 and a frame member portion 520 are formed integrally with each other.

In this embodiment, illustration is made of three retaining portions 523. However, any number of these retaining portions may be used for example, one, or more than three, in correspondence with the scale and construction of the pump device.

The frame member portion 520 is fixed by being clamped by the outer case 513 and an intermediate case 531 while the free end 521 is inserted into the concaved groove 511 of the circular-cylindrical surface cam 509.

And, the concaved groove 511 of the circular-cylindrical surface cam 509 is formed as a sine wave-like groove.

The retaining portion 523 is connected to the frame member portion 520 by the fixed end 519. Therefore, the retaining portion 523 is regulated in the radial directional movement as viewed with respect to the axial direction of the output shaft. Further, it is also regulated in the rotational movement made about the output shaft 505. Therefore, the portion 523 is only displaceable in the axial direction of the output shaft.

And into the retaining portion 523 there is inserted a coupling portion 529 that extends downward from a diaphragm 527 that constitutes the pump portion 525 and that is made of flexible elastic material.

In this embodiment, the coupling portion 529 is substantially spherical. The diameter thereof is slightly larger than the diameter of the hole formed in the retaining portion 523 of the drive member 515, and in addition the coupling portion 529 is made of flexible elastic material. Therefore, by inserting the coupling portion 529 into the retaining portion 523 with a force greater than prescribed, the coupling portion 529 is deformed. And the coupling portion 529 passes through the retaining portion 523 and thereby is fixed to the diaphragm 527.

Also, the diaphragm 527 is fitted into the intermediate case 531, by which the outer-peripheral portion of a side wall 533 supports this side wall 533, which is a deformable portion of the diaphragm 527, so as not to be subjected to no unnecessary deformation.

And, an air chamber 539 is formed by the exhaust valve holder 537 constituting the suction/exhaust portion 535 and the diaphragm 527.

The kind and hardness of the diaphragm 527 can variously be selected depending upon the characteristics the pump device is demanded to have. In this embodiment, the diaphragm 527 is made using a NBR rubber having a hardness of 30 degrees.

In the exhaust valve holder 537 there are provided exhaust openings 543 at the positions corresponding to a plurality of the air chambers 539. On the other hand, on the side of the air chamber 539, there is formed a convexed portion 545 constituting a pressure-adjusting portion 530.

On the exhaust valve holder 537 there is placed a sheet valve 541. The sheet valve 541 is constituted by the exhaust valve 545 and the suction valve 551. One or plurality number of each of these valves are used, and the exhaust valve 545 is provided at the position corresponding to the exhaust opening 557.

The hardness of each of the exhaust valve 545 and suction valve 551, that constitute the sheet valve 541, can variously be selected depending upon the characteristic the pump device is demanded to have. In this embodiment, it is arranged that the hardness of the exhaust valve be 70 degrees and that of the suction valve be 50 degrees. However, in a case where the hardness of the exhaust valve and that of the suction valve are made to be the same, it becomes possible to integrally form the suction valve 551 and the exhaust valve 545. Therefore, the arrangement becomes easy to assemble and handle. This can reduce the number of the parts used and also reduce the cost.

On the sheet valve 541 there exists the suction valve holder 553. And the suction valve holder 553 and the exhaust valve holder 537 clamps the sheet valve 541.

In the suction valve holder 553 there is formed a suction opening 555 at a position corresponding to the suction valve 551. At a substantially central portion of the suction valve holder 553 is provided an exhaust port 557.

And on the suction valve holder 553 there is a case lid member 558, which has formed therein the exhaust port 557 and a unified suction opening 556.

The unified suction opening 556 is the one that is formed by unifying the openings through which the air flows in. In this embodiment, this suction opening is formed with a diameter of (1 mm.

It is to be noted that the suction opening 555 and the exhaust opening 543 are kept to have sealability from each other by the seal portion (not illustrated) provided on the sheet valve 541. Therefore, no passage of air occurs between these two openings.

And, the case lid member 558 and the suction valve holder 553 are bonded and fixed together by adhesive or the like so that no air may leak from between them. Screw holes exist in these elements as well as the exhaust valve holder 537, the intermediate case 531, and the outer case 513, at the same corresponding positions. All of these elements are bonded and fixed together by screws.

Figure 32:
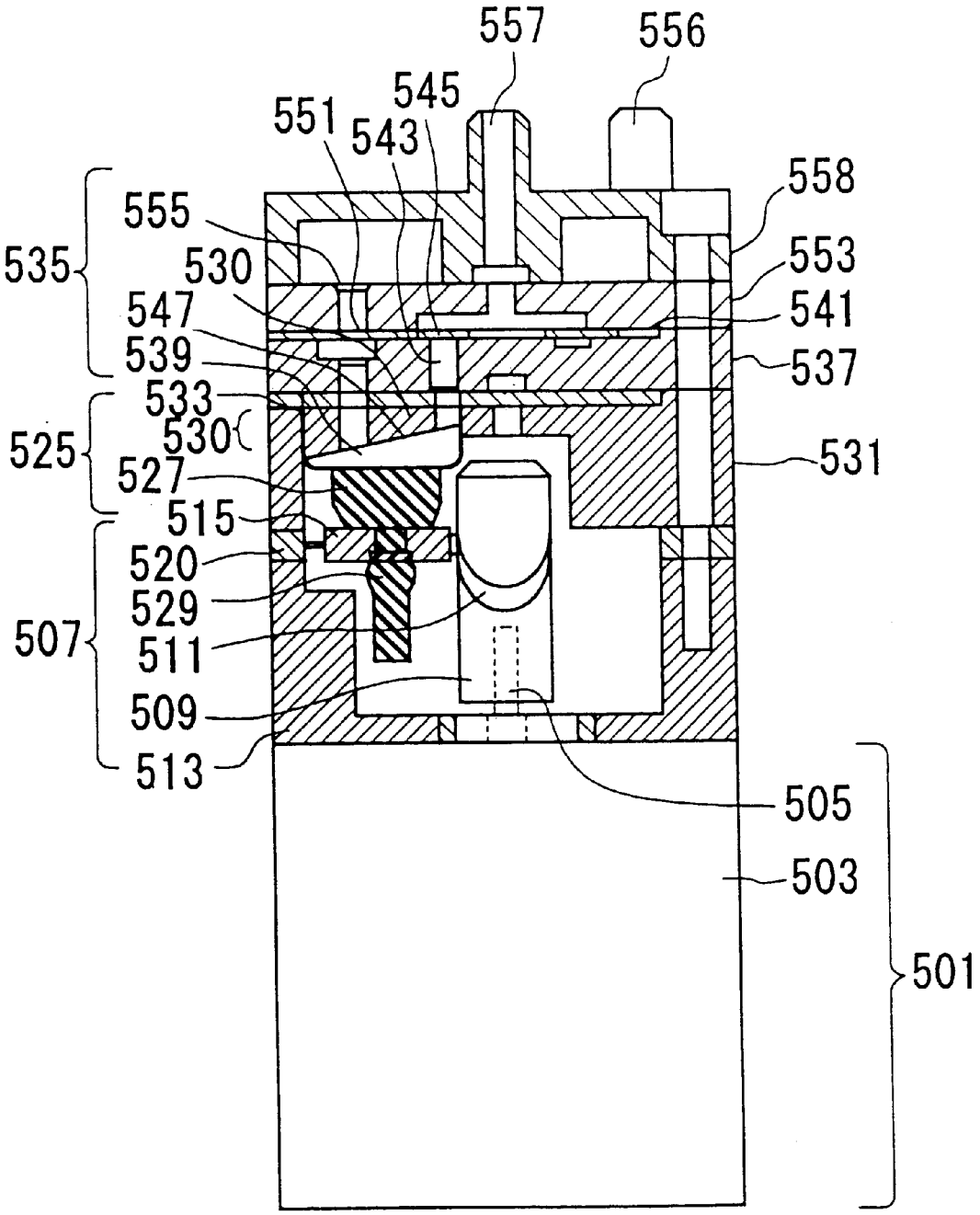
FIG. 32 is a sectional view illustrating the small-sized pump device of the eleventh embodiment.

Further, the pressure-adjusting portion 530 has its bottom surface made substantially parallel with an angle defined by a line connecting the fixed end of the drive member 515 and the apex portion of the cam portion 509, as shown clearly in FIG. 32.

Also, the pressure-adjusting portion 530 is the same in sectional configuration as the air chamber 539.

Further, the suction/exhaust portion 535 is constituted by the suction valve holder 553 and the exhaust valve holder 537 respectively retaining the suction valve 551 and the exhaust valve 545. The peripheral portion of each of the suction opening 555 and the exhaust opening 543, which have been provided in these holders, has a suction/exhaust pressure-adjusting portion.

Also, the suction/exhaust pressure-adjusting portion is characterized by being constructed so that the spacing between the mutually opposing surfaces of the suction valve holder 553 and the exhaust valve holder 537 may be non-uniform.

Next, the operation of the drive member of this embodiment will be explained.

When causing an electric current to pass into the motor 503 and thereby energizing the same, the output shaft 505 is rotated and the circular-cylindrical surface cam 509 fixed to the output shaft 505 by forced insertion, etc. is rotated. Simultaneously, the position of the concaved groove 511 is also changed.

The concaved groove 511 of the circular-cylindrical surface cam 509 and the free end 521 of the drive member 515 are coupled with each other. At the time of compression when the free end 521 of the drive member 515 has located at the apex portion 559 of the concaved groove 511, there is almost no clearance between the spherical portion of the free end 521 and the concaved groove 511 as illustrated in FIG. 33(*a*). In terms of the design, the difference between the diameter of the sphere and the width of the groove only exists.

At this time, the retaining portion 523 of the drive member 515 is located at the position pushed up to the intermediate case 531 side while the frame member portion 520 is fixed by the intermediate case 531 and the outer case 513. Therefore, as illustrated in FIG. 34(*a*), the fixed portion 519 is deformed by being downwardly flexed in the form of a convexed. As a result of this, the retaining portion 523 can be maintained in a state of being inclined.

At this time, the air chamber 539 is kept compressed with the result that the pressure within it becomes high. Therefore, the air within the air chamber 539 passes through the exhaust opening 543, and pushes and opens the exhaust valve 545. Then, the air passes through the exhaust opening 553 and is sent into the cuff band member (not illustrated). In this respect, the operation is the same as in the case of the prior art. At this time, the suction valve 551 is pressed against the suction opening 551 of the suction valve holder 553, whereby the sealability between these two elements is maintained to prevent the leak of the air to the outside.

And, following the concaved groove 511 of the circular-cylindrical surface cam 509, the free end 521 of the drive member 515 goes therealong due to the rotation of the motor 503. Accordingly, the retaining member 523 of the drive member 515 is moved up and down, or vertically. It is thereby possible to highly efficiently convert the rotational movement of the motor 503 to the compression/expansion movement of the air chamber 539.

In the pump device that operates in this way, at the time of expansion, the coupled state between the free end 521 and the concaved groove 511 is as illustrated in FIG. 33(*b*). Namely, the clearance between the concaved groove 511 and the spherical portion of the free end 521 is as in the case where compression is made. Therefore, during the expansion and the compression, the clearance between those two elements can be at all times maintained to be at a fixed value. Therefore, in terms of the design, this clearance can be made small.

And, as illustrated in FIG. 34(*b*), the retaining portion 523 is in a state of being inclined with its free end 521 side being moved downward. The fixed portion 519 is being deformed by being flexed upward in the form of a convexed, in such a way as to smoothly connect the retaining portion 523 and the frame member portion 520 fixed between the outer case 513 and the intermediate case 531.

As described above, the fixed end 519 is deformed by being flexed. Therefore, no friction, vibration, etc. occurs between itself and the frame member portion 520.

Further, the concaved groove 511 of the circular-cylindrical cam 509 is configured as a sine wave. Therefore, the free end 521 has become able to be very smoothly moved along the concaved groove 511.

Also, as another embodiment of the drive member 515, no hindrance occurs even with a construction wherein the fixed end 519 is constituted by a metal thin plate and the drive member is formed by molding it together with the retaining portion 523 and the frame member portion 520.

As one more example, no hindrance occurs even with a construction wherein the portion from the free end 521 to the retaining portion 523 is made using a rigid member of plastic material. And, in this case, a flexible elastic material such as rubber is used in such a way as to cover the surfaces of the fixed end 519, frame member portion 520, and retaining portion 523.

As has been described above, the present invention is characterized by being constructed in such a form as to have combined with each other the rotary member that has formed in its outer-peripheral surface a smooth concaved groove inclined with respect to a plane with respect to the axial direction of the output shaft and the drive member that has a convexed portion mutually coupled with a part of the concaved groove. Therefore, it is possible to highly efficiently convert the rotational movement of the motor to a linear movement whereby air is compressed and expanded.

At this time as well, by forming the convexed portion of the drive member of a circular-columnar pin and loosely inserting the circular-columnar pin into a hole formed in the rotary member, the following can be achieved. Namely, the frictional force between the concaved groove of the rotary member and the convexed portion of the drive member can be reduced. This can achieve the low power consumption.

As has been described above, according to the present invention, there is the following characteristic. Namely, a circular-cylindrical surface cam, which has formed in its outer-peripheral surface the smooth concaved groove inclined with respect to a plane with respect to the axial direction of the output shaft, and the drive member, which is swingably retained at one end by the outer case and is fitted at the other end into the concaved groove inclined with respect to the axial line of the circular-cylindrical surface cam, are combined with each other. Therefore, it is possible to make small the load that is applied onto the motor. It is therefore possible to make small the current value that occurs when the pump device is started. And therefore it is possible to perform a smooth level of starting.

Also, regarding the actual measurement results as well, while the starting current value of the conventional pump is approximately 370 mA, the starting current value of the invention pump is approximately 330 mA. This means that the starting current value becomes able to be reduced as much as approximately 10%.

Accordingly, there is the effect that the re-pressurization characteristic, which is among the characteristics demanded from the pump device for use in the blood pressure meter, is also excellent.

Also, according to the present invention, a convexed portion is provided on the air chamber side of the exhaust valve holder, as the pressure-adjusting portion for making adjustment of the pressure. This enables the reduction of a dead space of the air chamber and thereby enables the improvement in the stable pressurizing force characteristic.

Further, by inclining the convexed portion, it is possible to obtain a high magnitude of pressurizing force. In addition, also by making the angle of inclination substantially parallel with the angle defined by a line connecting the fixed end of the drive member and the apex portion of the concaved groove, it is advantageously possible to obtain a high magnitude of pressurizing force.

And, by making the sectional configuration of the convexed portion the same to that of the air chamber, it is possible to clamp the side wall of the diaphragm between the intermediate case and the convexed portion. Accordingly, it is possible to prevent unnecessary deformation of the side wall and thereby obtain a higher level of compression effect.

Therefore, it is possible to obtain a greater maximum pressurizing force.

Also, regarding the actual measurement results as well, the maximum pressurizing force characteristic of the invention pump has been improved approximately 1.6 to 1.8 times as compared with that of the conventional pump.

Accordingly, by providing the pressure-adjusting portion for making adjustment of the pressure, there is brought about the following prominent effect. Namely, the pump device of the invention has an excellent pressurizing force characteristic that is among the characteristics demanded of the pump device for use in the blood pressure meter.

Further, according to the present invention, an inclined convexed-like level difference has been provided at the neighboring portion upon each, or either one, of the suction and exhaust openings. By this provision, a greater tension is applied to the landing portion of the outer-peripheral edge of each of the suction and exhaust valves. Therefore, the landing characteristic of the outer-peripheral edge with respect to the seal surface is improved. As a result, there is the effect that the pressurization characteristic of the small-sized pump device is improved.

As has been described above, according to the present invention, it is possible to integrally form the drive member, with the result that the fixed end connecting the retaining portion and the frame member portion can be flexibly deformed. Therefore, no friction and no vibration occur. No noises generate. Accordingly, the noise reduction effect can be expected.

Further, the free end is made into a substantially spherical configuration. Therefore, it becomes possible to reduce the sound that generates from between the circular-cylindrical surface cam and the drive member.

And, since the concaved groove of the circular-cylindrical surface cam is formed as a sine wave, the free end has become able to be very smoothly moved along the concaved groove. In terms of this construction as well, there is the noise reduction effect.

Also, because of the case lid member having provided therein the unified suction opening, the sound of opening and closing the suction valve is not directly leaked to outside the pump. This also brings about a good deal of effect for reduction of the noises.

And, as the actual noise characteristic of the pump device, at the position 30 cm laterally away from the pump device, the noise data was 61.8 dB conventionally. In contrast to this, in the pump device of the present invention, the noise data was 52.6 dB, with the result that an-effect as great as −9.2 dB was obtained.

What is claimed is:

1. A pump device including a drive source, a drive transmission portion that is engaged with the drive source, a pump portion that includes an air chamber comprising a diaphragm/bellows engaged with a drive member of the drive transmission portion, and a suction/exhaust portion that includes a suction valve and an exhaust valve, each of which communicates with the air chamber of the pump portion, wherein the drive transmission portion has a cylindrical member, rotatably-supported about a rotation axis on a drive output shaft of the drive source, a cam portion formed on a peripheral circumferential surface of the rotary cylindrical member so as to have a sinusoidal configuration around the circumference of the rotary cylindrical member so as to define a sinusoidal movement in the direction of the rotation axis as the cylindrical member is rotated, and one end of said drive member engages with the cam portion and a second end of said drive member is pivotably supported by a part of the pump portion; and the air chamber is constructed so that an internal volume thereof may be compressed and expanded according to displacement movements of said drive member which engages the diaphragm/bellows of the air chamber and responds to rotation movements of the cam portion.

2. A pump device according to claim 1, wherein the cam portion formed on the peripheral surface of the rotary cylindrical member is constructed so as to cause the drive member to be displaced at a prescribed angular pitch of slope of the cam portion relative to circumferential rotation of the rotary cylindrical member.

3. A pump device according to claim 1, wherein the drive source is a motor.

4. A pump device according to claim 1, wherein the rotary cylindrical member of the drive transmission portion has a circular-peripheral surface cam portion.

5. A pump device according to claim 4, wherein said circular-peripheral surface cam portion consists of a concaved groove and is combined with the drive member having a convexed portion at least a part of which engages with the concaved groove.

6. A pump deice according to claim 5, wherein the convexed portion of the drive member comprises a circular-columnar pin which is inserted into a hole formed in the drive member.

7. A pump device according to claim 1, wherein the suction/exhaust portion comprises a suction valve holder and an exhaust valve holder, which respectively have a suction valve and an exhaust valve, and in a peripheral area of a suction opening and an exhaust opening that are provided in the holders, and a suction/exhaust pressure adjusting portion.

8. A pump device according to claim 7, wherein the suction/exhaust pressure-adjusting portion is constructed so that the spacing between mutually opposing surfaces of the suction valve holder and the exhaust valve holder is non-uniform.

9. A pump device according to claim 8, wherein the suction/exhaust pressure-adjusting portion comprises an inclined, relative to the rotation axis, convexed step like portion provided in a peripheral area formed at least one of the suction opening and exhaust opening of the suction valve holder and exhaust valve holder, respectively.

10. A pump device including a drive source, a drive transmission portion that is engaged with the drive source, a pump portion that includes an air chamber comprising a diaphragm/bellows engaged with a drive member of the drive transmission portion, and a suction/exhaust portion that includes a suction valve and an exhaust valve, each of which communicates with the air chamber of the pump portion, wherein the drive transmission portion has a cylindrical member, rotatably-supported about a rotation axis on a drive output shaft of the drive source, a cam portion formed on a peripheral circumferential surface of the rotary cylindrical member so as to have a sinusoidal configuration around the circumference circumferential configuration while having a prescribed angle with respect to a rotation axis of the rotary cylindrical member so as to define a sinusoidal movement in the direction of the rotation axis as the cylindrical member is rotated, and a said drive member, a part of which engages with the cam portion, wherein the drive member has a fixed end formed integrally with a frame member portion; and the air chamber is constructed so that an internal volume thereof may be compressed and expanded according to displacement movements of said drive member which engages the diaphragm/bellows of the air chamber and responds to rotation movements of the cam portion.

11. A pump device according to claim 10, wherein one end of the drive transmission portion is fixed to a part of an outer frame portion of the pump device.

12. A pump device according to claim 11, wherein the drive transmission portion has one end portion thereof displaced in response to displacement of the cam portion, and is configured so that the drive transmission portion swings about said fixed portion thereof which serves as a rotatably-supporting point.

13. A pump device according to claim 11, wherein the drive transmission portion has one end portion thereof displaced in response to displacement of the cam portion, and is configured so that the drive transmission portion bends about said fixed portion thereof which serves as a fulcrum.

14. A pump device according to claim 10, wherein the suction/exhaust portion includes means for preventing the back-flow of air.

15. A pump device according to claim 10, wherein the drive member has a fixed end formed integrally with a frame member portion.

16. A pump device according to claim 10, wherein the cam portion has a concaved groove formed in a sine wave configuration.

17. A pump device according to claim 10, further including a case lid member constituting the suction/exhaust portion.

18. A pump device according to one of claims 1 to 6 and 10, wherein the cam portion comprises one continuous line of concaved groove portion.

19. A pump device according to one of claims 1 to 6 and 10, wherein the pump device is a part of a blood pressure measuring device.

20. A pump device according to one of claims 1 to 6 and 10, wherein the number of the air chambers is two, or more than two.

21. A pump device according to claim 20, wherein a plurality of the air chambers are disposed on the same plane.

22. A pump device according to one of claims 1 to 6 and 10, wherein a plurality of the air chambers are disposed around said drive source as a center.

23. A pump device according to claim 22, wherein the pump portion has an exhaust valve holder, a sheet valve disposed on the exhaust valve holder, and a suction valve holder disposed on the sheet valve.

24. A pump device according to claim 23, wherein the suction/exhaust portion comprising the exhaust valve holder and a pressure increasing portion for increasing the pressure developed during operation of the pump device by decreasing the internal volume of dead/unused air space in the air chamber is formed between the suction/exhaust portion and the air chamber.

25. A pump device according to claim 24, wherein the pressure increasing portion has a convexed portion protruding into the air chamber.

26. A pump device according to claim 25, wherein the pressure increasing portion has a bottom surface which is inclined relative to the rotation axis.

27. A pump device according to claim 24, wherein the pressure increasing portion has a bottom surface which is substantially parallel with a straight line connecting a fixed end of the drive member and an apex portion of the cam portion.

28. A pump device according to claim 23, wherein the pressure increasing portion has the same sectional configuration as that of the air chamber.

29. A pump device according to one of claims 1 to 6 and 10, wherein the air chamber is made of elastic material.

30. A pump device according to one of claims 1 to 6 and 10, wherein the drive transmission portion is joined to an end portion of the air chamber.

31. A pump device according to one of claims 1, 6 and 10, wherein a plurality of the air chambers are disposed two or more in number on the same plane.

32. A pump device including a drive source, a drive transmission portion that is engaged with the drive source, a pump portion that includes an air chamber comprising a diaphragm/bellows engaged with a drive member of the drive transmission portion, and a suction/exhaust portion that includes a suction valve and an exhaust valve, each of which communicates with the air chamber of the pump portion, wherein the drive transmission portion has a cylindrical member, rotatably-supported about a rotation axis on a drive output shaft of the drive source, a cam portion formed on a peripheral circumferential surface of the rotary cylindrical member so as to have a sinusoidal configuration around the circumference of the rotary cylindrical member so as to define a sinusoidal movement in the direction of the rotation axis as the cylindrical member is rotated, and said drive member, a part of which engages with the cam portion; and the air chamber is constructed so that an internal volume thereof may be compressed and expanded according to displacement movements of said drive member which engages the diaphragm/bellows of the air chamber and responds to rotation movements of the cam portion, wherein the drive member has a free end forming substantially a spherical configuration.

33. A blood pressure meter comprising a display, a control circuit, a pressure sensor, and a slow leak valve, and a pump device comprising a drive source, a cylindrical surface cam rotatably supported by an output shaft, a drive transmission portion which engages an air chamber comprising a diaphragm/bellows engaged with a drive member of the drive transmission portion which is moved up and down by the cylindrical surface cam, a pump portion, and a suction/exhaust portion, and wherein the suction/exhaust portion comprises an exhaust valve holder, and a pressure increasing portion for increasing the pressure developed during operation of the pump device by decreasing the internal volume of dead/unused air space in the air chamber being provided on a surface of said exhaust valve holder facing said air chamber.

34. A blood pressure meter comprising a display, a control circuit, a pressure sensor, and a slow leak valve, and a pump device comprising a drive source, a cylindrical surface cam rotatably supported by an output shaft, a drive transmission portion which engages an air chamber comprising a diaphragm/bellows engaged by a drive member of the drive transmission portion which is moved up and down by the cylindrical surface cam, a pump portion, and a suction/exhaust portion, and wherein the suction/exhaust portion comprises an exhaust valve holder, and a pressure increasing portion for increasing the pressure developed during operation of the pump device by decreasing the internal volume of dead/unused air space in the air chamber, the pressure increasing portion being provided on a surface of said exhaust valve holder facing said air chamber.

* * * * *